US010609980B2

(12) United States Patent
Weidl et al.

(10) Patent No.: US 10,609,980 B2
(45) Date of Patent: Apr. 7, 2020

(54) MODULAR SHOE

(71) Applicant: adidas AG, Herzogenaurach (DE)

(72) Inventors: Jürgen Weidl, Herzogenaurach (DE); Antonio Jaime Zea, Jr., Herzogenaurach (DE); Florian Fleischer, Herzogenaurach (DE); Adrian Francois Noirhomme, Herzogenaurach (DE); Marco Müller, Herzogenaurach (DE); Martin Love, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 15/529,111

(22) PCT Filed: Dec. 21, 2015

(86) PCT No.: PCT/EP2015/080805
§ 371 (c)(1),
(2) Date: May 24, 2017

(87) PCT Pub. No.: WO2016/113082
PCT Pub. Date: Jul. 21, 2016

(65) Prior Publication Data

US 2017/0303627 A1 Oct. 26, 2017

(30) Foreign Application Priority Data

Jan. 15, 2015 (DE) ..... 10 2015 200 523

(51) Int. Cl.
*A43B 3/24* (2006.01)
*A43B 1/00* (2006.01)
(Continued)

(52) U.S. Cl.
CPC ..... *A43B 1/0072* (2013.01); *A43B 3/0047* (2013.01); *A43B 3/24* (2013.01);
(Continued)

(58) Field of Classification Search
CPC ..... A43B 3/16; A43B 3/24; A43B 3/244
(Continued)

(56) References Cited

U.S. PATENT DOCUMENTS 997,657 A * 7/1911 Drake ..... A43B 5/06 36/129
2,825,155 A 3/1958 Hines
(Continued)

FOREIGN PATENT DOCUMENTS

CN 1929757 3/2007
CN 1993064 7/2007
(Continued)

OTHER PUBLICATIONS

European Application No. 15816776.7, Office Action dated Jun. 22, 2017, 6 pages.
(Continued)

*Primary Examiner* — Marie D Bays
(74) *Attorney, Agent, or Firm* — Kilpatrick Townsend & Stockton LLP

(57) ABSTRACT

The present invention relates to a modular shoe (1700) in particular a sports shoe, with a sock like outer shoe (1750) and a frame (1710). The sock like outer shoe is provided for a releasable arrangement around the frame. The sock like outer shoe may comprise a plurality of profile elements (1765), wherein at least one of the profile elements extends from an outer side of the sock like outer shoe. A region of the at least one of the profile elements may be configured to releasably engage in a formfitting manner with a lower side of the frame of the modular shoe.

26 Claims, 28 Drawing Sheets

Figure 1A:
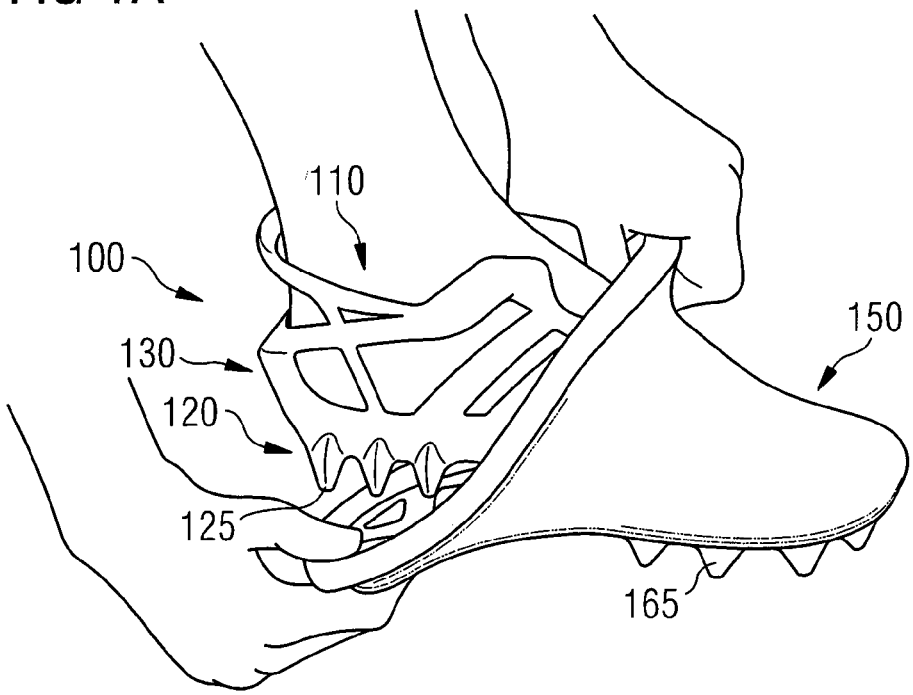

(51) Int. Cl.
*A43B 3/00* (2006.01)
*A43B 5/02* (2006.01)
*A43B 5/18* (2006.01)

(52) U.S. Cl.
CPC ..... *A43B 3/242* (2013.01); *A43B 3/244* (2013.01); *A43B 3/246* (2013.01); *A43B 5/02* (2013.01); *A43B 5/025* (2013.01); *A43B 5/18* (2013.01); *A43B 5/185* (2013.01); *A43B 3/00* (2013.01)

(58) Field of Classification Search
USPC ..... 36/100, 101, 7.1 R, 15
See application file for complete search history.

(56) References Cited

U.S. PATENT DOCUMENTS

| | | | | |
|---|---|---|---|---|
| 3,559,310 | A | 2/1971 | Kiela | |
| 5,086,576 | A | 2/1992 | Lamson et al. | |
| 5,367,791 | A * | 11/1994 | Gross | A43B 13/181 36/25 R |
| 6,038,792 | A | 3/2000 | Hauter | |
| 6,915,596 | B2 * | 7/2005 | Grove | A43B 13/223 36/100 |
| 7,140,129 | B2 * | 11/2006 | Newson | A43B 5/18 36/100 |
| 7,730,636 | B2 | 6/2010 | Auger et al. | |
| 8,196,320 | B2 | 6/2012 | Droege et al. | |
| 8,789,297 | B1 | 7/2014 | Doyle et al. | |
| 2002/0066208 | A1 * | 6/2002 | Hall | A43B 3/0078 36/7.3 |
| 2004/0255486 | A1 * | 12/2004 | Pawlus | A43B 3/0047 36/10 |
| 2005/0066544 | A1 * | 3/2005 | Beak | A41B 11/008 36/43 |
| 2005/0188562 | A1 * | 9/2005 | Clarke | A43B 5/18 36/15 |
| 2008/0168681 | A1 * | 7/2008 | Andersen | A43B 3/0047 36/100 |
| 2008/0250666 | A1 * | 10/2008 | Votolato | A43B 3/16 36/7.1 R |
| 2008/0271343 | A1 * | 11/2008 | Ordenes Haag | A43B 3/24 36/101 |
| 2008/0289222 | A1 * | 11/2008 | Candrian | A43B 1/0027 36/101 |
| 2009/0100713 | A1 * | 4/2009 | Adami | A43B 3/0047 36/100 |
| 2009/0183392 | A1 | 7/2009 | Shane | |
| 2010/0236100 | A1 * | 9/2010 | Ho | A43B 1/0081 36/100 |
| 2010/0301632 | A1 | 12/2010 | Bryne et al. | |
| 2011/0047829 | A1 | 3/2011 | Bell et al. | |
| 2011/0314701 | A1 | 12/2011 | Rod, III et al. | |
| 2013/0263468 | A1 * | 10/2013 | Ciccarelli | A43B 3/16 36/7.1 R |
| 2014/0075787 | A1 | 3/2014 | Cartagena | |
| 2014/0202045 | A1 | 7/2014 | Glassman et al. | |
| 2014/0208617 | A1 | 7/2014 | Foxen et al. | |
| 2015/0342261 | A1 * | 12/2015 | Boucher | A43B 1/04 36/84 |

FOREIGN PATENT DOCUMENTS

| | | |
|---|---|---|
| CN | 101909471 | 12/2010 |
| DE | 102004011680 | 9/2005 |
| EP | 2308334 | 4/2011 |
| EP | 2338370 | 11/2014 |
| JP | 49144447 | 12/1974 |
| JP | 02145103 | 12/1990 |
| JP | 2007507323 | 3/2007 |
| JP | 2011120915 | 6/2011 |
| JP | 2011520568 | 7/2011 |
| WO | 2005092136 | 10/2005 |
| WO | 2014096561 | 6/2014 |

OTHER PUBLICATIONS

Japanese Application No. 2017-517328, Office Action dated Feb. 15, 2018, 6 pages (3 pages of the original document and 3 pages of the English translation).
German Patent Appl. No. 102015200523.2, Office Action dated Oct. 14, 2015, 6 pages (No English translation available. A summary of the Office Action is provided in the Transmittal Letter submitted herewith).
European Patent Appl. No. 15816776.7, Office Action dated Dec. 9, 2016, 7 pages.
International Patent Application No. PCT/EP2015/080805, International Search Report and Written Opinion dated Apr. 29, 2016, 10 pages.
Japanese Patent Application No. 2017-517328, Office Action dated Dec. 18, 2018, 9 pages (5 pages for the original document and 4 pages for the English translation).
Japanese Patent Application No. 2017-517328, Office Action dated Apr. 2, 2019, 8 pages (English translation submitted).
Chinese Application No. 201580060555.8, Office Action dated May 15, 2019, 14 pages (machine English translation provided).
European Patent Application No. 19168160.0, Extended European Search Report dated Sep. 10, 2019, 5 pages.
German Patent Application No. 102015200523.2, Office Action dated Apr. 10, 2019, 12 pages (English machine translation provided).

* cited by examiner

MODULAR SHOE

1. REFERENCE TO RELATED APPLICATIONS

This application is the U.S. national phase entry of International Patent Application No. PCT/EP2015/080805, filed Dec. 21, 2015, which claims the benefit of DE 102015200523.2, filed Jan. 15, 2015, both of which are herein incorporated by reference in their entireties.

2. TECHNICAL FIELD

The present invention related to a modular shoe, in particular a sports shoe.

3. PRIOR ART

Shoes, in particular sports shoes, as for example soccer shoes, generally have an upper and a sole.

The upper primarily serves to fix the foot within the shoe and on top of the sole. Additionally, the upper can be configured to protect the foot from dirt, water, heat, cold etc.

The sole of a shoe primarily serves to protect the feet from injuries, which may for example be caused when stepping on uneven surfaces. The sole can further cushion ground reaction forces exerted on the musculoskeletal system of the wearer while walking and can thus contribute to preventing injuries.

In particular on soles of shoes used on soft, steep or wet surfaces, as for example soccer shoes, hockey shoes, rugby shoes or football shoes but also, for example, hiking shoes, profile elements are usually provided, which ensure an improved stability of the sole. For example, studs, nubs or other indentation or elevation profiles can be provided on the sole as profile elements.

Shoes with profile elements can in particular be used outdoors, for example in order to play soccer, where many different external conditions may arise. Depending on terrain conditions, climate or weather, different levels of stability and different properties of the upper (e.g., insulation, waterproofness, ventilation, adhesion properties etc.) can be desirable, which require different geometries of the profile elements or material properties of the shoe.

From the prior art, numerous approaches are known for providing e.g. exchangeable studs for a shoe. Representative of the plurality of constructions known in the art, the known screw-in studs for soccer shoes are mentioned here, wherein the studs have a screw-shaped base, which is releasably screwed into a thread of the sole.

Additionally to exchanging studs, DE 10 2004 0111680 discloses a modular shoe with studs. To this end, a chassis is arranged in the upper. Together with a plurality of studs, which are attached to the chassis through a lower side of the upper, a stable shoe with studs is to be provided. However, mounting and unmounting a plurality of studs is time consuming. Additionally, single studs can get lost easily.

Besides releasable studs, covers or gaiters for shoes are known in the prior art from different fields, which may influence the properties of the shoe. US 2011/0314701 for example discloses a shoe cover for a bicycle shoe to improve aerodynamics. U.S. Pat. No. 8,789,297 shows a disposable shoe cover for a shoe to be used while bowling, which modifies the friction of the shoe on the ground. Further shoe covers are for example known from US 2010/0301632 A1, U.S. Pat. No. 5,086,576 and US 2014/0202045 A1. However, these covers are usually only loosely connected with the shoe so that the cover can easily slip and the wearer of the shoe can fall. In particular for outdoor usage, sufficient sturdiness (Stabilität) cannot be provided with these covers. Furthermore, these covers are not compatible with profile elements of the shoe.

EP 2 338 370 B1 discloses footwear, which is in particular to be used for tennis, with an upper member that has a midsole member fixedly attached to it. The footwear further has a removable outsole member. The outsole member includes outsole attachment elements at its exterior major surface. At the interior major surface of the outsole member, outside regions of the attachment elements, the outsole member includes three raised rib areas, which help engage the outsole member with the midsole member.

From US 2014/0208617 a spat is known, which is fastenable around the ankle area of a shoe with the help of a hook and loop fastener and which—as a replacement for an ankle tape—is to support the ankle area. Spats or gaiters however always have the issue that they shift easily since they do not encompass the foot fully and thus have open ends.

Apart from that, profile elements are usually permanently connected with the sole and the upper in the prior art to provide sufficient sturdiness. As examples, reference is made to U.S. Pat. Nos. 7,730,636 and 8,196,320 B2, wherein a sole with cleats is connected to the shoe by means of an adhesive or stitching, respectively.

U.S. Pat. No. 3,559,310 A discloses an overshoe for golf shoes. Moreover, WO 2005/092 136 A1 discloses an article of footwear with perforated covering and removable components.

Important properties of the shoe, such as the type of the profile elements, the shape of the shoe or also the ventilation properties of the shoe are thus currently only adaptable in an insufficient manner. When conditions change, either one has to revert to a completely different shoe or, as explained above, all studs need to be unscrewed and screwed in again.

It is thus an object of the present invention to provide a shoe with profile elements, which is adaptable to different requirements of the respective wearer in an improved manner compared to constructions known from the prior art.

4. SUMMARY OF THE INVENTION

This objective is at least partially achieved by a sock-like outer shoe for a modular shoe according to claim 1, by a frame for a modular shoe according to claim 15, and by a modular shoe according to claim 25.

According to an embodiment, a sock-like outer shoe is provided for releasable arrangement around a frame to provide a modular shoe, in particular a modular sports shoe. The sock-like outer shoe comprises a plurality of profile elements, wherein at least one of the profile elements extends (e.g., extends away) from an outer side of the sock-like outer shoe. A region of the at least one of the profile elements is configured to releasably engage in a form-fitting manner with a lower side of the frame of the modular shoe.

This embodiment allows easily altering the outer properties of the modular shoe, which are determined by the outer shoe and its profile elements, by simply changing the outer shoe. Instead of exchanging all profile elements individually, the profile elements are arranged on the outer shoe so that the outer shoe of the modular shoe can be changed in a single simple step.

For example, when it suddenly starts to rain, a modular soccer shoe can be easily provided with a waterproof outer shoe with studs, which are particularly well suited for wet surfaces. Instead of changing the entire shoe, which has to be newly broken in, which often leads to blisters or pressure marks, only the outer shoe needs to be changed. The frame of the modular shoe, around which the outer shoe is arranged, can be continued to be used. Due to the fact, that the profile elements are provided on the outer shoe, no additional sealing between the outer shoe and the frame is necessary. Therefore, a waterproof modular shoe can be provided.

The form-fitting engagement between a region of at least one profile element with the lower side of the frame further provides sufficient sturdiness for the connection between the frame and the outer shoe, which also satisfies the high requirements, which for example are to be fulfilled by soccer shoes. With a form-fit between the outer shoe and the frame directly in the region of the profile elements, where forces between the foot and the ground are transmitted, the arising forces can be directly transferred between the frame and the outer shoe there, such that shear forces can only occur to a very low extent. Thus, a particularly high sturdiness can be provided. The region of the form-fit can for example be respectively arranged at an upper end of the profile element. The region can be arranged in the center of the upper end of the profile element. For example, an indentation in the profile element or a protrusion can be provided there, into which a corresponding protrusion or indentation of the lower side of the frame can fit in a form-fitting manner. The form-fitting engagement of the outer shoe at the lower side of the frame and the arrangement of the outer shoe around the frame allow easy positioning and safe fixing of the outer shoe and its profile elements around the frame. Increased static friction between the outer shoe and the frame can also be provided, for example by using appropriate materials in the region of the at least one of the profile element and/or on the lower side of the frame. Thus, a relative movement can be further suppressed.

The constructive separation of frame and outer shoe enables both elements to be optimized with regard to their respective properties, for example fixing the shoe on the foot or providing outer properties, respectively (for example insulation/ventilation, adhesion or cushioning properties upon contact with a ball). Also manufacturing of the shoe is simplified since the frame and the outer shoe do not have to be elaborately sewed or bonded (e.g., glued). As a result, seams, adhesives or other connection elements can be economized, whereby the shoe can be provided more easily and in a more environmentally sustainable way.

Moreover, a plurality of profile elements can be provided, which extend from the outer side of the sock-like outer shoe, wherein a respective region of each profile element is configured to releasably engage in a form-fitting manner with the lower side of the frame of the modular shoe.

The outer shoe can be configured such that the plurality of profile elements comprises a plurality of studs. The studs can be adapted with regard to their shape and their size to specific surfaces and/or weather conditions. Therefore, with a simple change of the outer shoe, an optimum stability can be provided for each surface. One or more profile elements may be configured as a stud. Additionally or alternatively to studs, other profile elements may be provided, such as nubs or grooves.

The plurality of profile elements of the outer shoe can be configured so that at least one of the profile elements comprises an indentation for the form-fitting engagement with a protrusion on the lower side of the frame. The form-fit is thus provided below the frame near the ground, which contributes to minimizing the shear forces arising at the contact areas. The profile elements can be configured to penetrate the ground and to extend below an outer side of the outer shoe, which is provided as the area of contact with the ground. The form-fitting engagement can therefore be provided below and/or substantially at the same height as the area of contact with the ground so that shear forces and the risk of twisting the ankle is particularly minimized. Additionally, the form-fitting engagement can be provided in a compact way since the protrusion formed by a profile element at the lower side of the outer shoe can be used for forming the indentation at the upper side of the outer shoe. The protrusion can also be configured as a supporting element for the profile element.

It is stressed that form-fitting engagement does not require that all outer faces of e.g. a protrusion on the lower side of the frame are in contact with e.g. corresponding faces of an indentation in a profile element (or the outer faces of a protrusion in a region of a profile element with corresponding faces of an indentation on the lower side of the frame). Rather, it is sufficient that a lateral movement, i.e. a relative movement in the plane of the lower side of the frame between the outer shoe and the frame, is substantially excluded while wearing the provided modular shoe by the form-fitting engagement. This can be ensured by a corresponding engagement, e.g. between a protrusion in an indentation. The indentation and the corresponding protrusion can be vertically arranged. For example, they can be cylindrically configured and/or can be downwardly tapered in a funnel-shape, resulting in a funnel-shaped engagement. Due to an at least partial or e.g. also full contact between the side faces of the respective cylinder and/or funnel, a lateral movement between the frame and the outer shoe can be excluded. A contact of a funnel-shaped protrusion and/or a funnel-shaped taper can also limit a movement of the frame relative to the outer shoe in a downward direction. To this end, a contact at the front faces of the respective funnel and/or cylinder is not necessarily required. However, such a contact can in some examples be provided fully or at least partially. Other shapes of the indentations or the protrusions, respectively, are also conceivable, also non-rotationally symmetric ones, e.g. triangular-shaped ones etc. In some examples, a protrusion and a corresponding indentation can also be arranged in an inclined manner. Thus, the form-fitting engagement can also contribute to prevent an upward movement of the frame relative to the outer shoe The outer shoe can comprise a flexible material, in particular a textile, a fabric, a textile fabric, a polyurethane-(PU)-coated expansible textile, a knitted fabric, polyurethane, leather, for example kangaroo leather, polyamide 12, a polyether block amide (PEBA) and/or a thermoplastic polyurethane (TPU). Using a flexible material ensures that the outer shoe adjusts to the frame and to the shape of the foot. A good fit of the modular shoe can thus be ensured. For example, a flexible material can contribute to the outer shoe fitting tightly around the foot like a sock. The outer shoe can cover the entire foot.

The mentioned materials are also in particular suitable for functionalizing the outer shoe and/or for providing various optical appearances of the outer shoe by coating, flocking, laminating, spraying, bonding and/or printing, for example using screen printing or other printing methods, functional layers in predetermined zones. For example, a zone can be provided with an increased stretchability, elasticity, flexibility, abrasion resistance and/or particular adhesion properties. Zones with different functionalities or optical designs can therefore—besides by means of using different base materials in individual zones—be realized additionally or alternatively by means of providing with further layers on the base material. Such functionally or visually configured zones can for example be adjusted individually to the respective wearer of the shoe and can for example be directly created on-site in a store if needed. In particular, specific optical design elements, as for example player numbers, player names, country flags or country names can be applied to the outer shoe by coating, flocking, laminating, spraying, bonding and/or printing. Such design elements can either be directly generated on the outer shoe at the factory or alternatively in the store or directly by the end-user at home. It is, for example, possible that the sock-like outer shoe is delivered in a single color and that it is provided with design elements in the store or by an end user. An outer shoe in a single color in a delivery state may be provided with a company logo or brand name only. The sock-like outer shoe is thus configured so that it can practically have any desired visual design. Thereby, new distribution channels are enabled.

The procurement of a plurality of the listed materials is especially cost-effective, whereby the production costs of the outer shoe can be kept low.

For the outer shoe, also materials can be used which were previously used as upper materials for known soccer shoes, wherein the material of the outer shoe can be configured to be thinner to obtain an increased stretchability and/or flexibility. An increased stretchability and/or flexibility e.g. enables the outer shoe to be pulled over the frame quickly and easily.

The outer shoe can comprise an elastic material. An elastic material is characterized in that it can be reversibly deformed and in that a restoring force occurs when the material is stretched, which acts towards a contraction of the material. By using an elastic material, not only the fit of the outer shoe can be improved but also the sturdiness of the releasable connection between the outer shoe and the frame. The elasticity of the outer shoe, which is arranged around the frame, acts against a relative movement between the outer shoe and the frame. In particular, when the outer shoe is configured for arrangement around the frame in a prestressed state, fixing the outer shoe around the frame in all three spatial directions can be achieved.

The plurality of profile elements can be injected onto the outer shoe via injection molding. On the one hand, this enables particularly easy and cost-effective industrial manufacturing of the outer shoe. On the other hand, a particularly tight connection between the outer face of the outer shoe and the profile elements is ensured to, for example, prevent water from penetrating into the outer shoe via these interfaces.

The outer shoe can be configured to comprise at least one zone, which is adapted to provide an increased friction for contact with a ball. In particular, in a zone in the region of the instep and/or the toes of the foot, an increased friction can significantly improve ball control. To this end, the outer shoe on the whole can comprise a particular material, which provides an increased friction. The outer shoe can alternatively or additionally comprise in at least one zone a coating, a bonded foil and/or a friction element applied in any other way for increased friction. The outer shoe can also be composed of multiple sections of different materials so that in at least one zone a material is present which provides increased friction.

The outer shoe can comprise a toe region. Thus, the outer properties of the modular shoe in the toe region may be changed, particularly by changing the outer shoe. For example, an outer shoe can thus be provided for a soccer shoe, which specifically provides increased friction with a ball in wet conditions to enable good ball control even in wet conditions. The outer shoe can also comprise an instep region and/or a heel region and/or can encompass the ankle and/or the leg of a wearer. The outer shoe can be substantially arranged around the entire upper.

The outer shoe can comprise a ground portion and an upper portion. The ground portion can be configured to serve as the outsole of the modular shoe. The profile elements of the outer shoe can be arranged at the ground portion. The upper portion can comprise a toe region and/or an instep region and/or a heel region and/or can encompass the leg of a wearer and/or can be arranged around the entire upper. The upper portion can form an outer side of the upper. The ground portion and the upper portion can be formed monolithically (e.g. as a single piece) from a same material so that easy manufacturing of a monolithic outer shoe is possible.

The ground portion can also comprise a material, which the upper portion is free from. Alternatively or additionally, the upper portion can comprise a material, which the ground portion is free from. Thus, these portions can be optimized for different requirements. For example, the ground portion can comprise an additional material, which for example is water and/or dirt-repellent and/or waterproof and/or abrasion resistant and/or non-extendably and/or is rigid. An additional material can for example in the region of the ground portion be bonded (e.g., glued) onto the material of the outer shoe or it can be applied in any other way.

Alternatively or additionally, an additional material can be applied to the ground portion and/or the upper portion by printing, flocking etc., as explained above. The outer shoe can, for example only in the ground portion, fully or partially be coated with a further material layer, for example TPU. Subsequently, the profile elements of the outer shoe can for example be injected onto the second material layer. The ground portion can for example be configured to comprise a plurality of layers and can comprise a base layer of a knitted material (mesh), which is coated with a PU layer and/or TPU layer, which is for example molded or injected. Providing a PU layer and/or TPU layer leads to an increased tear resistance and abrasion resistance of the outer shoe in the ground portion. The ground portion can also be configured as a single layer, for example, a thin injected TPU or PA ground plate.

Further, a TPU layer can for example be arranged in a toe region of the upper portion. This can increase the tear resistance and/or abrasion resistance in this particularly loaded region. Also in other particularly loaded regions of the upper portion, additional layers can be arranged.

The ground portion may also, alternatively or additionally, comprise a different base material than the upper portion. The ground portion and the upper portion may be manufactured independently from each other and may subsequently be permanently connected with each other. Such a connection may for example be achieved with sewing techniques or with lasting. The outer shoe may be designed substantially as two parts with the ground portion and the upper portion.

The upper portion can comprise a material, which is more elastic and/or flexible than a material of the ground portion. Thereby, covering or removing the outer shoe from the frame is further simplified, whereas the ground portion provides an increased sturdiness. The upper portion can comprise materials mentioned above with regard to flexible and/or elastic materials for an outer shoe.

Inside the outer shoe, a stiffening plate can be firmly inserted, for example at the bottom of the toe region. This may increase the basic strength provided by the outer shoe in the toe region so that the sturdiness of the shoe is increased.

According to a further embodiment, a frame is provided for a releasable arrangement of a sock-like outer shoe around the frame to provide a modular shoe, in particular a sports shoe. The frame comprises an upper part portion, and a sole portion, and is configured to encompass a foot. The sole portion comprises a lower side, which is configured to releasably engage in a form-fitting manner with the sock-like outer shoe in a region of at least one profile element of the sock-like outer shoe.

The frame encompasses the foot and thus ensures that the frame and the modular shoe can be safely fixed at the foot. With the help of the sole portion of the frame, it can be ensured that arising forces are distributed across an area of the foot, even on uneven surfaces, so that injuries and pressure points are avoided. Due to the form-fitting engagement between the lower side of the sole portion and the profile elements of the sock-like outer shoe, an easy positioning and a stable connection between the frame and the outer shoe can be provided, as already explained above with regard to the outer shoe. Therein, the outer shoe is arranged around the frame, i.e. at least partially also around the sole portion and the upper part portion of the frame. The configuration of the frame with not only a sole portion but also an upper part portion allows fixing the outer shoe arranged around the frame from all sides. The sole portion can have a shape, which is adapted to the shape of the upper part portion. Due to the functional separation between frame and outer shoe, the frame can be reduced to its task of fixing to the foot, and it can be configured in a minimalistic manner and with low weight.

The sole portion may comprise at least one protrusion. The at least one protrusion is configured to engage in a form-fitting manner with the at least one profile element in the region of the at least one profile element.

The at least one protrusion can comprise TPU, polyamide 12, polyamide 11 and/or PEBA and/or can substantially consist of one of these materials. These materials, in particular TPU, only have low abrasion and allow for a good adhesion to the ground if the wearer moves without the sock-like outer shoe, for example in a changing room.

The sole portion can at least partially be provided with an anti-slip textile. Thus, a relative movement between the outer shoe and the frame can be further prevented. The anti-slip textile can be arranged in a forefoot region of the lower side of the sole portion. In other examples, a different slip-resistant element may be provided, for example a rubber element.

The frame and/or the sole portion may for example not comprise any protrusions in a forefoot region. However, a slip-resistant element, such as an anti-slip textile, for example a rubberized textile, may be provided in the forefoot region, which serves to prevent a relative movement between the frame and the outer shoe. A slip-resistant element can, alternatively or additionally, be provided on an inner side of the outer shoe. Not providing any protrusions in the forefoot region has proved to significantly facilitate putting the sock-like outer shoe on the frame or covering the frame with the sock-like outer shoe, respectively.

In general, the frame and/or the outer shoe may comprise at least one slip-resistant element. For example, a slip-resistant element may be provided on an inner side of the outer shoe and/or at an outer side of the frame. It has turned out that the provision of a slip-resistant element, which may e.g. have an increased static friction, greatly improves the sturdiness of the modular shoe, since relative movements of the frame and the outer shoe may substantially be inhibited. Not only relative lateral movements (e.g. in a plane parallel to the ground) but also relative vertical movements may be inhibited.

The frame can be adapted such that an instep region and/or a toe region of the foot are not covered by the frame. Due to the separation between the tasks of fixing the foot and determining the outer properties of the shoe between the frame and the outer shoe, respectively, the frame can be configured in a versatile manner. If the frame does not cover the instep region and/or the toe region of the foot, the local properties of the shoe at these positions are only determined by the outer shoe. Due to the absence of the frame, a close contact between the foot and the ball can for example be ensured, which allows better ball control for a soccer shoe.

The frame can be manufactured monolithically. This enables a particularly economical manufacturing method. Avoiding seams/bonding points etc., in particular avoids possible pressure points on the foot as well as possible weak points, at which the frame could tear open or separate. The frame can for example comprise polyamide, PEBA or TPU.

An upper side of the sole portion and a lower side of the upper part portion can be configured to releasably engage in at least one region in a form-fitting manner with one another. Thus, different sole portions and upper part portions can be releasably combined with one another.

Therein, the sole portion can comprise a ground plate, which can be rigid and which can releasably or permanently be connected with the upper part portion. The sole portion can also be substantially configured as such a ground plate. The sole portion can further comprise a heel counter, which can extend from a ground plate of the sole portion in a heel region along at least a part of the upper part portion. Such a heel counter can increase the sturdiness of the modular shoe. A locking means, for example a hook, can further be provided at the heel counter, which is configured to act together with a counter locking means of the outer shoe, for example a loop, in an assembled state of the modular shoe.

According to a further embodiment, a modular shoe, in particular a sports shoe, comprises a sock-like outer shoe—as described in the previous paragraphs—and a frame—as also described in the previous paragraphs. The modular sports shoe is designed such that the sock-like outer shoe is releasably arranged around the frame. A lower side of the frame is engaged in a form-fitting manner with the sock-like outer shoe in a region of at least one profile element.

By combining the already explained outer shoe with the also already explained frame, a stable modular shoe, in particular a sports shoe, can be provided, whose outer properties can be almost arbitrarily changed in a single simple step. Also, different frames optimized for different foot anatomies can be used and can be combined with different outer shoes.

A further aspect of the invention relates to a sock-like outer shoe, a frame and a modular sports shoe.

An embodiment relates to a sock-like outer shoe for a releasable arrangement around a frame to provide a modular shoe, in particular a sports shoe. The sock-like outer shoe comprises a plurality of openings, wherein the plurality of openings is configured so that a plurality of profile elements of the frame can extend through the openings such that a sealing is provided between the openings and the profile elements.

By providing the profile elements at the frame, the outer properties of the upper can be changed separately from the stability of the modular shoe by changing the outer shoe. By adapting the openings of the outer shoe to the profile elements of the frame and by arranging the outer shoe around the frame, a simple and safe positioning of the outer shoe at the frame is ensured. Simultaneously, the openings of the outer shoe are configured such that water or dirt cannot penetrate into the modular shoe between the openings and the profile elements. Additional sealing rings or other sealing elements are not necessary but are not excluded.

The outer shoe can be configured such that at least one of the openings comprises a three-dimensional shape, such that, when the outer shoe is arranged around the at least one profile element of the frame in the region of the at least one opening, a sealing area is provided, which laterally abuts the profile element. By configuring the outer shoe to provide a sealing area instead of a "sealing line", the sealing between the profile element and the opening is strongly improved. By using an elastic material in the region of the three-dimensional shape, the sealing can be further improved.

The at least one opening of the outer shoe can be configured to be downwardly tapered. Thus, it can be ensured that the sealing area is formed autonomously when arranging the outer shoe around the frame without the user having to pay attention thereto. A sealing area is therefore automatically provided from top to bottom along the profile elements.

A further embodiment relates to a frame for a releasable arrangement of a sock-like outer shoe around the frame to provide a modular shoe, in particular a sports shoe. The frame comprises an upper part portion and a sole portion. The sole portion comprises a lower side with a plurality of profile elements, wherein the plurality of profile elements is adapted such that it can extend through a plurality of openings of the outer shoe, so that a sealing between the openings and the profile elements is provided.

By providing the profile elements at the frame, they can be formed monolithically with the frame and can be manufactured in the same manufacturing step, as it has turned out that the same materials may be used for the frame and the profile elements. The profile elements of the frame, which are manufactured monolithically, are particularly durable since a detachment, which may occur with bonded (e.g., glued) profile elements, can be prevented.

According to a further embodiment, a modular shoe, in particular a sports shoe, comprises a sock-like outer shoe with a plurality of openings—as described in the previous paragraphs—and a frame with a plurality of profile elements—as described in the previous paragraphs. The sock-like outer shoe is releasably arranged around the frame. The plurality of profile elements extends through the plurality of openings such that a sealing between the openings and the profile elements is provided.

By combining the explained outer shoe having a plurality of openings with the explained frame having a plurality of profile elements, a stable modular shoe, in particular a sports shoe, can be provided whose outer properties can be almost arbitrarily changed in a single simple step. Therein, frames optimized for different foot anatomies and surfaces can be used.

A distribution channel or a business model respectively of the modular outer shoe according to the invention can comprise a separate sale of the frame. Therein, the frame can be directly adapted to a sportsperson and can be sold directly to the sportsperson. Further, a plurality of sock-like outer shoes can be separately offered for sale. The sock-like outer shoes can be sold separately or in sets. The sock-like outer shoes can in particular differ from another with regard to material, function, color design and/or graphical appearance. A customer who has already purchased a frame separately can thus subsequently purchase one or more sock-like outer shoes according to personal requirements. It is also possible that a frame is distributed together with a sock-like outer shoe or with a set of sock-like outer shoes.

According to a further example, a subscription or membership for outer shoes may be offered. Customers having a subscription or being a member may be provided with new outer shoes on a regular basis, e.g. monthly etc. The frame may, however, be continued to be used, and it may therefore only need to be bought once.

Specific visual design elements, such as player numbers, player names, country flags or country names may either be generated on the outer shoe directly at the factory or alternatively in a store or directly at home by a sportsperson or an end-user. The sock-like outer shoe may be delivered in a single color and design elements can then be applied thereto in the store or by the end-user.

Moreover, end-users may design the look of outer shoes and upload their design onto an online platform (or otherwise register with a common platform). Other interested users may purchase outer shoes having that design from the platform. It may be envisaged that the end-user who shared his design with the platform participates with a certain rate or fixed amount from each outer shoe that is sold.

Further, outer shoes may also be designed specifically for certain events, e.g. soccer matches etc., and may have a design relating to the event. They may be worn by the athletes competing at this event, and/or purchased by spectators of the event.

5. BRIEF DESCRIPTION OF THE FIGURES

Figure 1B:
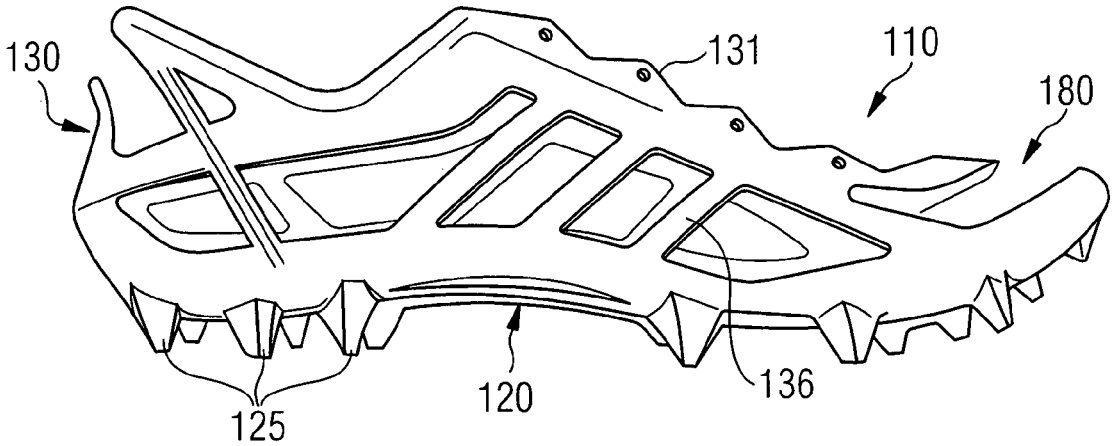
Figure 1C:
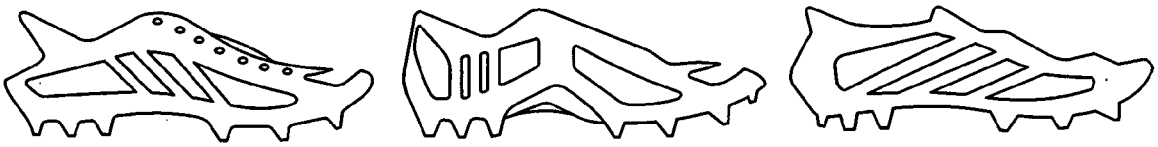
Figure 3:
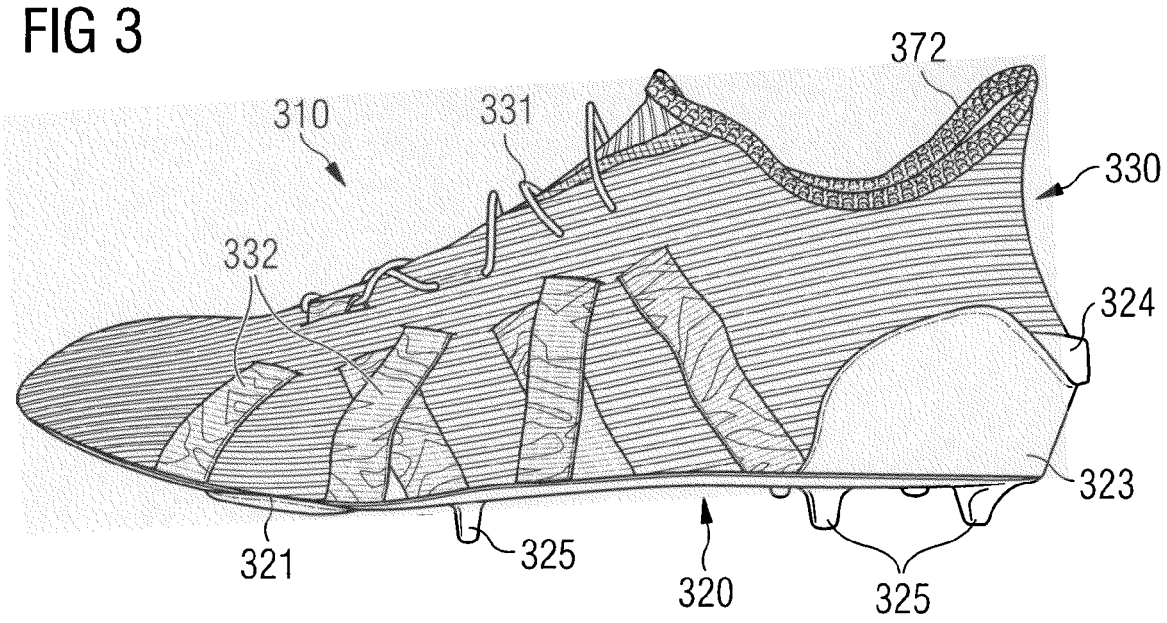
Figure 4A:
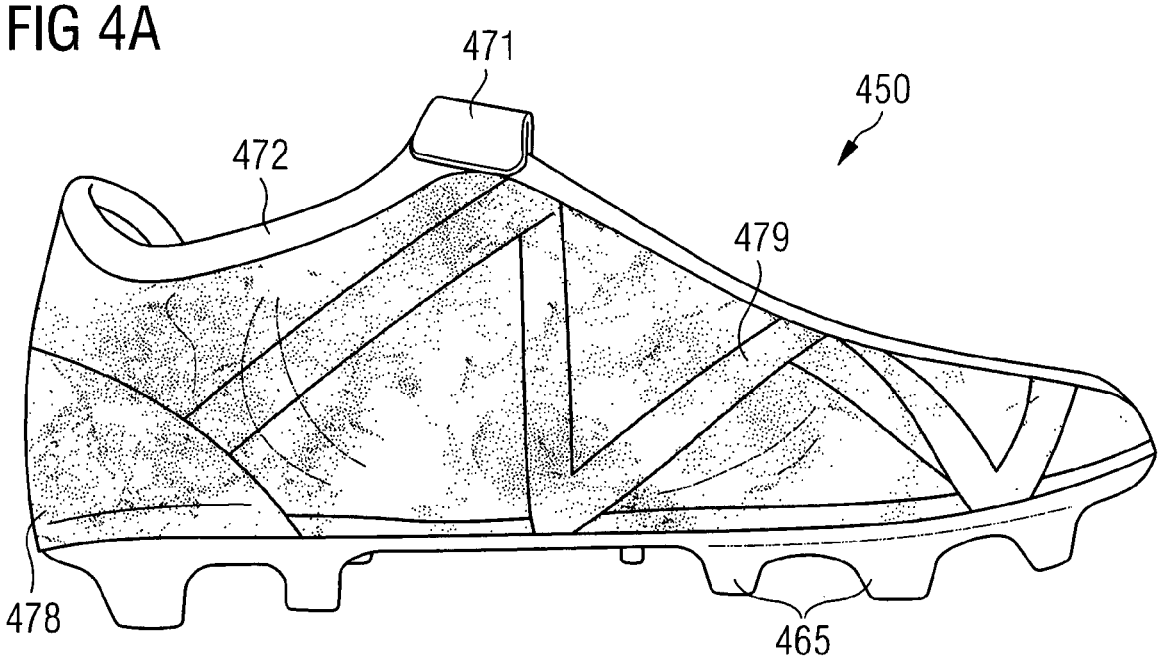
Figure 4B:
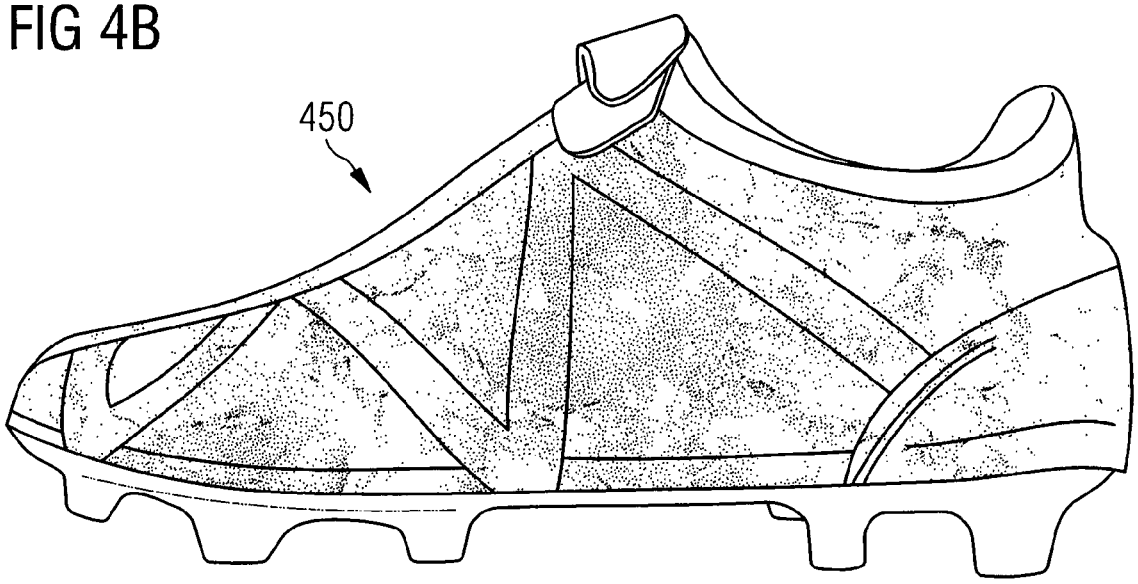
Figure 5A:
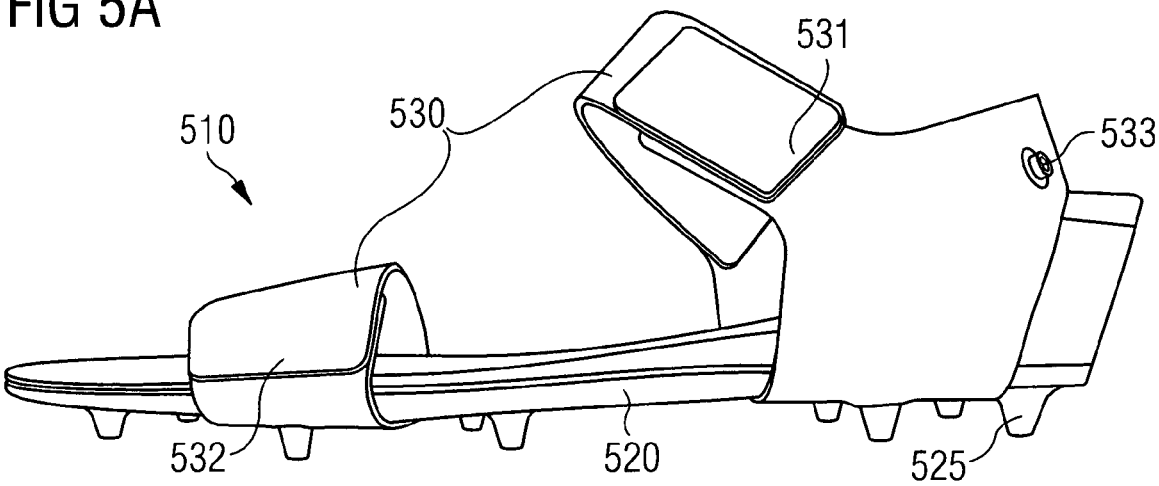
Figure 5B:
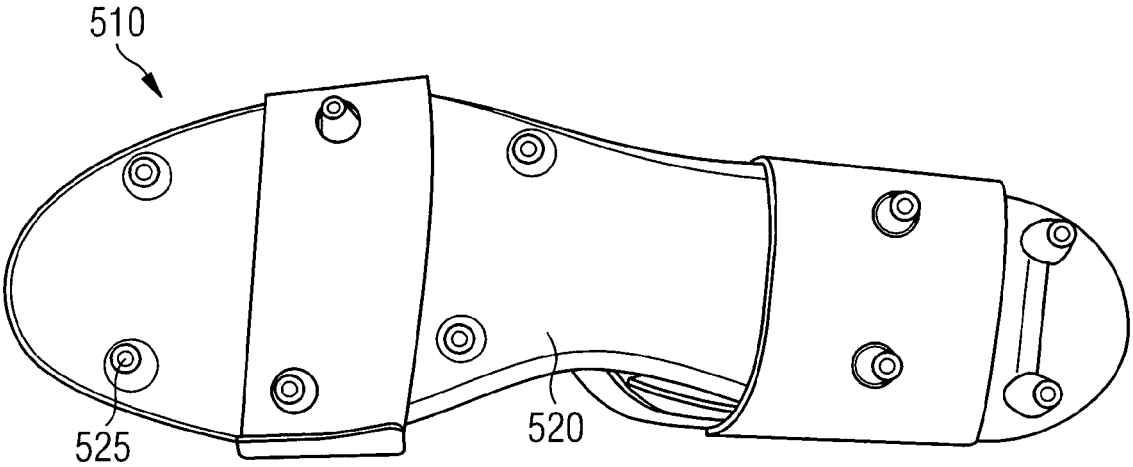
Figure 6:
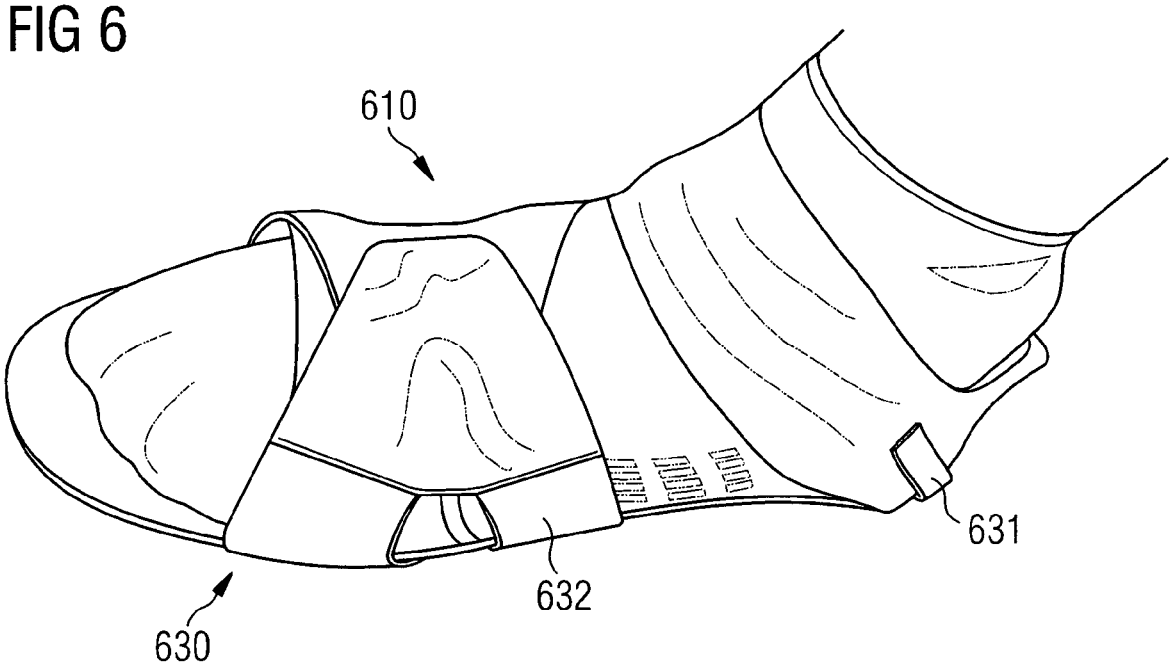
Figure 8A:
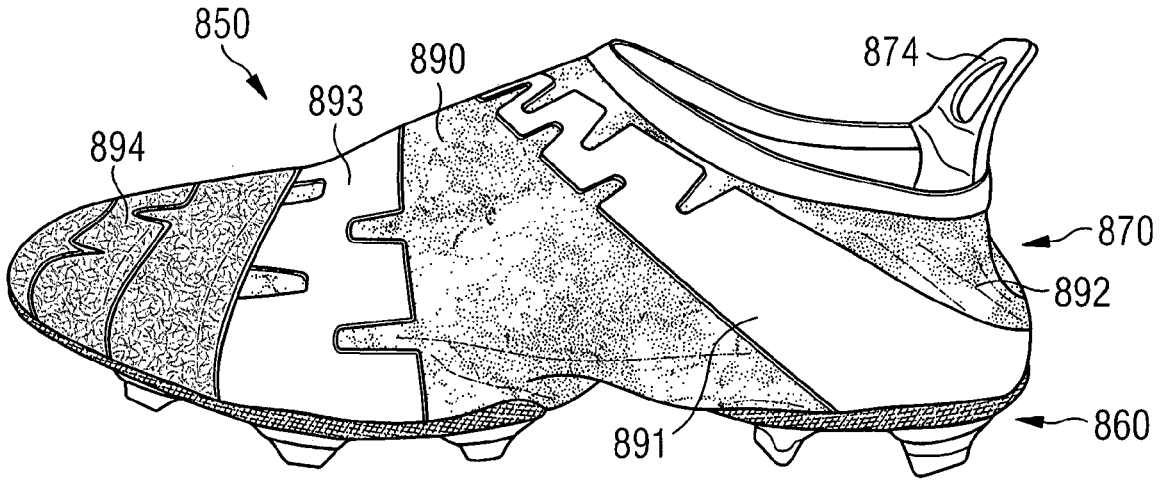
Figure 8B:
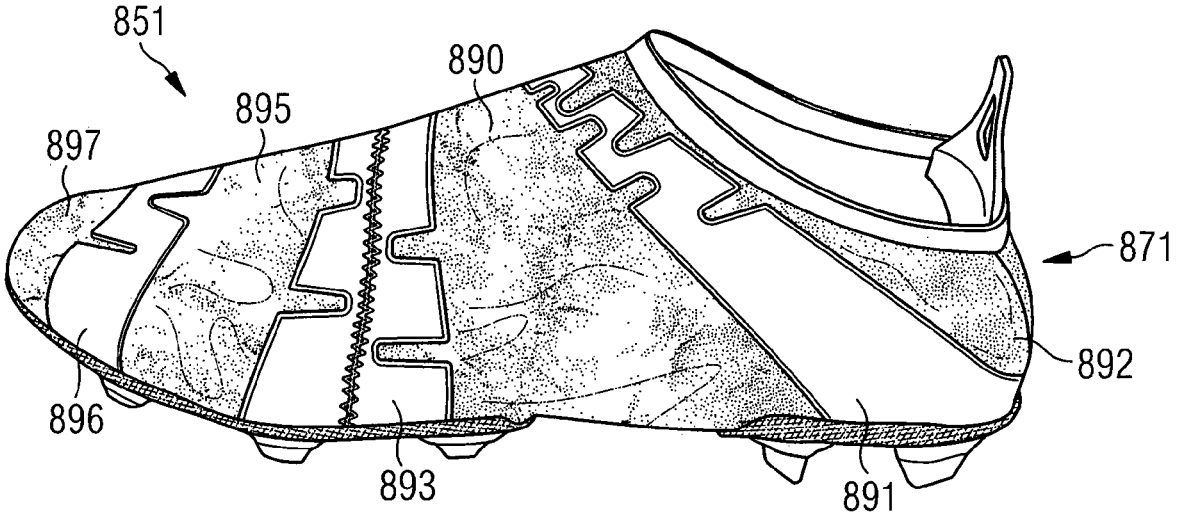
Figure 9A:
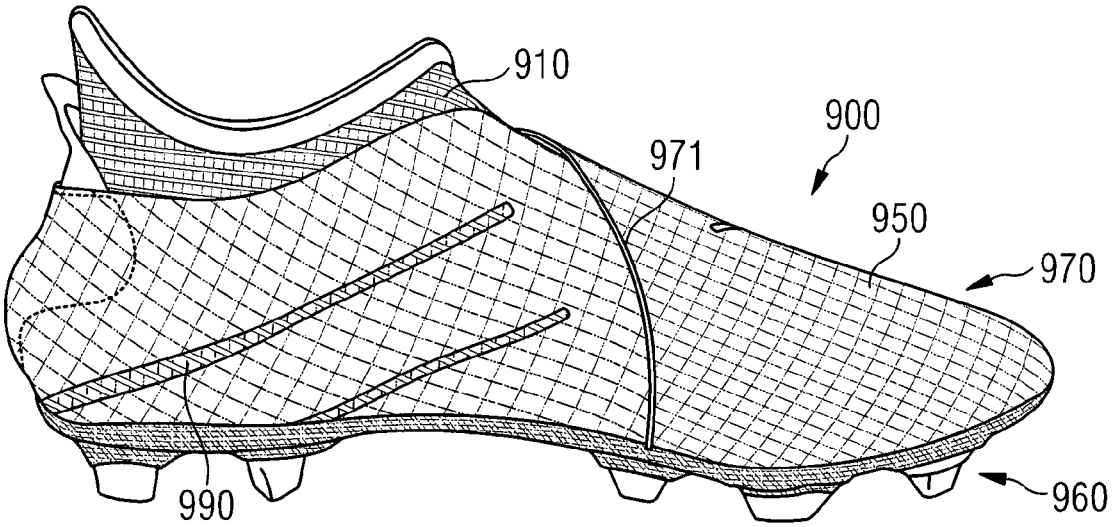
Figure 9B:
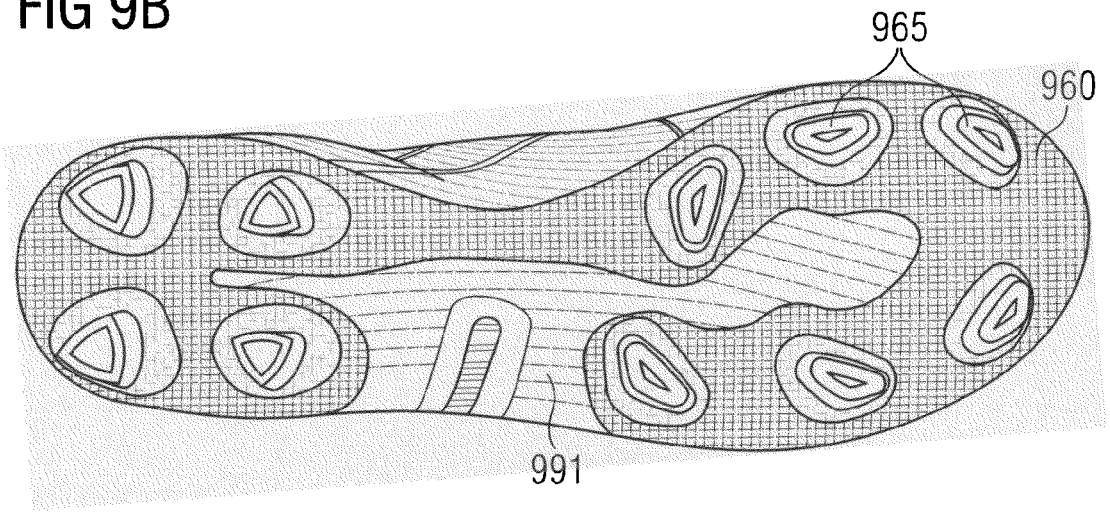
Figure 10A:
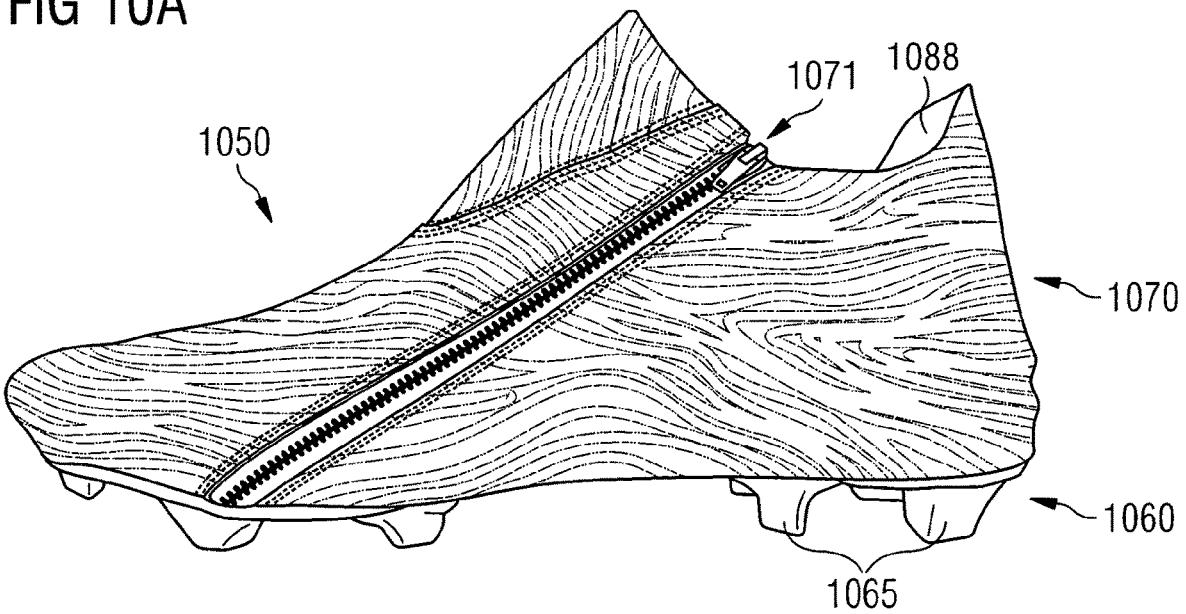
Figure 10B:
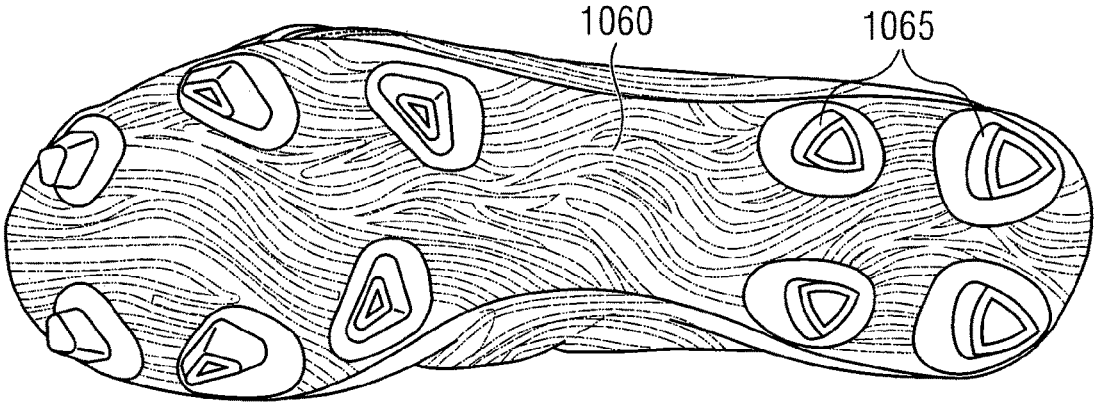
Figure 13A:
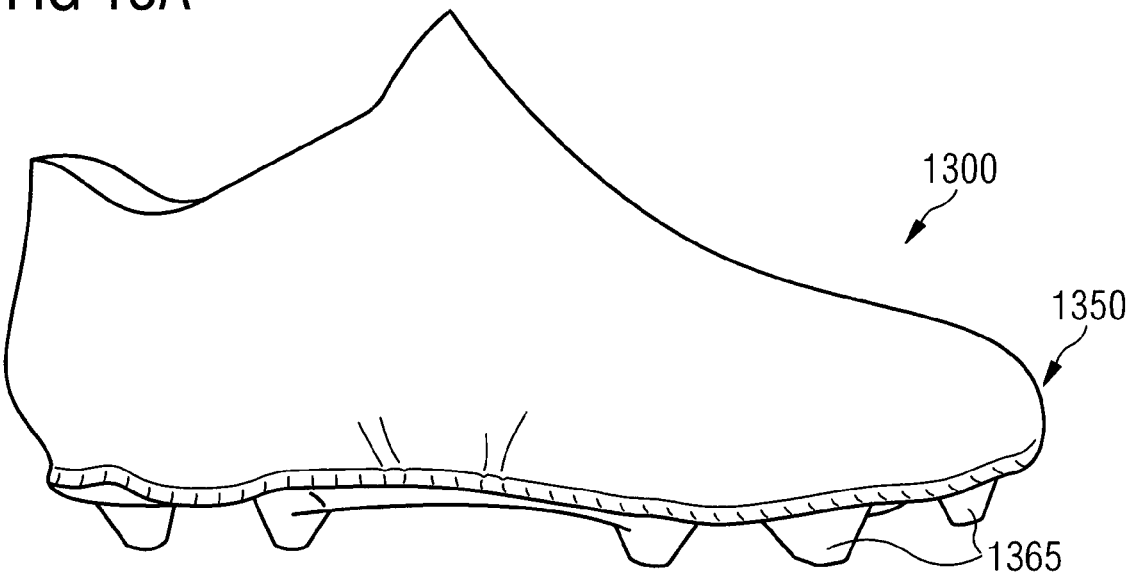
Figure 13B:
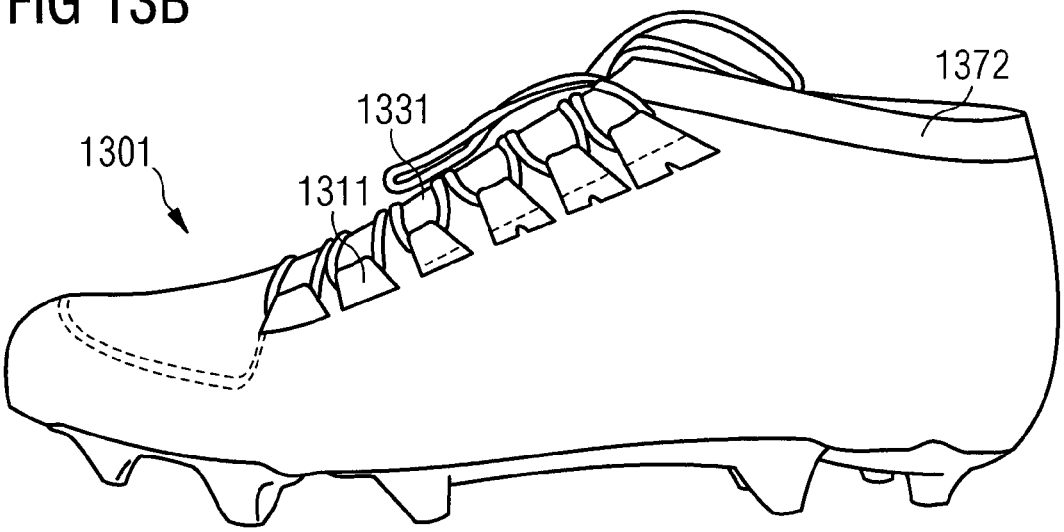
Figure 14A:
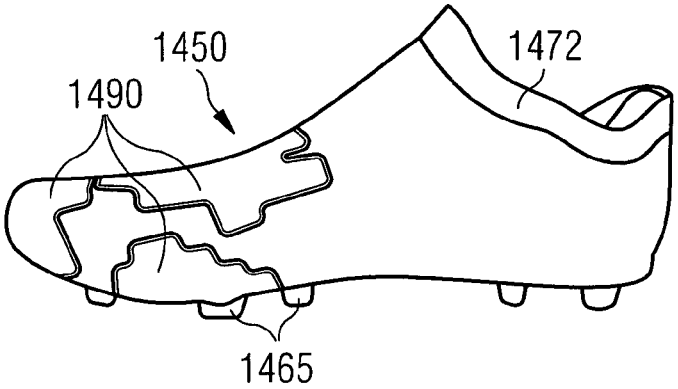
Figure 14B:
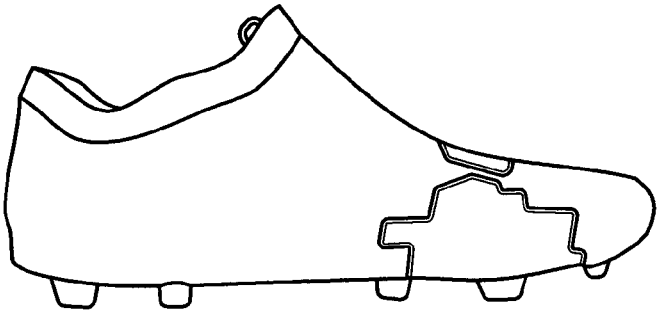
Figure 14C:
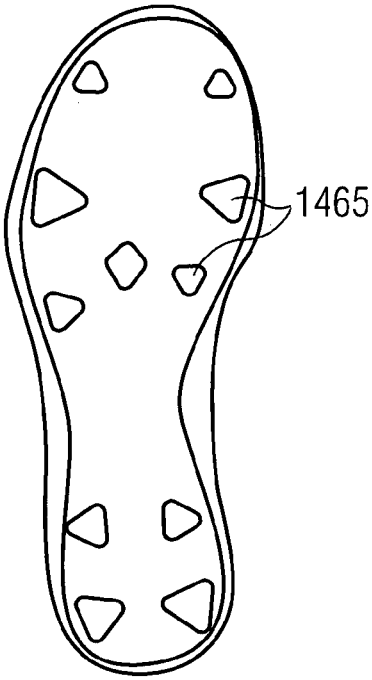
Figure 15A:
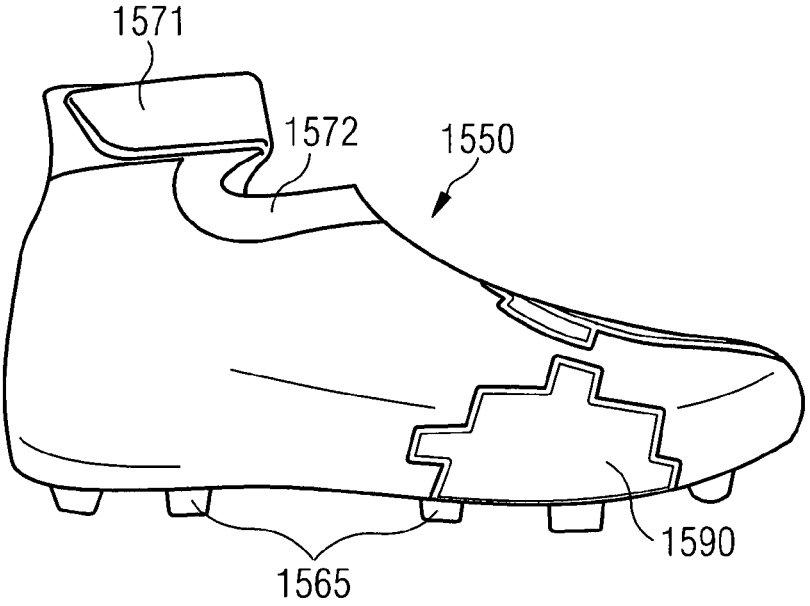
Figure 15B:
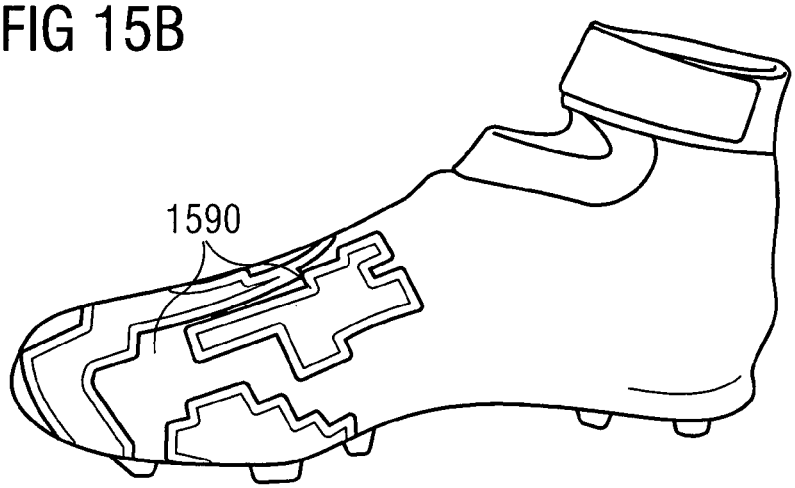
Figure 16A:
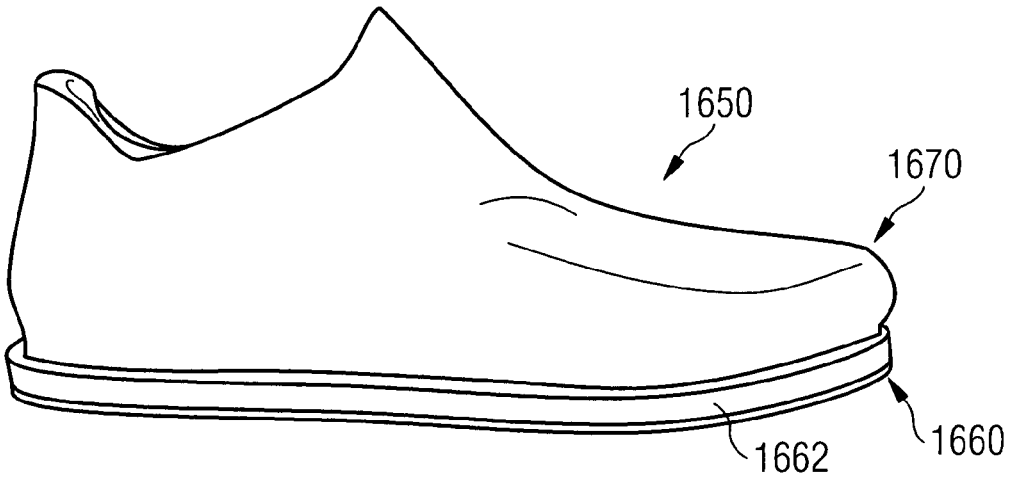
Figure 16B:
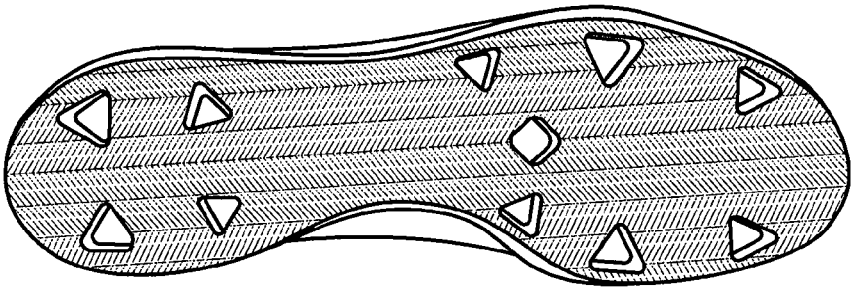
Figure 17A:
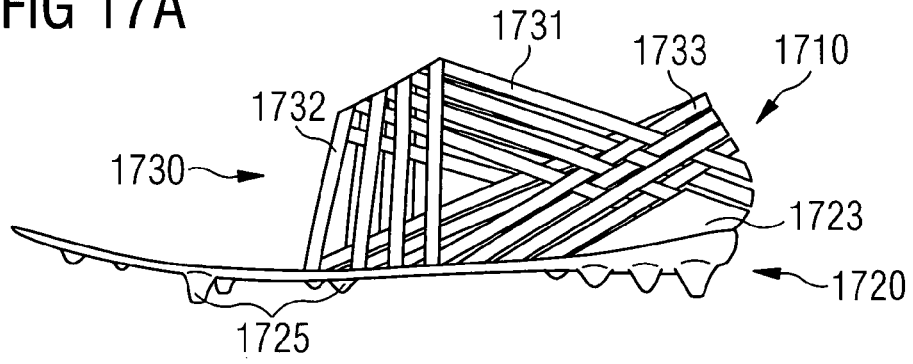
Figure 17B:
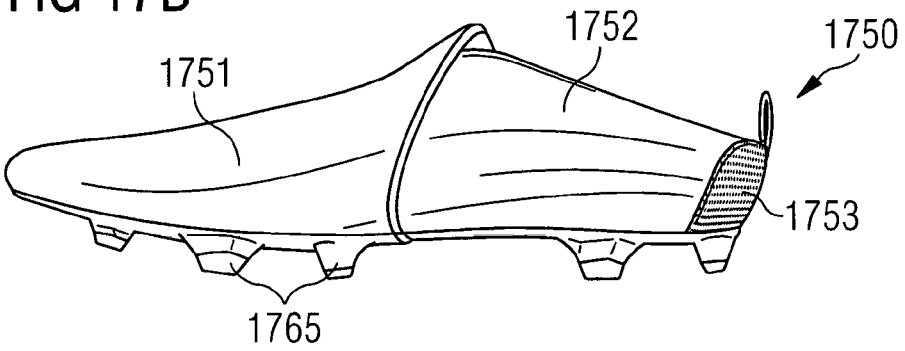
Figure 17C:
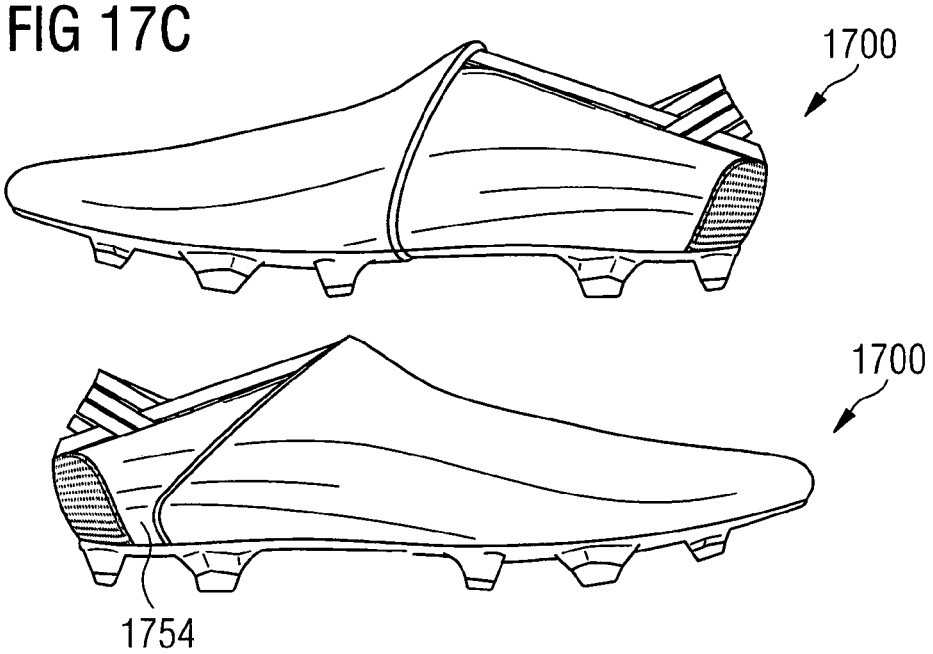
Figure 18A:
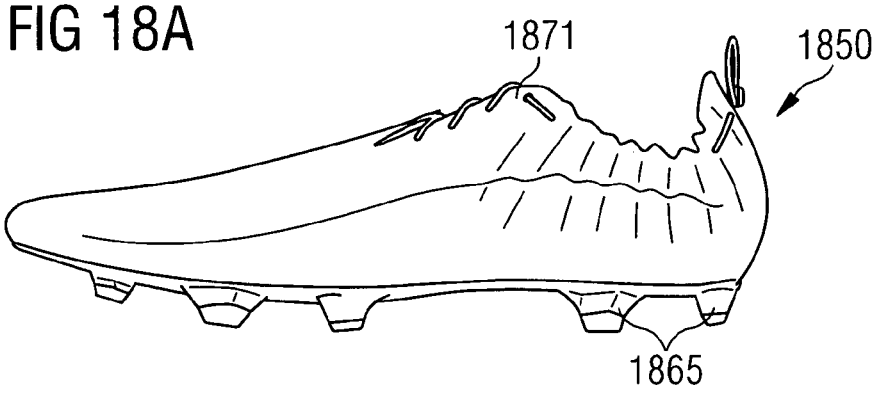
Figure 18B:
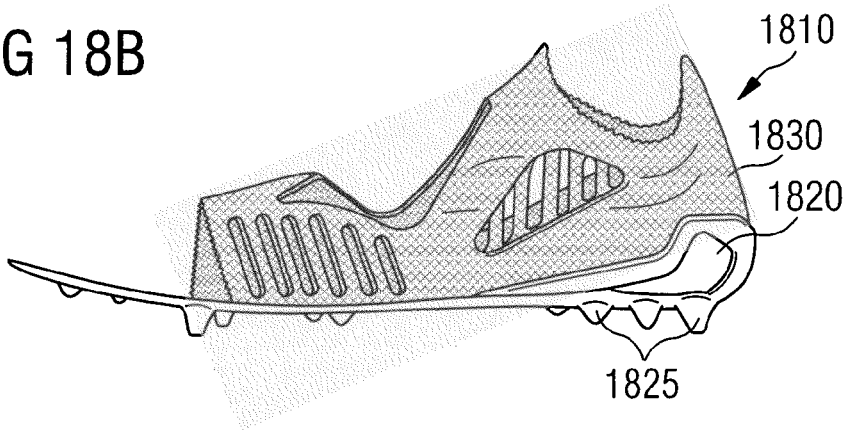
Figure 18C:
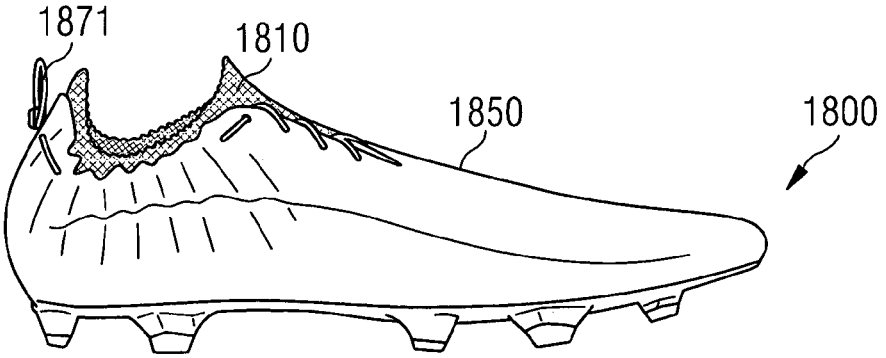
Figure 18C:
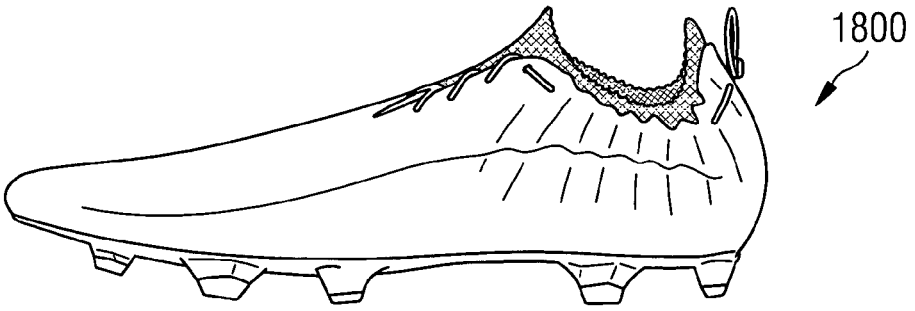
Figure 19A:
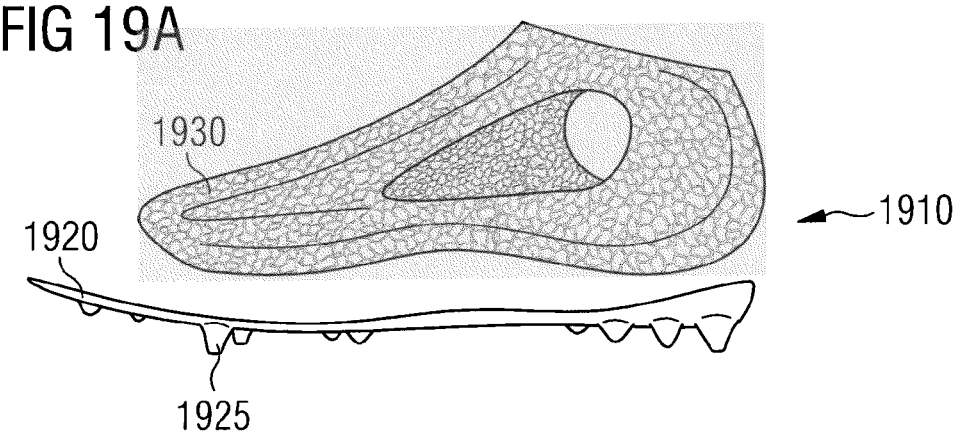
Figure 19B:
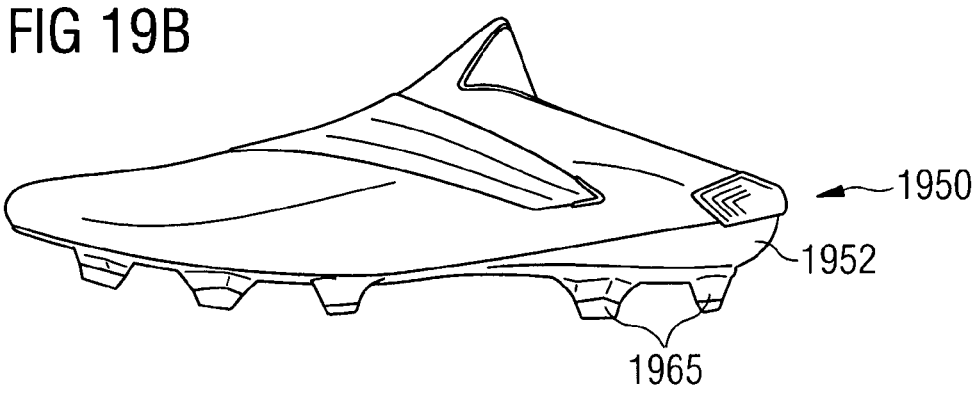
Figure 19C:
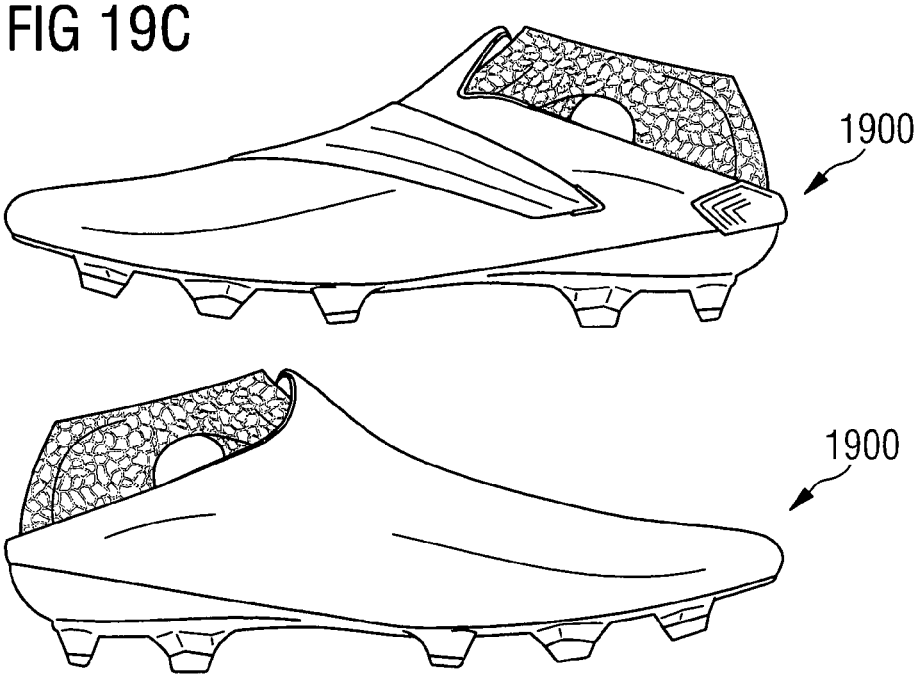
Figure 20A:
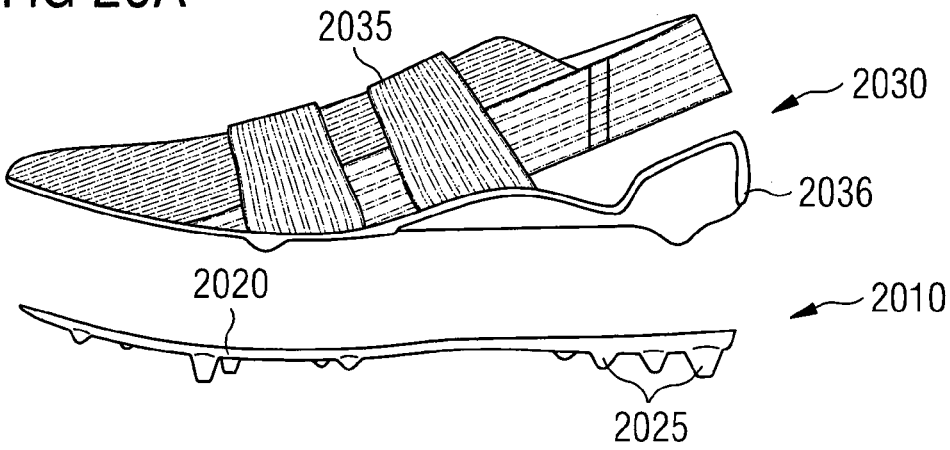
Figure 20B:
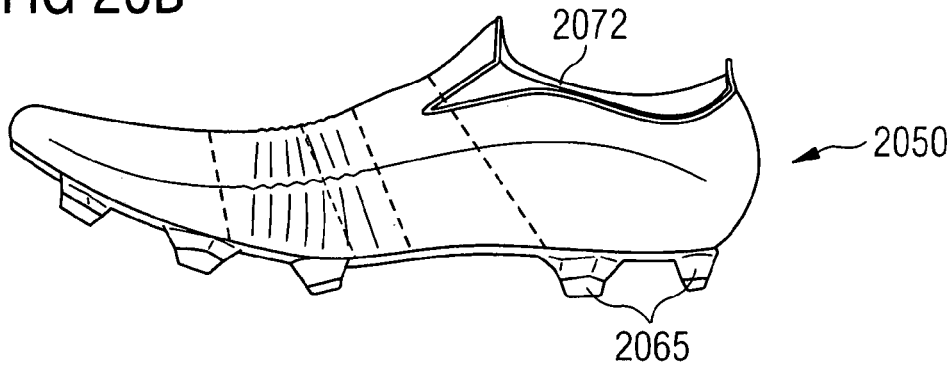
Figure 20C:
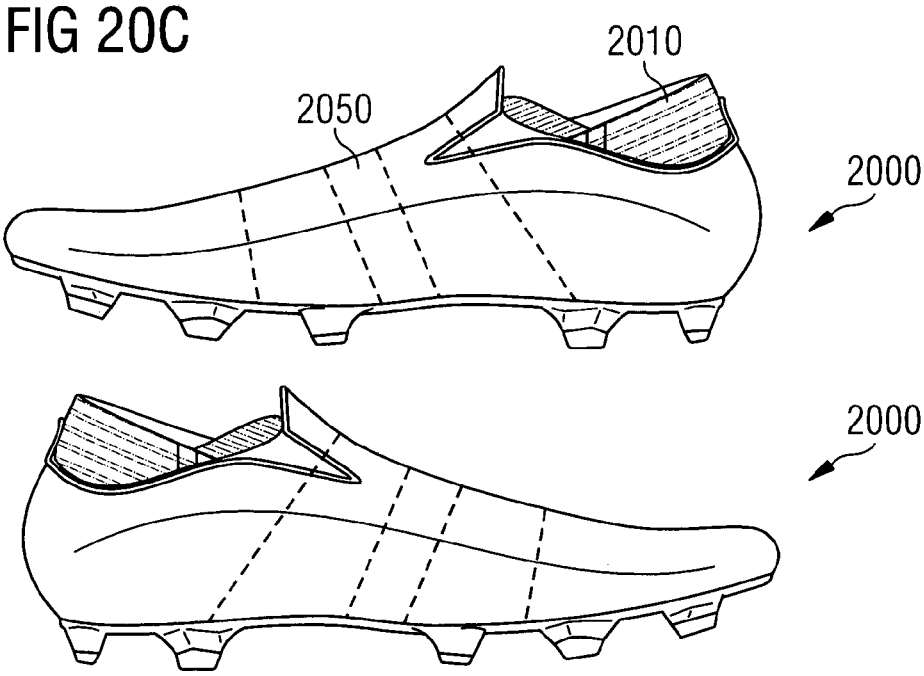
Figure 22A:
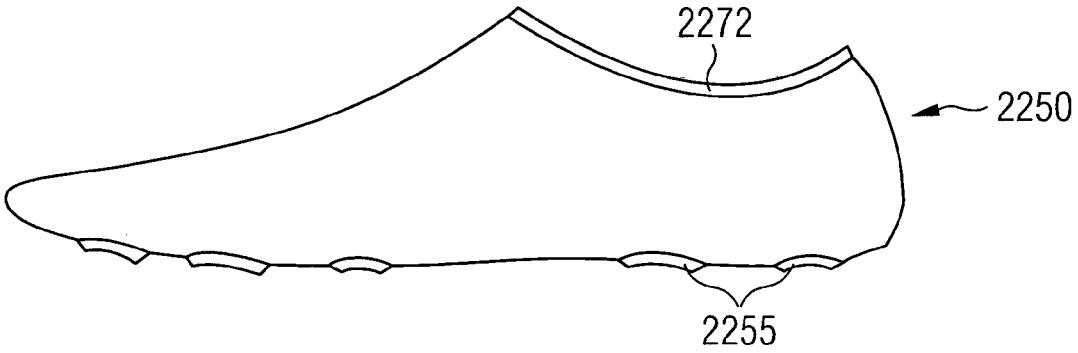
Figure 22B:
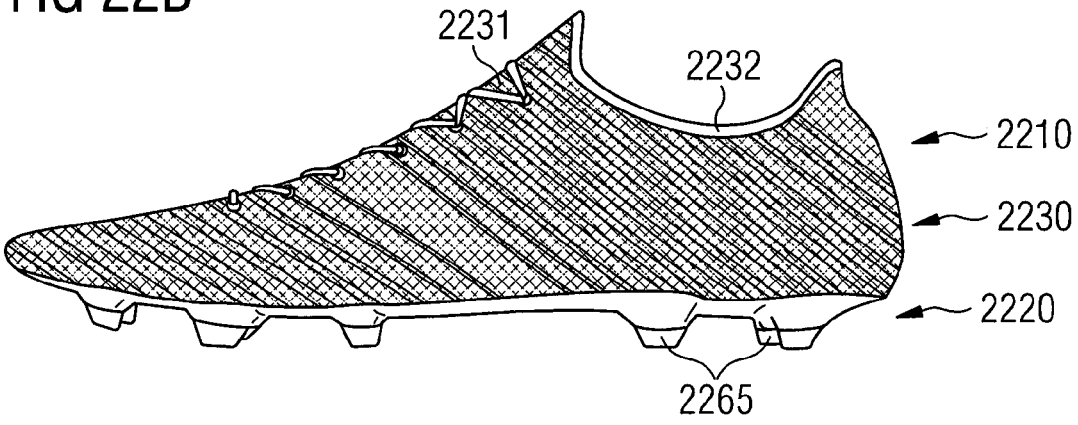
Figure 22C:
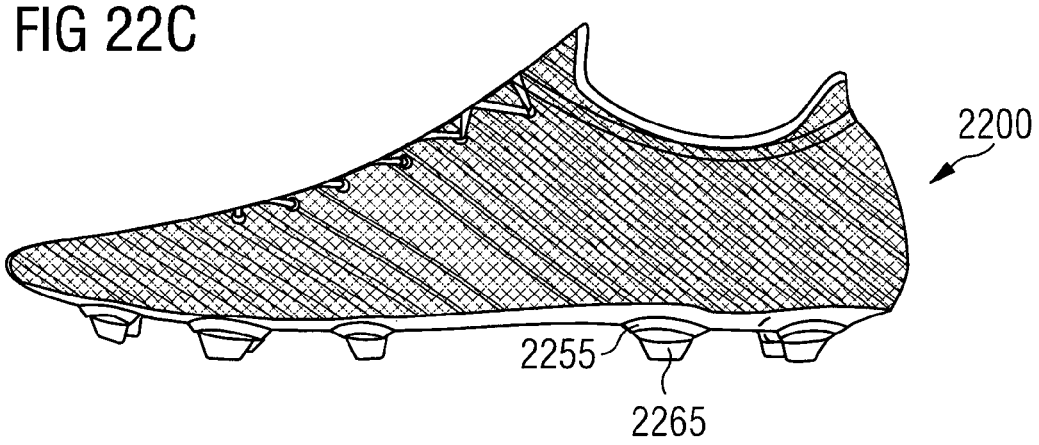
Figure 23A:
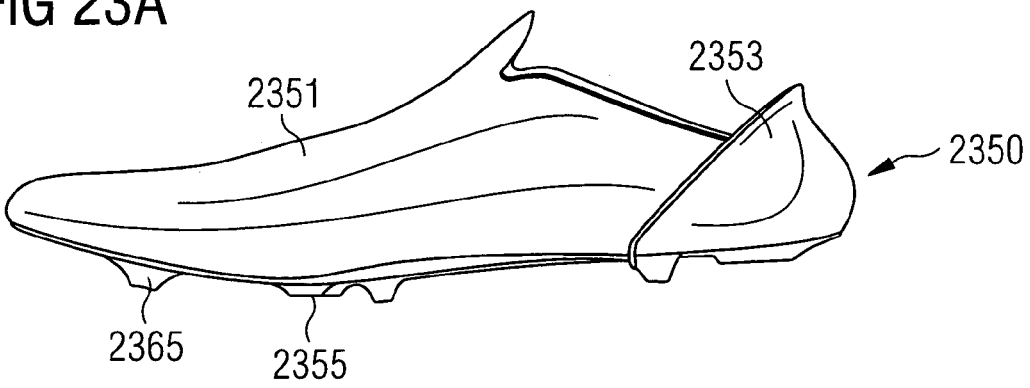
Figure 23B:
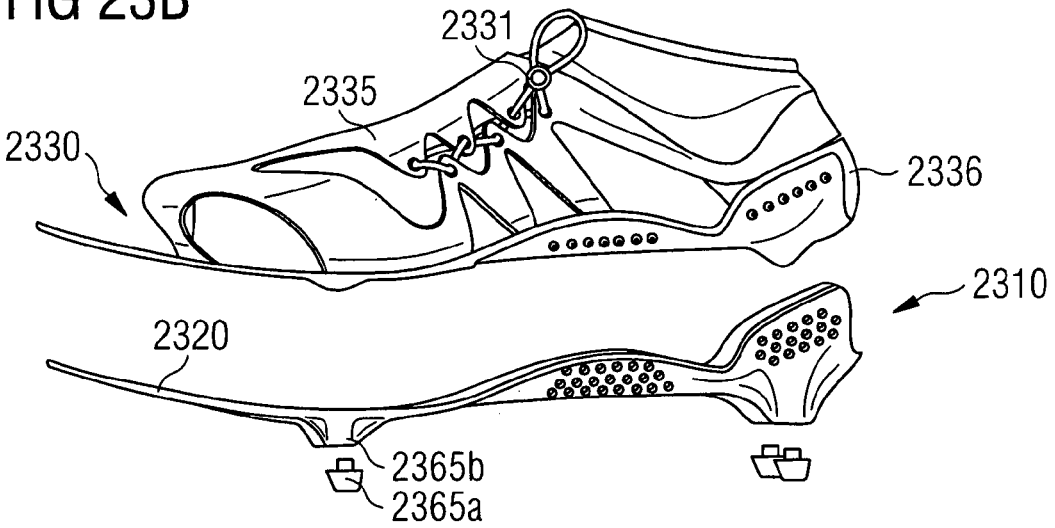
Figure 23C:
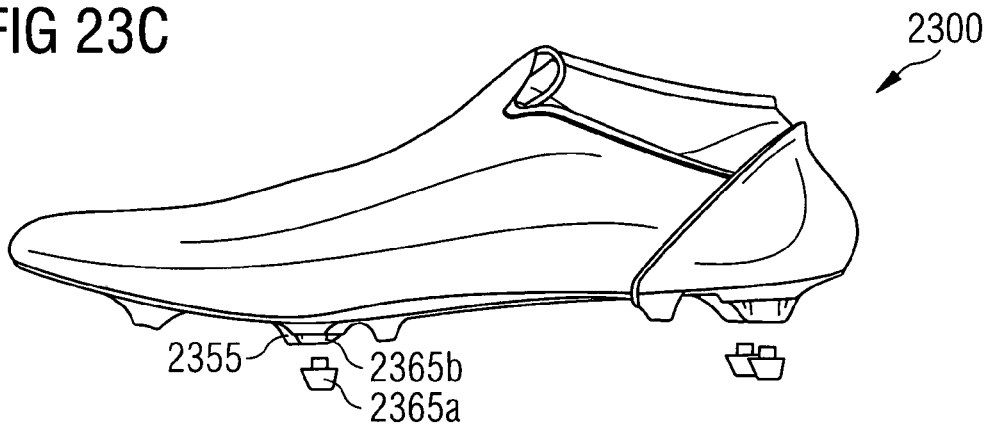
Figure 24A:
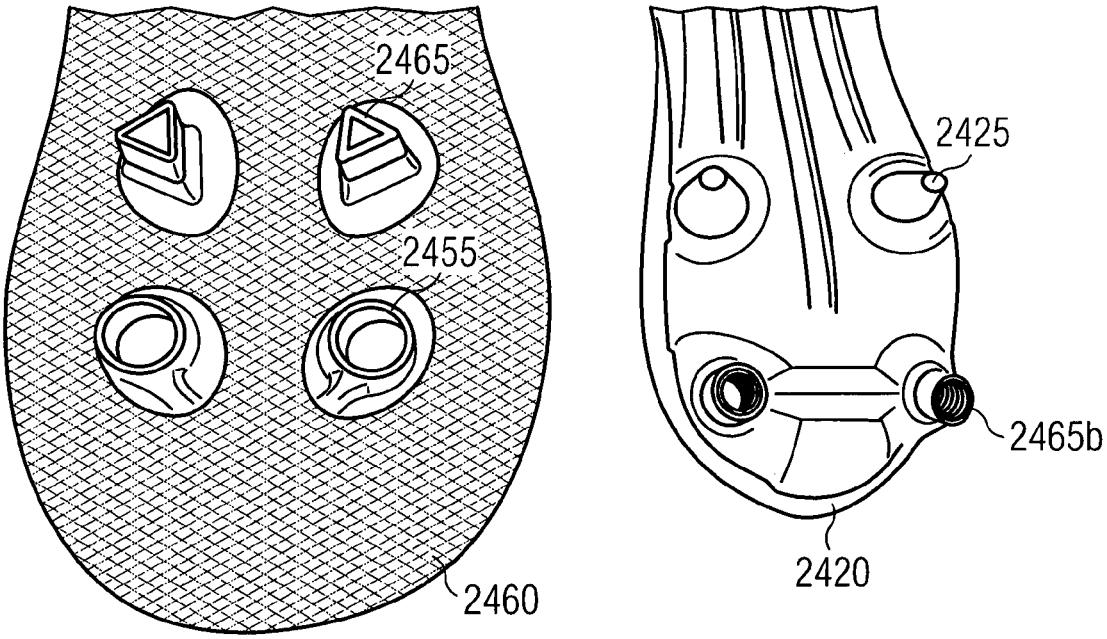
Figure 24B:
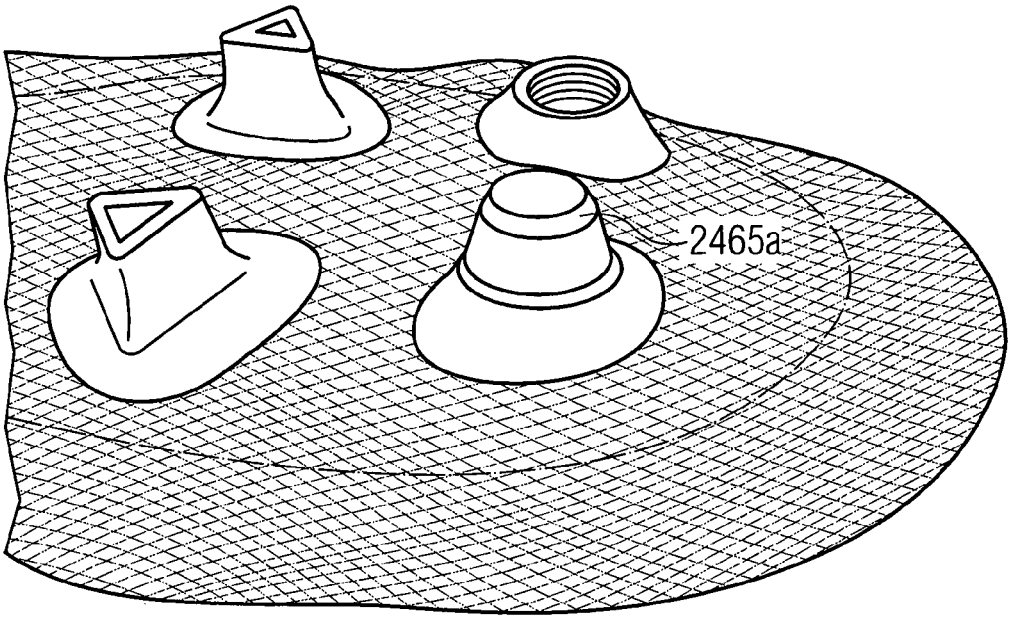

In the following detailed description, present embodiments of the invention will be described with reference to the following Figures:

FIGS. 1A-C: Examples of a modular shoe, an outer shoe and various frames;

FIGS. 2A-E: Examples of various frames;

FIG. 3: Example of a frame;

FIGS. 4A-B: Example of an outer shoe;

FIGS. 5A-B: Example of a frame;

FIG. 6: Example of a frame;

FIGS. 7A-E: Examples of various outer shoes;

FIGS. 8A-B: Examples of outer shoes;

FIGS. 9A-B: Example of a modular shoe, an outer shoe and a frame;

FIGS. 10A-B: Example of an outer shoe;

FIGS. 11A-E: Examples of profile elements and a form-fitting engagement with a lower side of a frame;

FIGS. 12A-E: Examples of modular shoes;

FIGS. 13A-B: Example of a modular shoe;

FIGS. 14A-C: Example of an outer shoe;

FIGS. 15A-B: Example of an outer shoe;

FIGS. 16A-B: Example of an outer shoe;

FIGS. 17A-C: Example of a modular shoe;

FIGS. 18A-C: Example of a modular shoe;

FIGS. 19A-C: Example of a modular shoe;

FIGS. 20A-C: Example of a modular shoe;

FIGS. 21A-D: Example of profile elements;

FIGS. 22A-C: Example of a modular shoe;

FIGS. 23A-C: Example of a modular shoe;

FIGS. 24A-B: Example of a ground portion of an outer shoe and a sole portion of the frame;

FIGS. 25A-F: Example of a frame:

FIGS. 26A-E: Example of a modular shoe with an outer shoe; and

Figure 27:
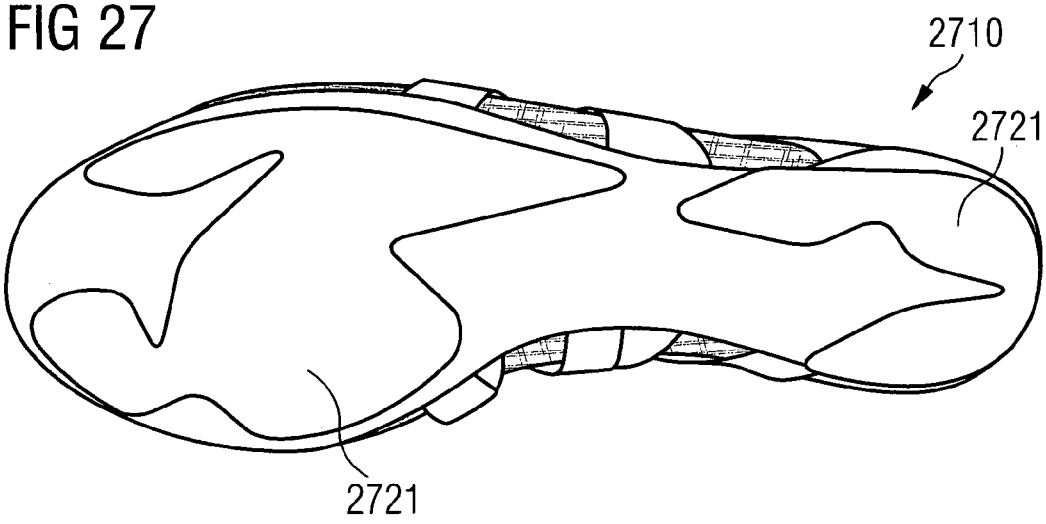

FIG. 27: Example of a frame.

6. DETAILED DESCRIPTION

Possible embodiments of the present invention will be described in the following detailed description primarily with reference to sports shoes with profile elements. It is emphasized, however, that the present invention is not limited to these embodiments. Rather, it may also be used with other types of shoes with profile elements or also with shoes without profile elements.

It is noted that in the following, only individual embodiments of the invention are described in more detail. The person skilled in the art is aware that the possible design options described with reference thereto can also be altered or otherwise combined with one another within the scope of the invention and that individual features can also be omitted insofar as they seem dispensable. To avoid redundancies, reference is in particular made to the explanations in the preceding paragraphs, which will also remain valid for the following detailed description.

FIG. 1A shows an example of a modular shoe 100. An outer shoe 150 is arranged around a frame 110. The outer shoe comprises for example a PU or a TPU. Outer shoe 150 comprises a plurality of profile elements 165, which are configured to be downwardly tapered. Each profile element 165 comprises an indentation on the inner side of the outer shoe.

Frame 110 comprises a sole portion 120 having a plurality of protrusions 125. The plurality of protrusions is configured to engage in a form-fitting manner with the plurality of indentations of the profile elements 165 to form a form-fitting engagement. Due to the arrangement of outer shoe 150 around frame 110, it is ensured that the form-fitting engagement between the lower side of the frame 110 and the profile elements remains permanently stable.

Frame 110 comprises an upper part portion 130. Upper part portion 130 encompasses the foot and is fixed to the foot via a lace fastening, which is not shown in FIG. 1A. Outer shoe 150 is arranged around sole portion 120 as well as upper part portion 130 of the frame.

FIG. 1B shows frame 110 of FIG. 1A. Frame 110 is manufactured monolithically. Frame no can be made of a hard plastic and can for example comprise polyamide, PEBA or TPU. It can for example be manufactured using injection molding. A frame can for example also be manufactured using 3-D printing. 3-D printing can take place locally in a store, wherein the shape of the frame can be individually adapted to the shape of the foot of the customer. Alternatively, 3-D printing can also be performed by the customer himself at home, for example according to the customer's individual requirements and/or the customer's foot shape. Upper part portion 130 comprises a portion 131, which is provided for a lace fastening of the frame. As will be subsequently explained with reference to further examples, other fastenings may also be provided. A toe region 180 remains free from the frame. Thus, good ventilation and good ball control upon contact with a ball can be ensured. Also other regions can remain free from frame 110, for example a heel region or one or more regions on the medial and/or lateral side of the foot. On the lateral and/or medial side of the foot, one or more cross struts 136 of the frame can be provided. The sole portion 120 is configured to be continuous.

FIG. 1C shows further examples of frames with differently configured heel portions, which can be adapted to the respective anatomy of the wearer of the shoe. As required, a high or a low sturdiness in the heel region can be provided by the frame. Also the cross struts and the toe region can be individually adapted so that the frame enables an increased sturdiness and/or ventilation and/or ball control.

FIG. 2 shows further examples of a frame. Frame 210 according to FIG. 2A comprises a continuous sole portion 220 and an upper part portion 230. Sole portion 220 comprises a plurality of protrusions 225. Upper part portion 230 comprises a lace fastening 231 and an optional push button 233. With the help of the lace fastening, frame 210 is fixed to the foot. With the help of the optional push button 233, an outer shoe can be releasably attached to frame 210, in addition to the form-fitting engagement with the help of protrusions 225. Push button 233 is arranged in a region where it does not impede the user, for example at the edge of the heel region. The frame optionally comprises a lining 238. Moreover, one or more insoles can be provided within frame 210.

Frame 210 comprises a plurality of cross struts in upper part portion 230 with free portions arranged between them. In the latter portions, a fabric can be arranged at the frame, for example within the frame, to ensure a pleasant wearing comfort. The fabric can for example prevent pressure points. The fabric can be selected as required regarding its composition and mesh size, e.g., to provide different stabilities and/or ventilations.

Figure 2A:
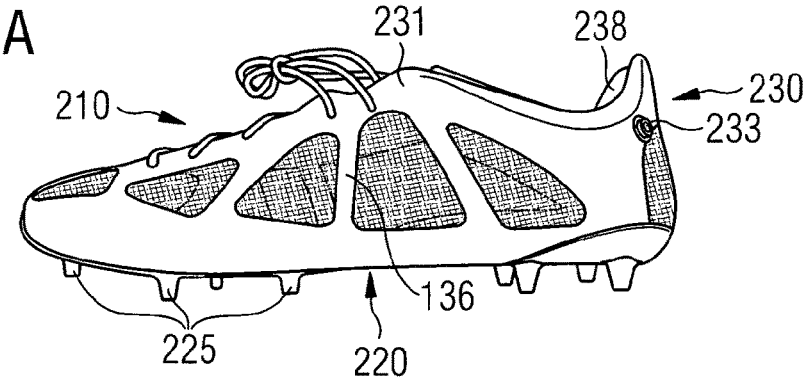
Figure 2B:
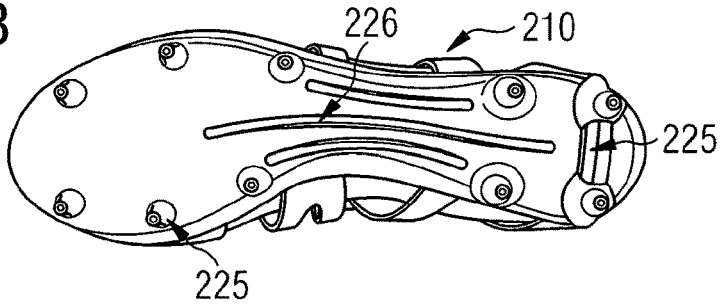

FIG. 2B shows the lower side of sole portion 220 of frame 210. In the forefoot region and in the heel region of the lower side of sole portion 220, several cylinder-shaped protrusions 225 are arranged. These can be downwardly tapered. Additionally, an elongated protrusion 225 is optionally arranged in the center of the rear heel region, which runs perpendicularly to the longitudinal axis of sole portion 220. This elongated protrusion 225 can act against a torsion of the sole portion 220 around the longitudinal axis of the foot so that frame 210 offers an increased sturdiness. The region of the arch of the foot can remain free from protrusions 225 to facilitate the rolling movement of the foot. Further, grooves 226 can be provided in the sole portion, which for example in the region of the arch of the foot run longitudinally to facilitate the rolling movement of the foot.

Figure 2C:
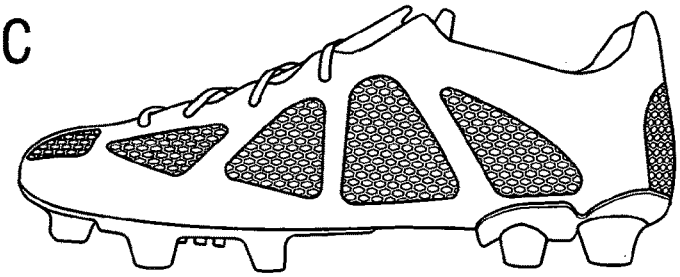
Figure 2D:
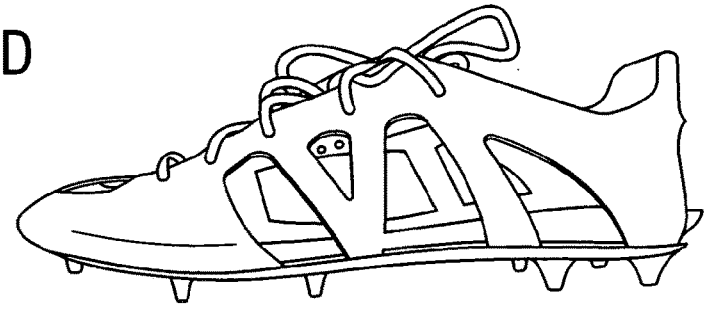
Figure 2E:
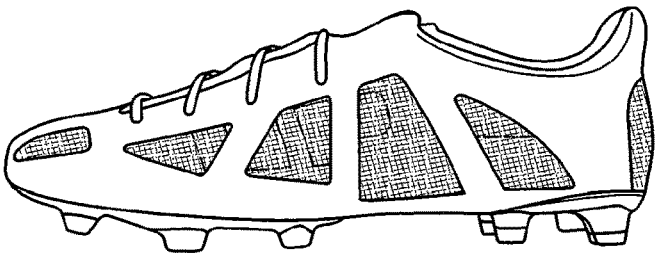

FIGS. 2C-E show further examples of frames. As can be seen in FIG. 2C, the fabric, which is arranged at the frame, can also have a coarser structure. Thereby, an improved ventilation can be supported. Further, the protrusions of the sole portion can be provided with larger diameters to adapt the form-fitting engagement with the outer shoe accordingly. The frame according to FIG. 2D comprises wider cross struts. The heel region and the toe region of the foot are not free from the frame. The frame therefore comprises an increased sturdiness. The frame according to FIG. 2E comprises a sole portion with protrusions, which are made of a different material than the sole portion. The protrusions can for example be made of a material, which provides higher friction with the indentations of an outer shoe.

FIG. 3 shows a further example of a frame 310. It comprises a sole portion 320. The sole portion 320 comprises a heel portion 323 with which the sturdiness provided by frame 310 is increased. The sole portion 320 comprises a plurality of protrusions 325, which are configured to engage in a form-fitting manner with indentations in regions of profile elements of an outer shoe. Protrusions 325 are arranged in the heel region of the sole portion and in the front region of the arch of the foot. Forefoot region 321 of the sole portion 320 does not comprise protrusions. This facilitates covering frame 310 with an outer shoe. To prevent a relative movement between frame 310 and an outer shoe arranged around it, frame 310 can comprise, besides the discussed protrusions 325 for a form-fitting engagement, a material that provides an increased static friction with the outer shoe. This material can be provided in forefoot region 321 and/or in a region 324 above heel portion 323. In forefoot region 321, slipping of the outer shoe relative to the frame can thus be prevented despite the absence of protrusions. The material with higher static friction in region 324 additionally prevents a vertical slipping of the outer shoe relative to frame 310 so that a "slipping out" of frame 310 from the outer shoe can be prevented. In other examples, a material with increased static friction can alternatively or additionally be provided in other regions of the frame. A material with increased static friction is for example a rubber material. The rubber material can be directly applied onto the frame. Alternatively, a rubberized textile can be attached to the frame, for example by bonding (e.g., gluing).

Frame 310 moreover comprises an upper part portion 330. Upper part portion 330 can comprise an extendable textile as a base material. The base material can essentially cover the upper part of the foot in its entirety. Upper part portion 330 optionally comprises a lace fastening 331 and a seam 372. Furthermore, the frame optionally comprises a quick fastening system. Also, a lateral adaption system is provided which comprises strips 332 arranged on the medial and lateral side faces of the frame, which each extend from the sole portion of the frame to the instep region of the upper part portion. The strips each wrap around the strings of the lace fastening 331 and act together with them. Strips 332 serve to additionally achieve an optimal fit of the frame to the foot of the wearer in the medial and lateral regions. The strips provide a comfortable and safe fixing of the upper part portion around the foot. Lace fastening system 331 and the optional quick fastening system can be configured to tension strips 332. In other examples, also more, fewer or other strips 332 can be provided. In some examples, a hook and/or a loop can be provided in the heel region of the upper part portion 330, e.g. laterally, and/or in the region of the heel portion 323 of the sole portion 320, e.g. laterally, which are respectively configured to act together with a loop or a hook of an outer shoe. Thereby, the connection between the outer shoe and the frame can be further improved.

FIGS. 4A-B show lateral views of an example of an outer shoe 450. The outer shoe 450 is configured so that it can be arranged around the frame according to FIG. 2E. In particular, outer shoe 450 comprises a plurality of profile elements 465, each having an indentation, which can engage in a form-fitting manner with the protrusions of the frame according to FIG. 2E. The outer shoe 450 comprises a hook and loop fastener 471 with which the outer shoe can additionally be fixed to the upper part portion of the frame.

Alternatively or additionally, a zip fastener can be provided, for example centered along the instep region of the foot. In other examples, other fasteners are also possible. However, a separate fastener of the outer shoe is only optional. Fixing the outer shoe at the frame can for example also be ensured by configuring the outer shoe with an elastic material.

Outer shoe 450 can furthermore comprise a seam 472, which respectively runs around the ankle or the leg. Thereby, a fraying of outer shoe 450, or moisture or dirt penetrating from above into the outer shoe 450 can be prevented and a pleasant wearing comfort can be ensured. Outer shoe 450 can be made of a waterproof material and can be configured to be transparent. In other examples, different colors and/or levels of transparency can be provided for outer shoe 450. Outer shoe 450 can further comprise a stiffening element 478 in the heel region and stiffening elements 479 at the medial and lateral sides of the foot. These can contribute to preventing the risk of tearing or overstretching of the outer shoe.

FIGS. 5A and 5B show a side and a lower view, respectively, of a further example of a frame 510 encompassing the foot. Frame 510 comprises a sole portion 520. The latter may be manufactured monolithically and comprises a plurality of protrusions 525 for releasably engaging in a form-fitting manner with an outer shoe. Optionally, an insole can fixedly or releasably be connected with sole portion 520.

Frame 510 comprises an upper part portion 530, which is configured sandal-like and which is configured softer compared to upper part portion 130. Various configurations in sandal-like manner, in particular minimalistic and simple configurations, of a frame are possible. Therein, the frame may always encompass the foot, i.e. it is ensured by the sole portion and the upper part portion that the frame is fixed to the foot.

Upper part portion 530 comprises a first connection element 531, which encompasses the foot in the heel region and the upper instep region. A second connection element 531 is arranged around the lower instep/toe region. Connection element 532 forms a strap. It may comprise two portions. A first portion, which can be non-extendably configured, runs underneath the sole portion 520. A second portion, which for example may be configured elastically or with a hook and loop fastener, runs over the sole portion 520. Thus, a good fit of the connection element 532 with the lower instep/toe region of the respective foot can be ensured. Connection element 531 can also comprise two portions. A first portion runs under the sole portion 520 and extends around the heel region of the foot above the sole portion 520. The first portion can be made of a non-extendable material and forms a strap-shape. A second portion of the connection element 531 extends from the first portion around the upper instep region of the foot. This second portion can be configured elastically or with a hook and loop fastener to fix the frame according to the respective anatomy of the foot.

Connection elements 531 and 532 can comprise openings, as shown in FIG. 5B, through which protrusions 525 of sole portion 510 extend, so that upper part portion 530 can be fixed at sole portion 510. Additionally, upper part portion 53*o* can also be bonded (e.g., glued) with sole portion 520. Frame 510 comprises an optional push button 533 for releasably connecting with an outer shoe.

FIG. 6 shows a further example of a frame 610 with an upper part portion 630 configured in a sandal-like manner. Frame 610 comprises a connection element 631, which is configured similarly to connection element 531. The second connection element 632 however comprises two straps as opposed to connection element 532. The two straps are above each other but are arranged in a slightly rotated manner with respect to each other, wherein the straps are rotated around a vertical axis by approximately +30° and −30°, respectively. Thus, a higher sturdiness of the forefoot region within frame 610 can be provided.

Figure 7A:
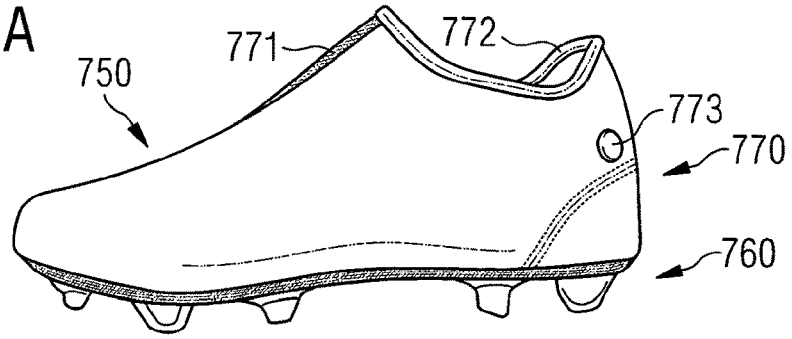
Figure 7B:
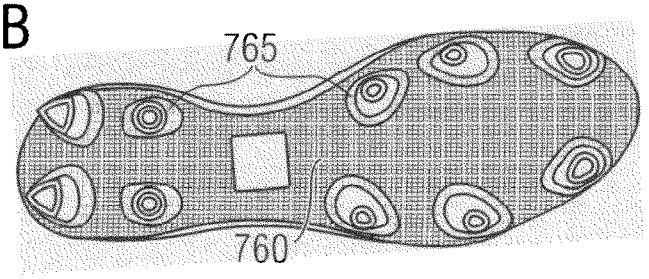

FIGS. 7A and 7B show a side view and a bottom view of an outer shoe 750. The outer shoe comprises an upper portion 770 and a ground portion 760. The upper portion 770 substantially forms the outer side of the upper part of a modular shoe when outer shoe 750 is arranged around a frame. Upper portion 770 can comprise a fabric and/or a plastic. Upper part 770 can be substantially made of a single material. Optionally, a heel element can be sewed to upper portion 77*o*. Upper portion 770 can comprise a push button 773 for releasably connecting with a corresponding push button at a frame, as for example discussed with reference to FIG. 2A. Furthermore, upper part 770 can comprise a seam 772. Outer shoe 750 can also comprise a zip fastener 771. Thus, outer shoe 750 may be more easily arranged around a frame. Zip fastener 771 of outer shoe 750 is attached in an upper instep region along a longitudinal direction of the shoe. Zip fastener 771 can be attached at different positions depending on the use of the shoe. When used as a soccer shoe, the zip fastener can also, for example, be provided at the edge of the heel region of the foot. Ground portion 760 of outer shoe 750 may be made of a different material than upper portion 770. Upper portion 770 and ground portion 760 can be sewed or bonded (e.g., glued) together. Thus, different properties can be provided in upper portion 770 and ground portion 760.

As shown in FIG. 7B, ground portion 760 comprises a plurality of profile elements 765, which serve to increase the stability provided by outer shoe 750. At least one of the profile elements 765 is configured to engage in a form-fitting manner with a lower side of a frame to stably but releasably arrange outer shoe 750 around a frame. Profile elements 765 are arranged in the forefoot region and in the heel region. Therein, in the forefoot region, they are arranged in circles and the individual profile elements 765 are configured asymmetrically to facilitate quick turns of the shoe around the forefoot region. The region of the arch of the foot may be free from profile elements so as to not impede a rolling movement of the foot.

Figure 7C:
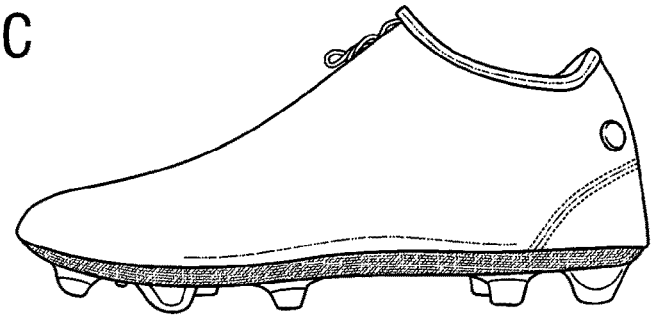
Figure 7D:
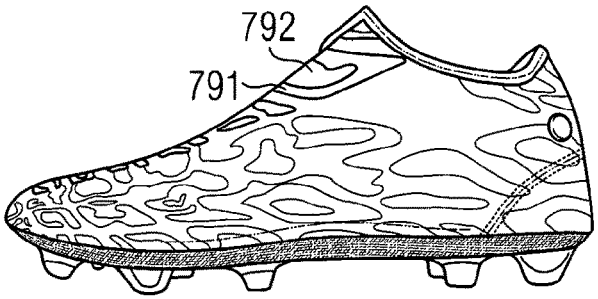

FIG. 7C illustrates an example for the upper portion 770 of outer shoe 750 being functionalized and/or designed optically according to the respective requirements. According to the example of FIG. 7C, several zones are provided in the instep region of the shoe, which are provided with an additional material. To this end, upper portion 770 can be printed, coated, laminated and/or bonded (e.g., glued) etc. with additional material. Also ground portion 760 can thus be provided with an additional material, for example with a water and/or dirt resistant coating. FIG. 7D shows a further example of an outer shoe with various zones 791, 792. Various zones 791, 792 may be provided with different functions and optically configured by different materials, almost arbitrarily.

Figure 7E:
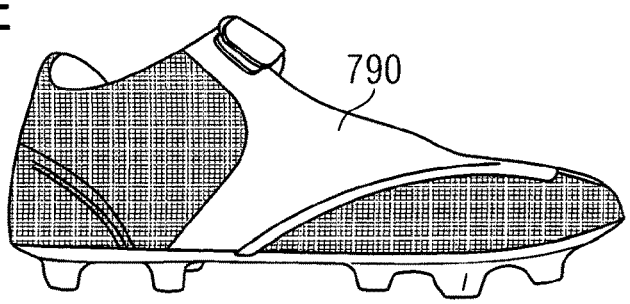

As illustrated in FIG. 7E, an outer shoe can also comprise at least one zone 790, which is made of a different material, for example leather or artificial leather, than the other portions of the outer shoe. The at least one zone 790 can for example be sewed to the other portions of the outer shoe. Also outer shoes with zones of different materials may be provided with functions and/or be optically designed by printing etc., as explained above. Finally, an outer shoe can also comprise a hook and loop fastener, as e.g. shown in FIG. 7E, to fix the outer shoe in the upper instep region of the foot. The hook and loop fastener can be provided alternatively or additionally to the zip fastener 771 according to FIG. 7A.

FIG. 8A shows a further example of an outer shoe 850. Outer shoe 850 comprises a ground portion 860 with a plurality of profile elements. Furthermore, outer shoe 850 comprises an upper portion 870, which is made of a different material than the ground portion 860. Upper portion 870 optionally comprises a fixed heel counter. A flap 874 can be provided in the upper heel region of the upper portion 870 and can facilitate covering the frame with the outer shoe and removing the outer shoe from the frame, respectively. The upper portion 870 comprises several zones 890-894. Zones 890-893 comprise a stretchable material, e.g. a stretchable textile, and are coated with different PU layers. Thereby, the zones can be configured to be more abrasion resistant, to have an increased tensile strength and/or to have an increased adhesion for contact with a ball. For example, an increased adhesion can be provided in zone 893. Zone 894, which is arranged in the toe region, is made of leather, e.g. genuine leather. The leather material in the toe region can provide a better feeling of the ball for a soccer shoe.

Optionally, zone 894 can also be equipped with further functional materials, for example PU. In other examples, further and/or other zones can be provided.

FIG. 8B shows a further example of an outer shoe 851. Outer shoe 851 comprises an upper portion 871. Upper portion 871 comprises in its entirety a stretchable material, e.g. a stretchable textile. Zones 890-893 of upper portion 871 are provided, which can be configured essentially as zones 890-893 of the upper portion according to FIG. 8A. Further, the upper portion comprises zones 895-897. Zones 895 and 896 can be configured similar to zones 890 and 893 respectively. Zone 897 can for example comprise an additional reinforcement due to a coating and/or a bonded reinforcing element to increase the long-term sturdiness of the outer shoe. Apart from that, outer shoe 851 can be configured like outer shoe 850.

FIGS. 9A-B show a side and a bottom view, respectively, of an example of a modular shoe 900 with a frame 910 and an outer shoe 950. Frame 910 can be configured like frame 310, which was discussed with reference to FIG. 3. Outer shoe 950 comprises a ground portion 960 with a plurality of profile elements 965. The profile elements in the heel region and the two profile elements in the front region of the arch of the foot each comprise at their upper sides an indentation to engage in a form-fitting manner with the corresponding protrusions of frame 910 (cf. FIG. 3). The four profile elements 965 in the forefoot region do not comprise such indentations. Frame 910 accordingly also does not comprise protrusions in the forefoot region (cf. FIG. 3). In other examples, different numbers of profile elements can also be provided with or without indentations, respectively. Outer shoe 950 can be substantially manufactured in two parts. Ground portion 960 of outer shoe 950 comprises a first material onto which profile elements 965 can for example be molded. The first material can comprise a base layer of a fabric or textile with a layer of TPU or PU applied thereon. A layer of PU, in particular of TPU, can increase the abrasion resistance of ground portion 960. Prior to and/or after attaching profile elements 965, further layers can be provided, e.g. in a forefoot region, to locally further increase the abrasion resistance.

Outer shoe 950 further comprises an upper portion 970, which is made of a material that differs from the first material of the ground portion 960. The material of upper portion 970 can be more flexible and/or more elastic than the first material of the ground portion 960. For example, an elastic textile with a PU coating is provided to this end. By means of this material, for example a good fit of the upper portion 970 can be achieved. Generally, also a textile fabric, a knitted fabric, polyurethane, leather, polyamide 12, PEBA and/or TPU may also be used for this matter. For upper portion 970 also materials can be used which have so far been used as upper materials for known soccer shoes, e.g. a synthetic PU material, a fabric, leather or TPU. The material for the upper portion may however be configured to be thinner to achieve an increased stretchability and/or flexibility. The necessary sturdiness for fixing at the shoe is provided by a frame 910. The upper portion may comprise zones 990, which may each be configured differently or provided with different functions, respectively. Further, the upper portion can comprise overlapping layers. The thus created edges 971 can be connected by means of a coating, a cement, and/or further functional elements. The edges 971 can however also simply overlap and can be sewed together sectionally.

Upper portion 970 and ground portion 960 of outer shoe 950 may be permanently connected with one another in different ways. Ground portion 960 may be bonded to the lower side of the upper portion 970. Ground portion 960 does not have to cover the entire lower side of upper portion 970 but certain zones 991 of the lower side of the upper portion 970 may remain free from ground portion 960.

Alternatively or additionally, the upper portion and the ground portion can be sewed together. It is also possible to connect an upper portion with a ground portion via lasting or a board lasting method, respectively. To this end, an insole (Brandsohle) in the shape of a thin foil, in the shape of a thin textile or in the shape of a thin ground plate can be placed on a last and the upper portion can be connected via lasting with the thin foil, the thin textile or the thin ground plate respectively. Subsequently, the ground portion may be bonded with the thin foil, the thin textile or the thin ground plate.

In all alternatives, profile elements 965 may be applied to the ground portion 960 prior to connecting ground portion 960 with upper portion 970. After applying profile elements 965, openings may be created in the regions of profile elements 965 in ground portion 960, e.g. by punching. In the same manufacturing step or separately, if necessary, respective openings can also be created on the lower side of upper portion 970, so that protrusions of frame 910 (cf. FIG. 3) may engage with corresponding indentations in the profile elements. This can be performed prior to or after attaching the ground portion 960 at upper portion 970.

FIGS. 10A and 10B show a side view and a bottom view of a further example of an outer shoe 1050. Upper portion 1070 and ground portion 1060 of outer shoe 1050 are made of the same material. Upper portion 1070 and ground portion 1060 are sewed together. However, they can also be manufactured monolithically. Outer shoe 1050 optionally comprises a lining 1088 to increase the wearing comfort. Outer shoe 1050 can comprise a separate portion in the upper instep region, which can be elastically configured so that an improved fit can be provided. Further, outer shoe 1050 comprises a zip fastener 1071. The zip fastener runs along the lateral side of the outer shoe from the region from the little toe to the region of the ankle of the foot.

As shown in FIG. 10B, the ground portion of the outer shoe comprises a plurality of profile elements. These are essentially arranged as already discussed with reference to FIG. 7B. The profile elements can be directly molded onto ground portion 1060 with an injection molding method. The profile elements comprise e.g. TPU.

Figure 11A:
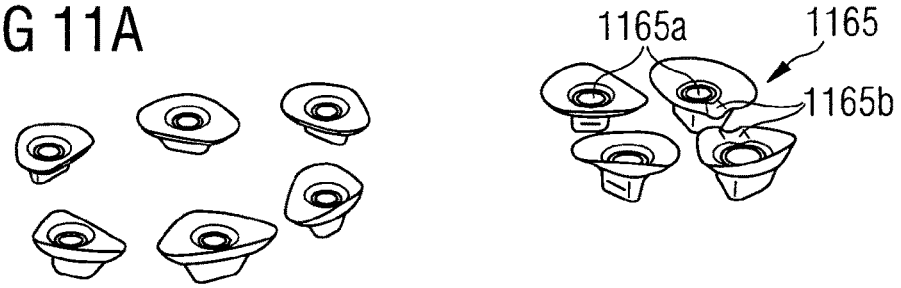

FIGS. 11A-E show examples for the interaction of profile elements 1165 of an outer shoe and protrusions 1125 of a frame. FIG. 11A shows a perspective view of the upper sides of a plurality of profile elements 1165, as they are for example provided in the outer shoe according to FIGS. 10A-B. The profile elements are each asymmetrically configured. Further, their diameters are tapered from bottom to top. On the upper side of each profile element, an indentation 1165*a* is provided. The indentation 1165*a* is approximately centrally arranged in each profile element. Indentation 1165*a* can be provided as a simple cylindrical recess. Indentation 1165*a* can however also be configured with several steps. In particular, indentation 1165*a* can comprise an outer region, in which the indentation 1165*a* is configured to be flat, whereas it may be steeper in an inner region. Indentation 1165*a* can in particular be configured to be downwardly tapered. With such a two-step and/or tapered indentation 1165*a*, the form-fitting engagement of indentation 1165*a* with a frame may be more easily manufactured and more stably configured. In other examples, a profile element comprises several indentations. A profile element 1165 may comprise, additionally or alternatively to indentation 1165*a*, an elongated indentation 1165*b*, with which a corresponding elongated protrusion 1125 of a frame, as discussed with reference to FIG. 11D, may engage in a form-fitting manner. Elongated protrusion 1125 according to FIG. 11D primarily serves to increase a bending stiffness and/or strength in the rear heel region between the two rear profile elements 1125.

Figure 11B:
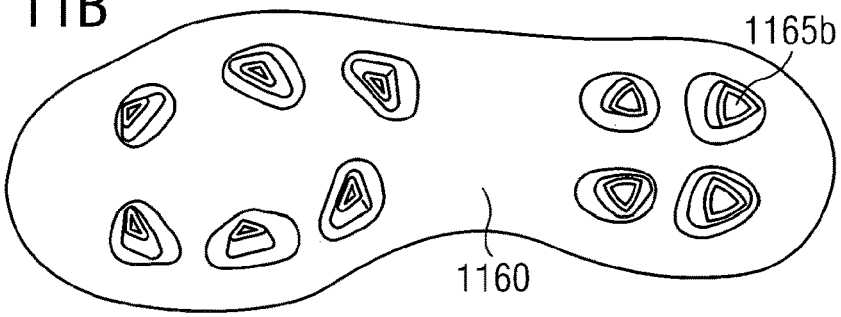

FIG. 11B shows a bottom view of profile elements 1165, which have been injected onto a ground portion 1160 of an outer shoe using injection molding. In other examples, profile elements 1165 can also be injected onto the entire outer shoe or can be attached to the outer shoe or ground portion 1160 in other ways, for example by bonding (e.g. gluing).

Figure 11C:
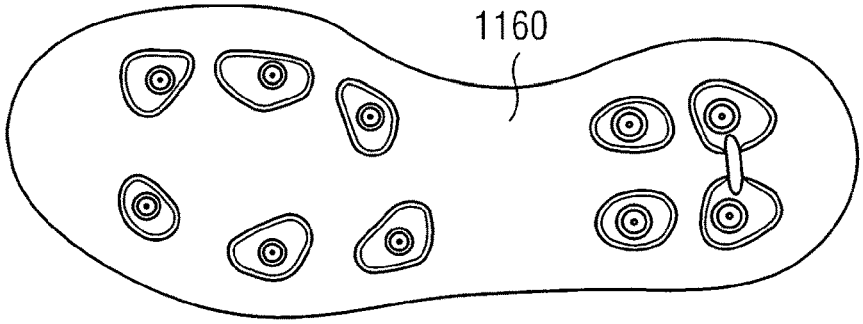

FIG. 11C shows a top view of the profile elements and ground portion 1160 according to FIG. 11B. As can be seen in FIG. 11C, the ground portion comprises an opening for each profile element 1165. Through these openings, corresponding protrusions of the lower side of the frame can extend into indentations 1165*a* and 1165*b* of profile elements 1165, so that a form-fitting engagement is created.

Figure 11D:
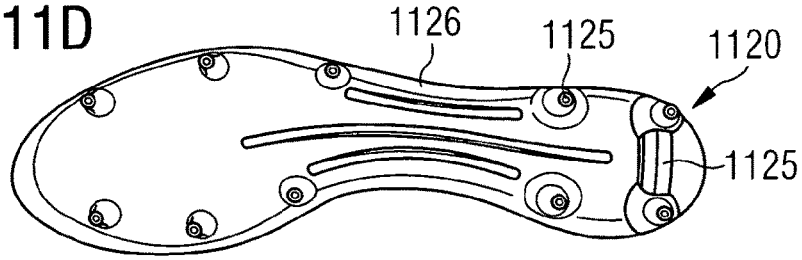
Figure 11E:
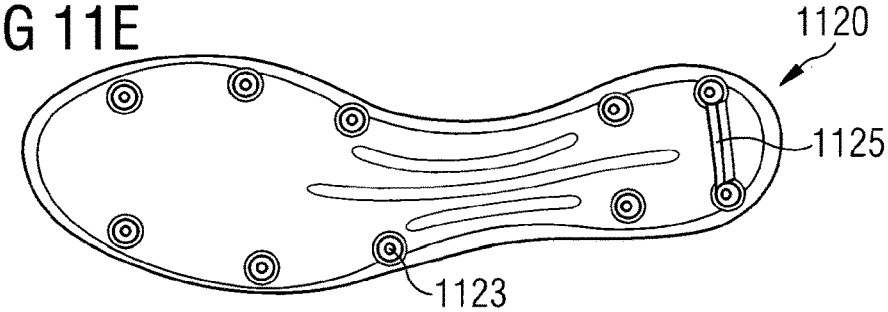

FIGS. 11D-E show a bottom view and a top view, respectively, of a sole portion 1120 for a frame, which is configured to engage in a form-fitting manner with ground portion 1160 of an outer shoe according to FIGS. 11B-C. As shown in FIG. 11D, sole portion 1120 comprises a plurality of protrusions 1125, which may engage in a form-fitting manner with indentations 1165*a* and 1165*b* of profile elements 1165 of ground portion 1160. Therein, protrusions 1125 may be configured as already discussed with reference to protrusions 225. Further, sole portion 1120 can comprise grooves 1126, as already discussed with reference to grooves 226.

As shown in FIG. 11E, protrusions 1123 can be provided on the upper side of sole portion 1120 to enable a form-fitting engagement of sole portion 1120 with an upper part portion of a frame, as further discussed with reference to the following figures. The upper part portion and the sole portion of the frame are then releasably connected with each other, wherein, additionally to the form-fitting engagement, the outer shoe, which is arranged around the frame, keeps the releasable connection stable. Alternatively or additionally, the sole portion can be bonded with an upper part portion of a frame.

Figure 12A:
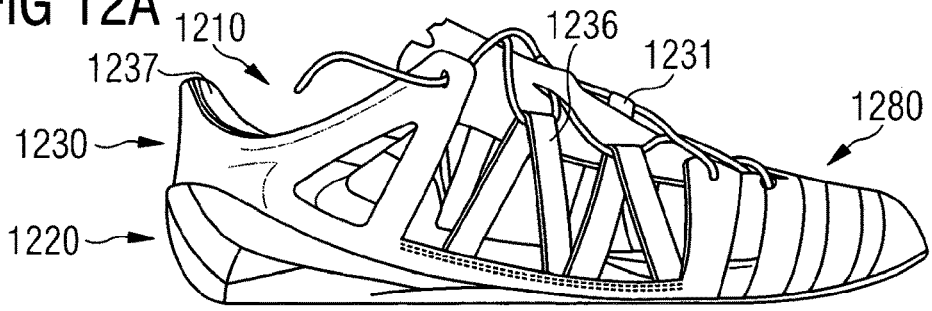

FIGS. 12A-E show further examples of a frame 1210 and of an outer shoe 1250. FIG. 12A shows an example of a frame 1210 with a sole portion 1220. Sole portion 1220 can be made of a hard plastic to provide a high sturdiness of frame 1210. Sole portion 1220 may be configured to be slightly elevated in the heel region of the foot so that it partly extends around the heel region of the foot. Frame 1210 further comprises an upper part portion 1230 with a lace fastening 1231. Upper part portion 1230 can for example comprise leather or artificial leather. Upper part portion 1230 is also arranged in toe region 1280 and in the heel region of the foot. At the lateral and medial side faces of the foot, upper part portion 1230 comprises free regions. There, several cross struts 1236 are arranged, between which optionally a fabric can be arranged, as for example discussed with reference to FIG. 2A. Alternatively, the free regions can however also be free from the frame. Frame 1210 optionally comprises a lining 1237. Protrusions of sole portion 1224 acting together with profile elements of a sock-like outer shoe are not shown in FIG. 12A but may be present.

Figure 12B:
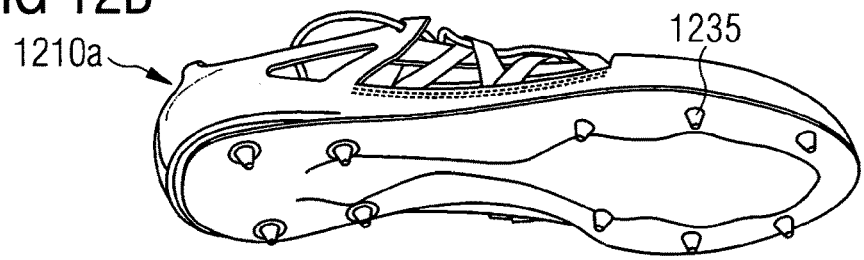

FIG. 12B shows a further variant of an embodiment of a frame 1210*a*. The lower side of frame 1210*a* comprises a plurality of protrusions 1235. In this variant, protrusions 1235 are bonded (e.g. glued) to a lower side of frame 1210*a*. Protrusions 1235 can act together with a plurality of indentations in corresponding profile elements of a sock-like outer shoe for a form-fitting engagement.

Figure 12C:
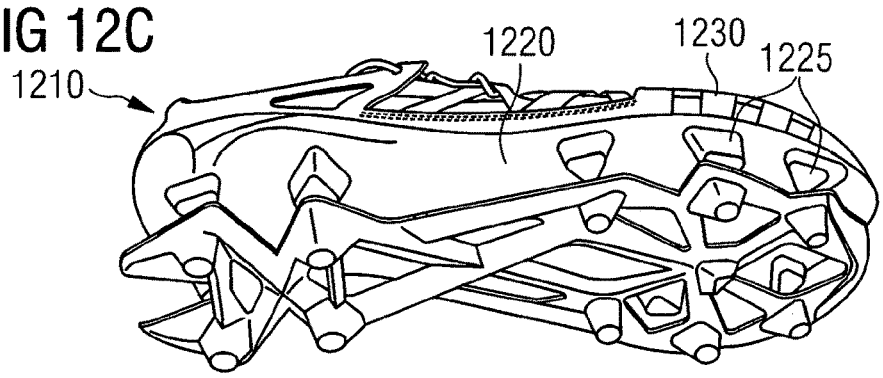

FIG. 12C shows an inclined lower view of upper part portion 1230 of frame 1210 with sole portion 1220 attached thereto. Sole portion 1220 comprises a plurality of protrusions 1225 on its lower side, which are configured for a form-fitting engagement with corresponding indentations in regions of profile elements 1265 of an outer shoe 1250 (cf. FIG. 12E).

Figure 12D:
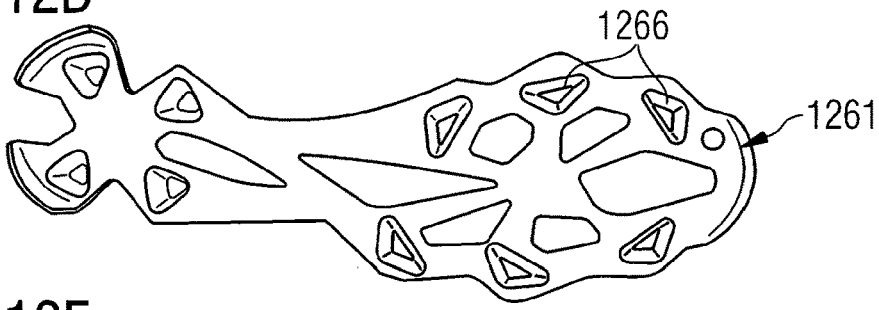
Figure 12E:
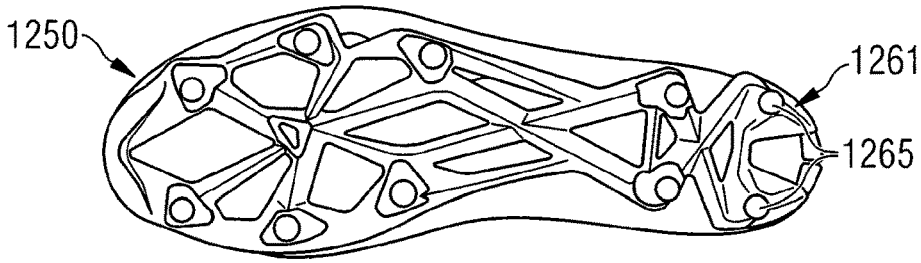

FIG. 12D shows a sole attachment 1261 with a plurality of indentations 1266, which are each arranged in a region of opposing profile elements 1265 (see FIG. 12E). Sole attachment 1261 is formed monolithically, for example by injection molding. Sole attachment 1261 comprises a plurality of passage openings, which can be arranged such that certain visual and/or mechanical properties of the sole attachment 1261 are provided. Alternatively or additionally, other recesses can also be provided.

FIG. 12E shows a sole attachment 1261 with a plurality of profile elements 1265, which is attached to an outer shoe 1250. For example, sole attachment 1261 is bonded (e.g. glued) to outer shoe 1250. Outer shoe 1250 comprises openings in regions above profile elements 1256 or above indentations 1266, respectively, so that protrusions 1225 of frame 1210 can engage in a form-fitting manner with indentations 1266. In other examples, a plurality of profile elements may be connected via one or more sole attachments and may be attached to an outer shoe.

FIGS. 13A-B show an example of a modular shoe 1300. As can be seen in FIG. 13A, modular shoe 1300 comprises an outer shoe 1350, which comprises a plurality of profile elements 1365. Outer shoe 1350 extends until approximately the region below the ankle of the foot. In other examples, the outer shoe can extend until a region above the ankle of the foot or even further.

FIG. 13B shows a modified variant of a modular shoe 1301. Outer shoe 1350 comprises a seam 1372. The outer shoe comprises one or more openings in the instep region of the foot, through which several flaps of a frame 1311 arranged within the outer shoe extend. These flaps can form lace-fastening 1331 of the frame. By passing the flaps through one or more corresponding openings in outer shoe 1350, lace-fastening 1331 can also extend partially around the outer shoe within the instep region of the foot. Thus, an additional releasable fixing of the outer shoe at the frame may be ensured. The frame can comprise a stretchable material, which may comprise neoprene.

FIGS. 14A-C show side views and a bottom view of a further example of an outer shoe 1450. The outer shoe can comprise a seam 1472 and comprises several profile elements 1465. Outer shoe 1450 comprises several zones 1490 in the toe and instep region of the foot, in which an increased friction is provided for contact with a ball. In these zones 1490, a material suited for this purpose is applied on outer shoe 1450. Further, outer shoe 1450 can be provided with an abrasion resistant material in certain zones in the same manner. For an improved adhesion e.g. a rubber material can be used. For an improved abrasion resistance, a TPU foil can be applied, e.g. laminated, or another material can be injected. Alternatively, also a fabric with abrasion resistant fibers can be used, e.g. aramide or a polyurethane. Therein, a zone may cover the entire toe region and instep region. Also, one or more separate zones for the toe region, the instep region and/or the medial side of the foot and/or other zones can be provided. Profile elements 1465 are configured as triangular studs. In other examples, other types of studs can also be provided. The individual studs of an outer shoe may in particular also comprise different shapes, colors and/or materials.

FIG. 15 shows a further example of an outer shoe 1550. Outer shoe 1550 is constructed similarly to outer shoe 1450. However, outer shoe 1550 does not comprise a simple seam as outer shoe 1450 but a more complex seam 1572 with a hook and loop fastener 1571. Hook and loop fastener 1571 ensures a fixing of the outer shoe around a leg at or above the region of the ankle of the foot. Simultaneously, the seam 1572 extends around the upper instep region of the foot such that an opening is formed between the hook and loop fastener 1571 and the seam 1572. This may facilitate a bending movement of the leg relative to the foot, which occurs when walking or running. Compared to outer shoe 1450, outer shoe 1550 comprises differently arranged zones 1590, in which an increased friction is provided.

FIGS. 16A-B show a further example of an outer shoe 1650. The outer shoe comprises an upper portion 1670, which can be configured as described above. Further, outer shoe 1650 comprises a ground portion 1660, which comprises a layer 1662 with an expanded TPU. This layer can optionally be covered with an outsole, which comprises e.g. rubber. By means of this layer, the ground portion may be configured with special cushioning properties. As shown in FIG. 16B, a plurality of indentations or apertures can be provided in layer 1662 with expanded TPU, below which a plurality of profile elements can be arranged. The indentations and/or indentations in the profile elements can be provided to form a form-fitting engagement with corresponding protrusions of a frame of the outer shoe 1650.

FIGS. 17-20 show various examples of a modular shoe and corresponding frames as well as outer shoes, wherein the outer shoes each comprise a plurality of profile elements, which form a releasable form-fitting engagement with a plurality of protrusions on the lower side of the respective frames.

Frame 1710 according to FIG. 17A comprises a sole portion 1720, which comprises a plurality of protrusions 1725. Furthermore, sole portion 1720 comprises a heel portion 1723. The sole portion can for example be made of a hard plastic and can for example be manufactured monolithically. Frame 1710 further comprises an upper part portion 1730. The latter is configured in a sandal-like manner. Upper part portion 1730 comprises three noose-like portions 1731, 1732 and 1733. Each noose-like portion comprises four segments. In another example, more than or less than four segments can also be provided. Noose-like portion 1731 extends around the ankle region of the foot and encompasses the heel region and the upper instep region of the foot. The second noose-like portion 1732 encompasses the upper instep portion of the foot and the region of the arch of the foot. The third noose-like portion 1733 in turn extends around the heel region and the region of the arch of the foot. Each segment or some of the segments can be elastically configured to ensure a good fit of the frame. Within one or more of the noose-like segments, optional setting means can be provided, for example hook and loop fasteners. The toe region and the lower instep region of the foot are free from frame 1710. In these regions of the foot, thus only the subsequently described outer shoe 1750 is arranged, which can improve a ball control provided by outer shoe 1750.

FIG. 17B shows an outer shoe 1750, which is configured to be arranged around the frame 1710 to thus provide a modular shoe 1700, as shown in FIG. 17C. Outer shoe 1750 comprises a plurality of profile elements 1765. These are configured so that indentations on their upper sides can engage in a form-fitting manner with protrusions 1725 of frame 1710. Outer shoe 1750 comprises a heel counter 1753 to provide additional protection for the heel of the foot as well as additional sturdiness. Outer shoe 1750 comprises a first zone 1751, which is made of a first material, and a second zone 1752, which is made of a second material. Due to the different choices for the materials in these zones, desired sturdiness and friction properties may be provided there. First zone 1751 of the outer shoe is arranged in the toe and instep region of the foot as well as at the medial side of the foot. These regions of the foot are used most often for contacting a ball as regards soccer shoes and thus particularly high requirements for ball control need to be fulfilled in these regions. Accordingly, first zone 1751 of outer shoe 1750 can comprise a material enabling good ball control.

FIG. 17C shows modular shoe 1700 in lateral and medial views. As can be seen from the medial view, outer shoe 1750 can comprise a third zone 1754. Zones 1751, 1752 and/or 1754 can be elastically configured so that outer shoe 1750 adapts to frame 1710 and the respective shape of the foot. Within or overlapping within zones 1751, 1752 and/or 1754, respectively, further zones can be provided, e.g. by printing, as explained above.

FIGS. 18A-C show a further example of a modular shoe 1800 with a frame 1810 and an outer shoe 1850. Outer shoe 1850 according to FIG. 18A comprises a plurality of profile elements 1865. Apart from that, outer shoe 1850 is made of a single upper material. Outer shoe 1850 comprises a lacing 1871, which extends from the region of the upper instep around the ankle region so that the lacing can be tightened in the heel region of the foot. However, other fastening mechanisms are also possible for outer shoe 1850. When configuring outer shoe 1850 with an elastic material, a fastening mechanism can also be omitted. Frame 1810 shown in FIG. 18B is adapted to be arranged in outer shoe 1850. Frame 1810 comprises a sole portion 1820 with a plurality of protrusions 1825. The sole portion can be made of a hard plastic. Frame 1810 comprises an upper part portion 1830. Upper part portion 1830 can be made of a soft material to ensure good wearing comfort. Moreover, upper part portion 1830 can comprise an elastic material. The toe region and the region of the upper instep of the foot are free from the upper part portion. Further, frame 1810 comprises several openings in upper part portion 1830, which can improve a ventilation of the frame. FIG. 18C shows a modular shoe 1800. Due to the lacing 1871 of outer shoe 1850, a fixing of outer shoe 1850 around frame 1810 can also be ensured in the upper region of the shoe additionally to the form-fitting engagement between outer shoe 1850 and frame 1810 at its lower sides, as explained above. To this end, the softer upper part portion 1830 of frame 1810 can extend slightly across the upper end of outer shoe 1850 so that forces arising due to the lacing 1871 may be attenuated by upper part portion 1830. Also in this example, outer shoe 1850 may be provided with functions and be visually configured in an almost arbitrary manner.

FIGS. 19A-C show a further example of a modular shoe 1900 and a frame 1910 as well as an outer shoe 1950. FIG. 19A shows outer shoe 1950 with a sole portion 1920, which can be configured similarly to the sole portions described above and which comprises protrusions 1925. Moreover, frame 1910 comprises an upper part portion 1930 consisting of a foamed material. The toe region of the foot can be free from the frame. Also at the medial and/or lateral side faces of the foot, a recess can be provided in upper part portion 1930 so that an increased ball control may be provided also there. FIG. 19B shows outer shoe 1950 for being arranged around frame 1910. Outer shoe 1950 can comprise a portion 1952 at its lower side covering the lower heel region and the region of the arch of the foot. Portion 1952 can comprise a hard plastic to increase a sturdiness of the outer shoe. Apart from that, outer shoe 1950 can be configured similarly to the outer shoes described above and can be provided with a functionalization on its outer surface. FIG. 19C shows modular shoe 1900 with frame 1910 and outer shoe 1950. To fix the frame at the foot and/or the outer shoe around the frame, a fastening mechanism can be additionally provided around the ankle region of shoe 1900.

FIGS. 20A-C show a further example of a modular shoe 2000, a corresponding frame 2010 as well as an outer shoe 2050. As shown in FIG. 20A, frame 2010 comprises a sole portion 2020 with a plurality of protrusions 2025. Upper part portion 2030 of frame 2010 comprises a lower portion 2036, which can be made of a hard plastic just as sole portion 2020. Lower portion 2036 can comprise a plurality of protrusions on its lower side, which engage in a form-fitting manner with corresponding indentations of sole portion 2020. In other examples, protrusions can also be provided at sole portion 2020. Upper part portion 2030 can comprise a sandal-like portion 2035 arranged on the top of lower portion 2036. The sandal-like portion 2035 comprises a shaft-like region, which is provided for receiving the toe and instep regions of the foot. Above the shaft-like region, two nooses extend in the instep region of the foot, which each encompass partial regions of the instep region and of the arch of the foot. A further noose is provided, which extends from the region of the arch of the foot across the heel region of the foot. With the sandal-like portion 2035 and the lower portion 2036, frame 2010 encompasses the foot and ensures a fixing of the frame around the foot. The shaft-like region and the three nooses of upper region 2035 can be made of an elastic material. Additionally, the three nooses can comprise setting means, such as a hook and loop fastener or a strap fastener. In other examples, further and/or other and/or only one noose can be provided.

As shown in FIG. 20B, outer shoe 2050 comprises a plurality of profile elements 2065. The upper regions of profile elements 2055 are configured so that protrusions 2025 of frame 2010 can form a form-fitting engagement. Apart from that, outer shoe 2050 is essentially made of one material. Outer shoe 2050 can be optically configured and/or provided with functions as already explained above. The material of outer shoe 2050 can be an elastic material so that outer shoe 2050 independently adapts itself to frame 2010. Optionally, outer shoe 2050 can be provided with a seam 2072. FIG. 20C shows a lateral and a medial view of a modular shoe 2000, which is provided by frame 2010 and outer shoe 2050.

FIGS. 21A-D illustrate examples of a ground plate of a frame with protrusions 2125 and an outer shoe with profile elements 2165. One or more of profile elements 2165 of the outer shoe comprise an indentation, which is configured as an aperture of the respective profile element 2165. Protrusions 2125 engage in a form-fitting manner with the apertures of profile elements 2165. In an inserted position of protrusions 2125 into profile elements 2165, protrusions 2125 can stick out of the profile elements. Thereby, a controlled relative movement between protrusions 2125 and profile elements 2165 can specifically be enabled. Thus, for example dirt can fall out of profile elements 2165. Protrusions 2125 can also be configured to be approximately flush with the apertures of profile elements 2165 or to be arranged in a recessed manner within the apertures. Protrusions 2125 can for example improve the stiffness of profile elements 2165. In other examples, protrusions 2125 can also be provided on a frame with a different ground plate or without a ground plate.

Figure 21A:
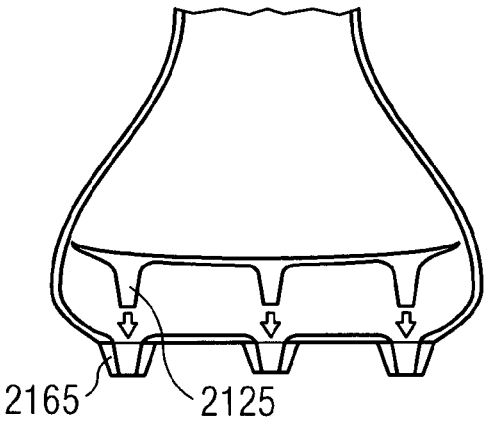
Figure 21B:
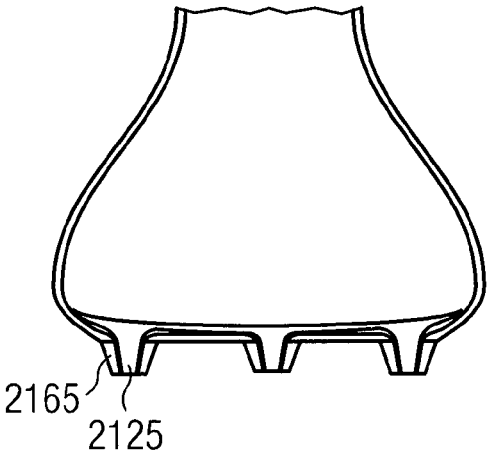
Figure 21C:
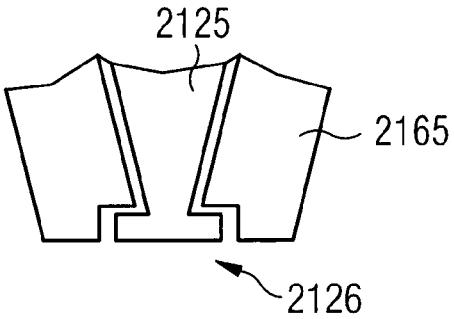
Figure 21D:
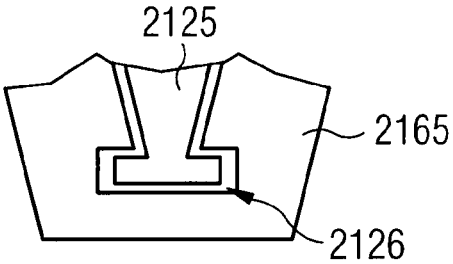

FIGS. 21C-D show examples of a locking mechanism between a profile element 2165 and a protrusion 2125. Protrusion 2125 is configured to be downwardly tapered and forms a form-fitting engagement with an indentation within profile element 2165. The distances between the edges of protrusions 2125 and profile elements 2165 only serve for illustration purposes. In FIG. 21C, the indentation within profile element 2165 is configured as an aperture, whereas this is not the case in FIG. 21D. An additional configuration of protrusion 2125 and/or the indentation can be carried out so that a vertical movement of protrusion 2125 out of the indentation and upward can be prevented. To this end, a screw cap or click closure can be provided. Protrusion 2125 can for example comprise a bulge 2126 at its lower side, while the indentation in profile element 2165 comprises a corresponding recess. Bulge 2126 of protrusion 2125 prevents that protrusion 2125 can move in a vertical direction upward and out of the indentation of profile element 2165. In order to be able to easily insert the bulge into and remove the bulge from the recess, respectively, when covering the frame with the outer shoe and when removing the outer shoe from the frame, bulge 2126 can be configured so that it does not extend around protrusion 2125 rotationally symmetrically but for example only extends at two opposing sides and thus can be inserted into and removed from a corresponding non-rotationally symmetrical recess e.g. by rotating. For example, the recess can be configured such that bulge 2126 arranges itself independently in the recess, for example it may be inserted therein via a thread, when it is pushed downwards into the indentation of the profile element, but also such that it can only be pushed out of the recess in connection with a manual rotation. Alternatively or additionally, various other mechanical connection means for providing such a fixing are possible, for example with the help of a pushbutton-like connection element at the lower side of the protrusion 2125 and at the upper side of the recess of the profile element 2165 and/or a hook/loop arrangement etc. between profile element 2165 and protrusion 2125 in FIG. 21C or in FIG. 21D. In other examples, the indentation can also be provided in the frame and the protrusion can also be provided at the upper side of the profile element.

FIGS. 22A-C show an example of a modular shoe with profile elements, wherein the profile elements are provided at a lower side of a sole portion of a frame.

FIG. 22A shows an example of an outer shoe 2250 with a plurality of openings 2255 at its lower side. Openings 2255 have a three-dimensional shape. Openings 2255 are in particular configured to comprise in a funnel shape and to be downwardly tapered. Outer shoe 2250 can comprise a seam 2272 and may essentially be made of a single material, which can optionally be provided with functions and/or be optically configured. Apart from that, outer shoe 2250 may be configured as explained above with reference to the already discussed figures.

FIG. 22B shows a frame for arrangement within outer shoe 2250. Frame 2210 comprises a plurality of profile elements 2265, which are arranged at a sole portion 2220 of frame 2210. Furthermore, frame 2210 comprises an upper part portion 2230, which can comprise a lace fastening 2231. Upper part portion 2230 may comprise a soft material, whereas sole portion 2220 and profile elements 2265 may comprise a hard material. Profile elements 2265 can be manufactured monolithically together with sole portion 2220. Alternatively, only attachments for the profile elements may be manufactured monolithically together with the sole portion, onto which the profile elements are attached in a further manufacturing step. Frame 2110 can also comprise a seam 2232. Apart from that, frame 2110 may be configured as explained above with reference to the other figures.

FIG. 22C shows the modular shoe 2200 with frame 2210 and outer shoe 2250. Funnel-shaped downwardly tapered openings 2250 are configured so that they arrange themselves around profile elements 2265, which are also downwardly tapered, such that outer shoe 2250 is arranged around profile elements 2265 across an area. Thus, a sealing area is provided, which laterally abuts profile elements 2265. Outer shoe 2250 may comprise an elastic material so that openings 2255 adapt themselves automatically to profile elements 2265 when covering frame 2210 with outer shoe 2250. When arranging the outer shoe 2250 with openings 2255 around frame 2210 with profile elements 2265 and when subsequently putting on the thus provided modular shoe 2200, profile elements 2265 are pushed into funnel-shaped openings 2255 so that funnel-shaped openings 2255 laterally abut profile elements 2265. The contact area between openings 2255 and profile elements 2265 forms a sealing area, which seals openings 2255, so that a penetration of moisture and/or dirt into modular shoe 2200 is prevented.

As already explained with reference to FIG. 18C, the frame, at the ankle, may extend slightly further upward along the foot so that only frame 2210 abuts the foot. The material of the upper part portion of the frame may thus be optimized for a pleasant wearing comfort, while the material of outer shoe 2250 can for example be optimized for providing a desired friction for a football shoe.

FIGS. 23A-C show a further example of a modular shoe 2300 with a frame 2310 and an outer shoe 2350. Outer shoe 2350 comprises, as shown in FIG. 23A, a zone 2351 and a heel counter 2253. Further zones can also be provided, as already explained with reference to other examples. At its lower side, the outer shoe comprises a plurality of openings 2355, which are configured so that profile elements 2365*a* and 2365*b* of frame 2310 extend through them such that a sealing is provided. Additionally, the outer shoe itself can also comprise profile elements 2365.

As shown in FIG. 23B, frame 2310 comprises a sole portion 2320. Sole portion 2320 comprises several profile elements 2365*b*, which can be manufactured monolithically with sole portion 2320. Profile elements 2365*b* can be extended via a thread connection with profile elements 2365*a*. Other connection types are however also possible. Moreover, also only simple profile elements may be provided at the sole portion, which cannot be extended. The frame further comprises an upper part portion 2330. The latter comprises an upper portion 2335 with a lace fastening 2331 and cross struts, which can be configured as already explained with reference to other examples. Upper part portion 2330 comprises a lower portion 2336, which can be made of the same material as sole portion 2320. Lower portion 2336 can be bonded (e.g. glued) or can be permanently connected in another way to upper portion 2335.

Lower portion 2336 can comprise a plurality of protrusions, which are configured so that they form a releasable form-fitting engagement with a plurality of indentations in sole portion 2320. Thus, different upper part portions and sole portions can be combined in a frame. Corresponding protrusions can alternatively or additionally also be provided at sole portion 2320.

FIG. 23C shows the modular shoe 2300 with frame 2310 and outer shoe 2350. Openings 2355 form a sealing around profile elements 2365*b*. Profile elements 2365*b* can be extended via profile elements 2365*a*, as explained above. Additionally to these profile elements of frame 2310, shoe 2300 also comprises profile elements 2365 of the outer shoe. Frame 2310 and at least one profile element 2365 can optionally be configured so that the lower side of the sole portion 2320 of frame 2310 releasably engages in a form-fitting manner with outer shoe 2350 in the region of the at least one profile element 2365, as for example explained with reference to FIGS. 1-20.

FIGS. 24A-B show details of a ground portion 2460 of an outer shoe with a plurality of profile elements 2465 and a plurality of openings 2455, which can be configured as profile elements 2365 and openings 2355. Openings 2455 can moreover comprise a hard plastic to support a three-dimensional shape of the openings. Sole portion 2420 of a frame, which is adapted to ground portion 2460, comprises a plurality of protrusions 2425, which may engage in a form-fitting manner with corresponding indentations in the regions of the profile elements 2465. Further, sole portion 2420 comprises profile elements 2465*b*, which can extend through openings 2455 such that a sealing is provided, as explained with reference to FIG. 23. FIG. 24B shows the ground portion 2460 with sole portion 2420 inserted below it. Profile elements 2465*b* may be extended with profile elements 2465*a*. The extendable profile elements 2465*b* can be arranged in the heel region to enable a particular stability there. Profile elements 2465*a* can improve the connection between the sole portion 2420 of the frame and the ground portion 2460 of the outer shoe, e.g. via a screw or plug connection with profile elements 2465*b*. In some examples, profile elements 2465*a* and 2465*b* are arranged in a rear heel region and/or a front toe region, whereas for the other regions, profile elements 2465 are provided.

FIGS. 25A-F show lateral, medial, top, rear, front, and bottom views, respectively, of a further example of a frame 2510. Frame 2510 comprises a sole portion 2520 and an upper part portion 2530. Both may generally be—but need not be—adapted as explained with respect to previously described sole portions and upper part portions.

Upper part portion 2530 may comprise a toe region, an instep region, a lateral side region, a medial side region, and/or a heel region. Together with sole portion 2520, the upper part portion 2530 may encompass the foot of the wearer. For example, upper part portion 2530 may be arranged to extend up to or to below the ankle region of the foot of the wearer. In other example, it may also extend above the ankle region. Optionally, the upper part portion 2530 may comprise a seam 2572 running around an upper rim of upper part portion 2530. Seam 2572 may help to avoid a fringing of upper part portion 2530 and/or to ensure a tight fit of upper part portion 2530 around the ankle and/or leg of the wearer.

Upper part portion 2530 may comprise a stretchable and/or elastic material 2531. For example, upper part portion may comprise a stretchable fabric, e.g. a stretchable mesh. The stretchable and/or elastic material 2531 may extend throughout upper part portion 2530. Upper part portion 2530 may be provided substantially monolithically. For example, the stretchable and/or elastic material 2531 may be manufactured as a single piece and formed into upper part portion 2530 by sewing, e.g. along a further seam 2573 (cf. FIG. 25E), which may run centrally along the instep region of upper part portion 2530.

Upper part portion 2530 as well as frame 2510 may not comprise any lace fastening, quick fastening or any other specific fastening means. Instead, a tight fit may be provided by adapting frame 2510 (e.g., upper part portion 2530) to be elastic.

Figure 25A:
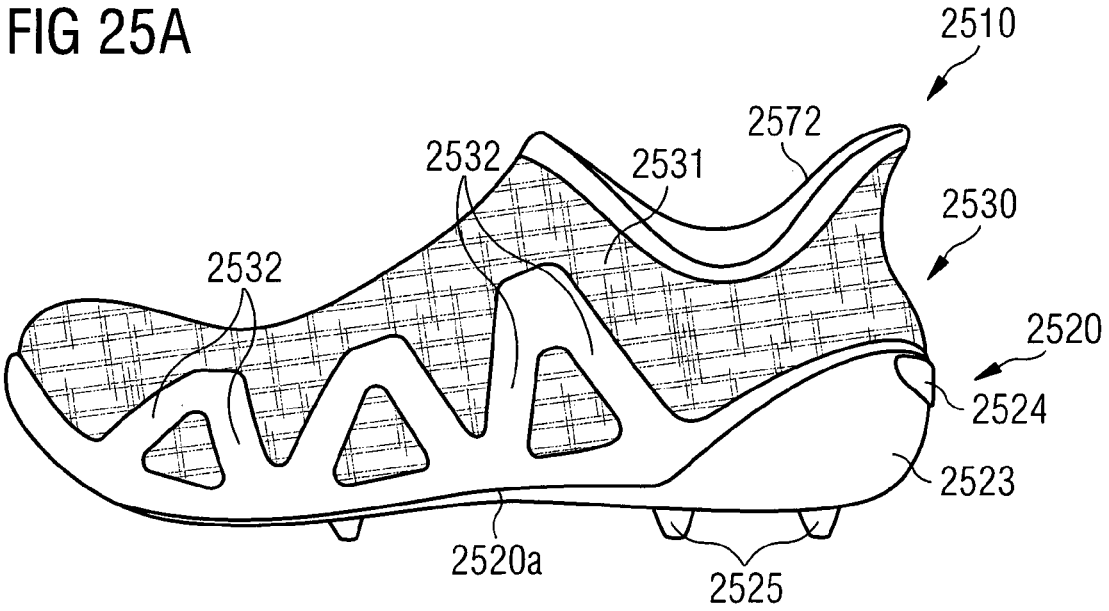
Figure 25B:
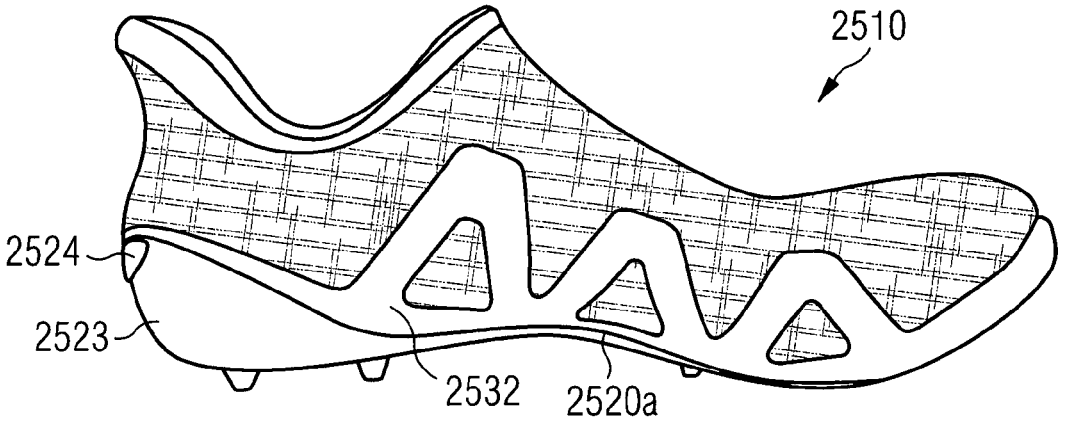
Figure 25C:
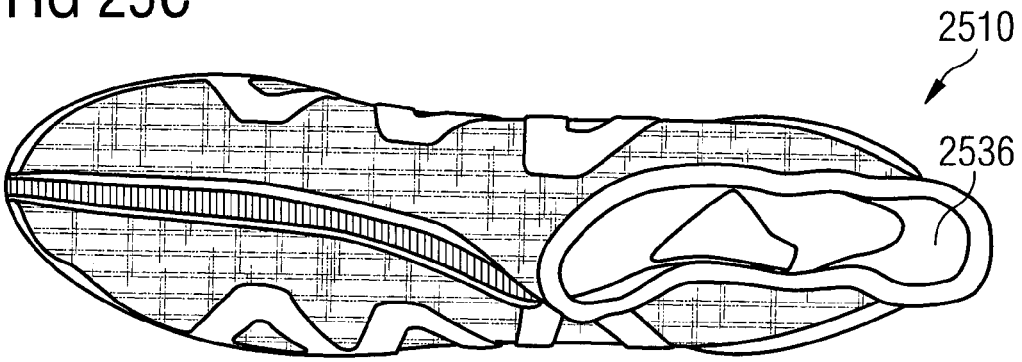

Moreover, upper part portion 2530 may comprise at least one stiffening element 2532. Stiffening elements 2532 may generally be—but need not be—designed similarly as stiffening elements 478 described with reference to FIGS. 4A-B. Stiffening elements 2532 may for example be provided to reduce the stretchability of upper part portion 2530, and e.g. comprise a non-stretchable material. For example, at least one stiffening element 2532 may be arranged in a lateral side region and/or a medial side region of upper part portion 2530. In the example of FIGS. 25A-B, six stiffening elements 2532 are provided at the medial side region and the lateral side region, each. Stiffening elements 2532 may be arranged to extend essentially in a vertical direction, e.g. from the sole portion 2520 upwards towards the instep region of upper part portion 2530. However, they may also be arranged to extend in an inclined manner, e.g. inclined towards the rear side of upper part portion 2530 or inclined towards the front side of upper part portion 2530. Stiffening elements 2532 may be adapted to meet or merge into each other. For example, a first stiffening element 2532 inclined towards the rear side of upper part portion 2530 may be arranged to meet or merge into a second stiffening element 2532 inclined towards the front side of upper part portion 2530. For example, the first and second stiffening elements 2532 may meet or merge into each other at their top ends. For example, they may form a triangular shape at the medial and/or lateral side regions of upper part portion 2530, cf. FIGS. 25A-B.

Although described with reference to upper part portion 2530, the at least one stiffening element 2532 may also extend into a sole region. For example, the at least one stiffening element 2532 may at least in part cover the bottom of upper part portion 2530, and/or the edges between the bottom and the sides of upper part portion 2530, e.g. in the toe region, a midfoot region, and/or the heel region. For example, sole portion 2520 may comprise a base element 2520*a*. Base element 2520*a* may form a sole plate of frame 2510. The at least one stiffening element 2532 may extend beneath base element 2520*a*, or it may extend above base element 2520*a*. The at least one stiffening element 2532 may for example at least partly overlap with an upper side of base element 2520*a* or with a lower side of base element 2520*a*, e.g. around the edges of the lower side of upper part portion 2530. The at least one stiffening element 2532 and the base element 2520*a* may comprise different materials. It is noted that the at least one stiffening element 2532 may, however, also be integrally formed with sole portion 2520 or at least a portion thereof, e.g. with base element 2520*a*, e.g. monolithically. The stiffening element 2532 and/or the base portion 2520*a* may be connected to the stretchable and/or elastic material 2531 of upper part portion 2530. For example, a material of base element 2520*a* may be identical to a material used for or comprised by the at least one stiffening element 2532. In other words, upper part portion 2530 and sole portion 2520 discerned with different reference numerals for ease of illustration in FIGS. 25A-F may be closely interrelated and their manufacturing may not clearly be separated. Therefore, in other similar examples, it may not be useful to discern upper part portions and sole portions but rather both should be considered as integral part of frame 2510. In particular, aspects described with reference to upper part portion 2530 may be interchanged with aspects described with reference to sole portion 2520 (cf. below), and vice versa. Moreover, it is noted that in other example, at least one stiffening element 2532 may be fabricated separately, such that it may not comprise the same material as the base element 2520*a* of sole portion 2520. For example, at least one stiffening element 2532 may comprise a band or tape, e.g. comprising TPU, which is bonded, e.g. glued or pressed, to upper part portion 2530, e.g. to the elastic and/or stretchable material 2531. At least one stiffening element 2532 can also extend to the heel region and can there for be attached between the stretchable and/or elastic material 2531 of the upper part portion 2530 and the sole portion 2530, and/or between the stretchable and/or elastic material 2531 and a heel counter 2523, and/or between the stretchable and/or elastic material 2531 and the base portion 2520*a*.

Frame 2510 may also comprise a plurality of protrusions 2525. One or more protrusions 2525 may e.g. be arranged at a lower side of sole portion 2530.

Sole portion 2520 and/or base element 2520*a* may essentially be geometrically designed similarly to a sole, e.g. extending along a lower side of the foot and extending across the edges of the lower side of the foot around the foot's circumference. However, sole portion 2520 may also comprise the heel counter 2523 to provide further sturdiness in the heel region. Heel counter 2523 and base element 2520*a* may comprise the same material. Heel counter 2523 and base element 2520*a* may for example be fabricated in one piece, e.g. monolithically. In other examples, sole portion 2520 may comprise other and/or further elements for providing increased sturdiness in the heel region and/or in further regions.

Figure 25D:
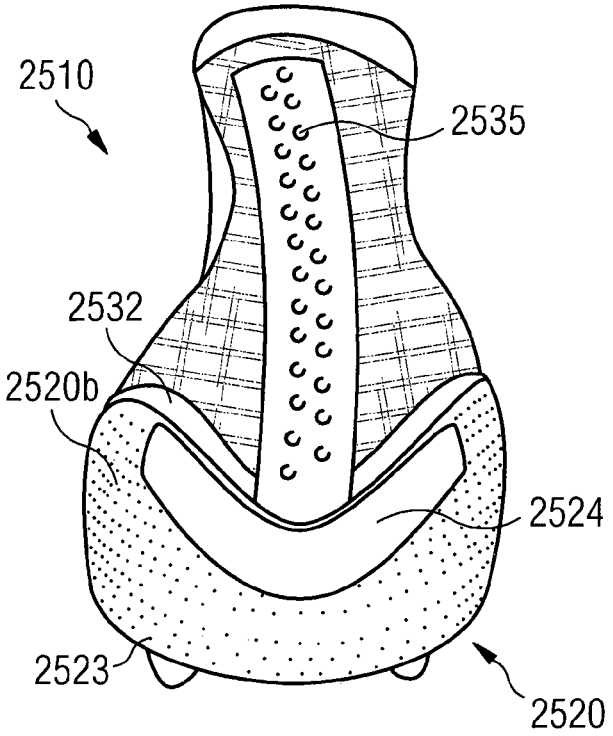
Figure 25E:
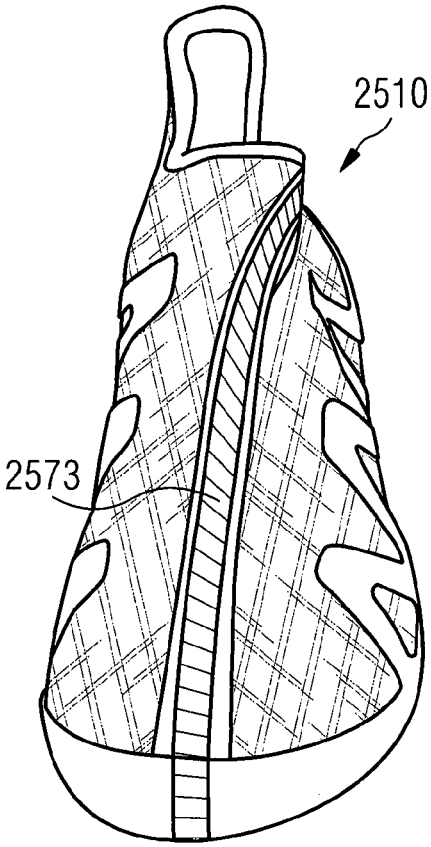
Figure 25F:
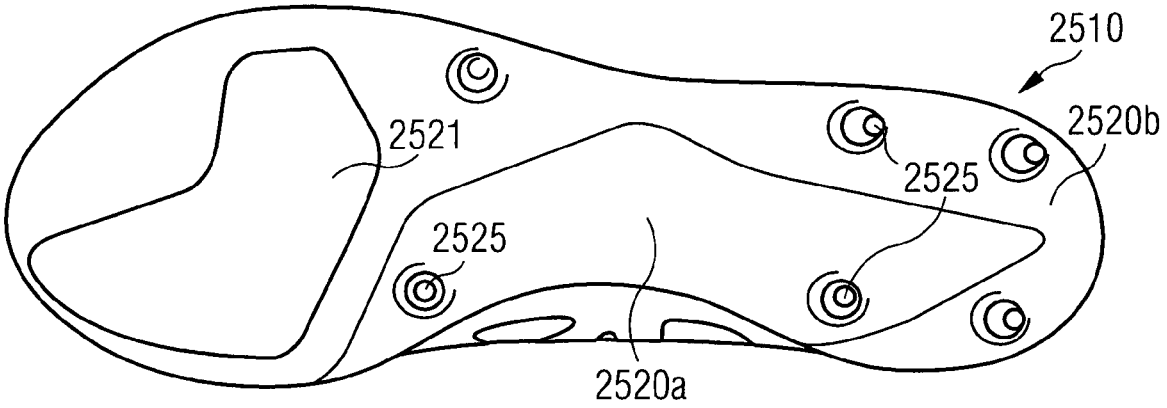

Frame 2520 may also comprise one or more slip-resistant elements 2521 (cf. FIG. 25F). For example, a slip-resistant element 2521 may be provided in a toe region and/or a forefoot region, e.g. at a lower side of frame 2510. For example, slip-resistant element 2521 may be arranged at a lower side of sole portion 2520. Slip-resistant element 2521 may be arranged to extend from a lateral forefoot region to a medial forefoot region, and/or it may extend in a medial toe region. A lateral toe region may remain free from slip-resistant element 2521, as shown in FIG. 25F.

It has been found out that arranging slip-resistant element 2521 according to a pressure map that is expected for the respective shoe's usage, e.g. when running, greatly facilitates the sturdiness of the modular shoe provided with frame 2510. Relative movements of frame 2510 and an outer shoe to be arranged around frame 2510 may then be avoided most effectively. For example, typically, a large amount of pressure is exerted in the region of the big toe and along the ball of the foot. Hence, arranging slip-resistant element 2521 e.g. in the region of the big toe (e.g. the medial toe region) or in the region of the ball of the foot (e.g. medial forefoot region to lateral forefoot region) allows exerting particularly increased friction forces between frame 2510 and an outer shoe, such that relative movements may be avoided. On the other hand, if the region of the big toe and/or the region of the ball of the foot remain free from slip-resistant element 2521, frame 2510 may be prone to relative movements with respect to an outer shoe during use. In other example, slip-resistant element 2521 may extend throughout the entire forefoot region. Slip resistant element 2521 may additionally or alternatively also be arranged at different locations, e.g. at other regions of the lower side of frame 2510 and/or of sole portion 2520.

Slip-resistant element 2521 may comprise or essentially consist of rubber. It may also comprise a textile, e.g. a rubberized textile. In other examples, slip-resistant element 2521 may comprise PU, TPU, soft TPU etc. Slip-resistant element 2521 may be bonded, e.g. glued or pressed (e.g. heat-pressed) onto frame 2510.

Frame 2510 may, additionally or alternatively, comprise a slip-resistant element 2524, which may be arranged in a heel region and/or any other location of frame 2510. For example, slip-resistant element 2524 may be arranged in a heel region of sole portion 2520. However, it may—additionally or alternatively—also be arranged in a heel region of upper part portion 2520. As can best be seen from FIG. 25D, slip-resistant element 2524 may for example comprise an approximate V-shape and/or may be arranged at an upper edge of a rear heel region of sole portion 2520. Slip-resistant element 2524 may significantly suppress relative movements between frame 2510 and an outer shoe arranged around frame 2510, particularly in a vertical direction. Hence, a vertical slipping of the frame 2510 relative to an outer shoe is suppressed. Slip-resistant element 2524 may comprise similar materials as described with reference to slip-resistant element 2521.

In a rear heel region, frame 2510 may be provided with a seam tape 2535 (cf. FIG. 25D). Seam tape 2535 may run along a vertical direction from the upper edge of frame 2510 towards the lower end of the heel, e.g. to cover a split of the of the upper part portion 2530. It may essentially follow the shape of the Achilles tendon. Seam tape 2535 may also help increasing the sturdiness of frame 2510 in the heel region. Moreover, it may comprise a slip-resistant material and thus form a slip-resistant element, primarily preventing vertical relative movements of frame 2510 with respect to an outer shoe arranged around frame 2510. To this end, seam tape 2535 may also be provided with one or more structure elements, e.g. dots as shown in FIG. 25D. For example, seam tape 2535 and/or one or more of its structure elements may comprise silicone. The structure elements may be attached to seam tape 2535 or they may also be integrally formed with seam tape 2535, e.g. by using a corresponding mold. In some examples, more generally a stabilizing heel portion may be provided, which may be configured as described with reference to seam tape 2535 above, but which not necessarily comprises a tape and which not necessarily covers a split.

Frame 2510 may comprise a further slip-resistant element 2520*b*. Slip-resistant element 2520*b* may extend across substantial parts of frame 2510. For example, it may be arranged at a majority of the outer sides (lower side and side faces) of sole portion 2520, or even the entire outer sides of sole portion 2520. Slip-resistant element 2520*b* may provide increased friction with an outer shoe arranged around frame 2510. Slip-resistant element 2520*b* may comprise a static friction, which is higher than that of base element 2520*a* of sole element 2520, in which slip-resistant element 2520*b* is not provided. However, the static friction of slip-resistant element 2520*b* may be lower than that of slip-resistant elements 2521 and/or 2524, respectively. Slip-resistant element 2520*b* may comprise a thickness, which is lower than a thickness of slip-resistant element 2521 and/or 2524, respectively.

As shown in the example of FIG. 25A-F, slip-resistant element 2520*b* may be arranged at the lower side of sole portion 2520, e.g. in a forefoot region, a lateral midfoot region and a rearfoot region. A medial midfoot region may for example remain free from the slip-resistant element 2520*b*. Slip-resistant element 2520*b* may also be arranged at heel counter 2523 of sole portion 2520 and/or at edges of the lower side of sole portion 2520 around the circumference of the foot. An upper rim of sole portion 2520 and/or one or more stiffening elements 2532 may remain free from slip-resistant element 2520*b*. While slip-resistant element 2520*b* generally increases the sturdiness provided by frame 2510 by inhibiting relative motion of an outer shoe via increased static friction, leaving said elements of frame 2510 free from slip-resistant element 2520*b* may facilitate covering frame 2510 with an outer shoe.

For example, slip-resistant element 2520*b* may be provided as a coating or film. It may additionally or alternatively comprise at least one structure element. Structure elements may also be formed, e.g. by using a corresponding mold. Structure elements may e.g. be formed integrally with other parts of sole portion 2520, e.g. with base element 2520*a*. In the example of FIG. 25A-F, a plurality of dots are provided. The slip-resistant element 2520*b* and/or its structure elements may for example comprise silicone.

Generally, slip-resistant elements may also be provided on an outer shoe that is adapted to be arranged around a frame. For example, slip-resistant elements identical to those as explained above with reference to FIGS. 25A-F may be provided at an inner side of an outer shoe at corresponding locations. Such slip-resistant elements may be provided instead of the corresponding elements on the frame. However, it has turned out to be particularly effective, if a slip-resistant element on the frame can act together with a corresponding slip-resistant element on the outer shoe. Hence, corresponding slip-resistant elements may be provided at an inner side of an outer shoe in addition to those provided at the frame. This particularly applies to the slip-resistant element 2524 (or seam tape 2535 that may act as slip resistant element) provided in the heel region of frame 2510, and to a corresponding counter-element in the heel region of an inner side of an outer shoe.

Optionally, upper part portion 2530 may be provided with a lining 2536 in a heel region, e.g. in the region of the heel counter 2523. Hence, the forces acting on the foot due to the increased stiffness provided by the heel counter may be attenuated.

Base element 2520*a* may be manufactured monolithically with one or more protrusions 2525 and/or heel counter 2523, e.g. by molding or injection molding.

In an example, base element 2520*a* and/or the at least one stiffening element 2532 and/or the at least one protrusion 2525 and/or heel counter 2523 may comprise a PU, e.g. a TPU, or a polyamide, e.g. polyamide 11. For example, a polyamide, which comprises at least one fiber may be used, for example a polyamide (e.g., polyamide 11) reinforced with glass fibers. Base element 2520*a* and/or heel counter 2523 (and optionally stiffening element(s) 2532 and/or protrusion(s) 2525) may be provided with one or more slip-resistant elements, e.g. slip-resistant elements 2521, 2524 and/or 2520*b*, as needed and as described above. Base element 2520*a* and/or heel counter 2523 (and optionally stiffening element(s) 2532 and/or protrusion(s) 2525) may be stitched, bonded, e.g. glued or heat-pressed, or connected otherwise in a permanent manner to upper part portion 2530, or its stretchable and/or elastic material 2531, respectively.

Protrusions 2525 may be arranged to engage with corresponding indentations provided by an outer shoe, e.g. in regions of profile elements of the outer shoe, for example in a form-fitting manner. Thus, relative movements of frame 2510 and an outer shoe arranged around frame 2510 may additionally be prevented. Moreover, protrusions 2525 may be provided to reinforce corresponding profile elements provided on an outer shoe.

FIGS. 26A-E show lateral, medial, top, bottom, and zoomed-in views of a further example for a modular shoe 2600 with an outer shoe 2650. Outer shoe 2650 is adapted to be arranged around a frame 2610. For example, frame 2610 may be provided as explained with reference to frame 2510 of FIGS. 25A-F.

Figure 26A:
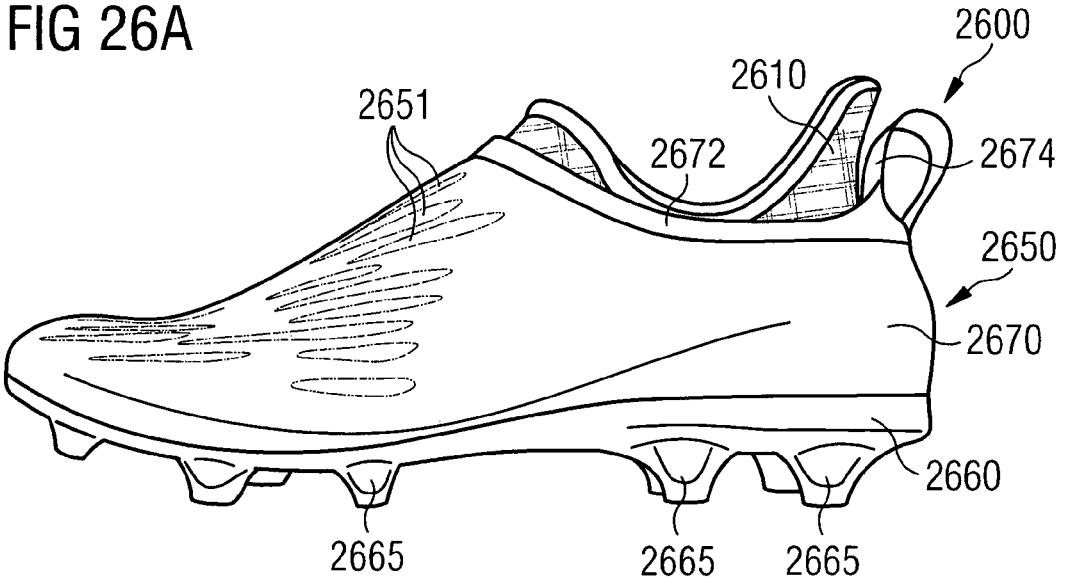
Figure 26B:
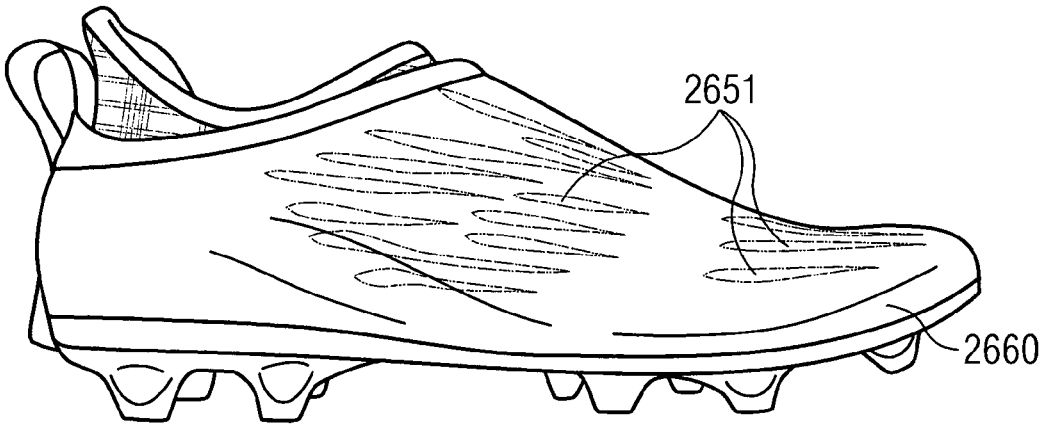
Figure 26C:
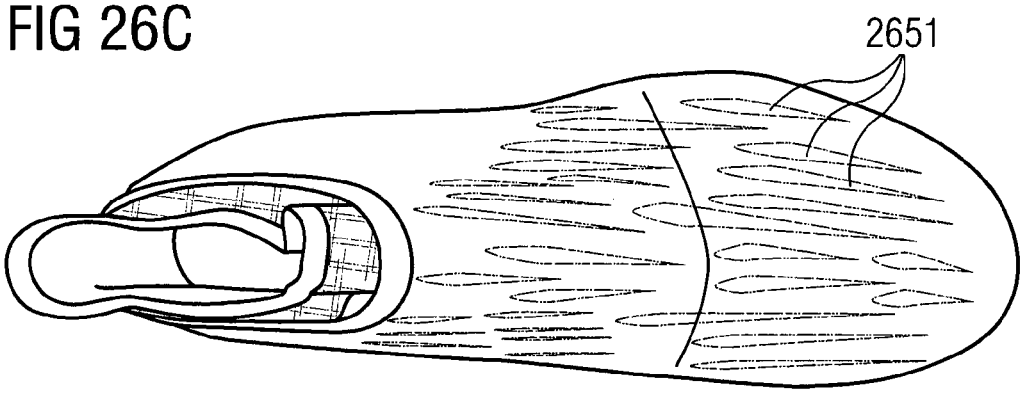
Figure 26D:
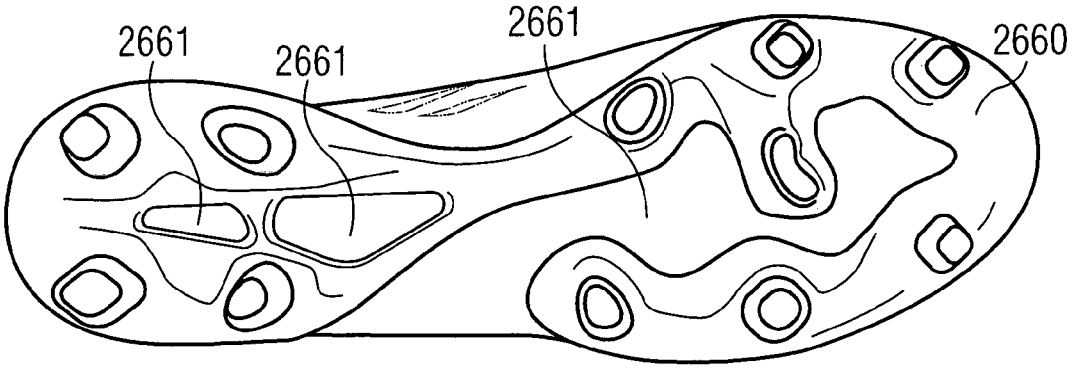

Outer shoe 2650 comprises one or more profile elements 2665 and an upper portion 2670. The one or more profile elements 2665 may be directly attached to the upper portion 2670. However, also a ground portion 2660 may be provided which is arranged at a lower side of upper portion 2670. Profile elements 2665 may be attached to ground portion 2660 or monolithically manufactured with the ground portion. Each profile element 2665 may comprise an indentation 2666, which may be adapted for engagement, e.g. form-fitting engagement, with protrusions of frame 2610. Ground portion 2660 may be arranged continuously at the lower side of outer shoe 2650 and/or around the edges of the lower side of outer shoe 2650 along the circumference of outer shoe 2650. However, as shown in FIG. 26D, also one or more free portions 2661 may be provided at the lower side of outer shoe 2650, in which the ground portion 2660 is not arranged. Free portions 2661 may for example be provided at a central heel region, at a central midfoot region (e.g. below the arch of the foot), wherein these portions may not extend to the edges of the lower side of outer shoe 2650. Moreover, free portions 2661 may be provided at a central forefoot portion. For example, such a free portion 2661 at a central forefoot portion may extend to the lateral edge of the lower side of outer shoe 2650 in a midfoot region. Providing free portions 2661 may make the shoe not only lighter but may also enable to only selectively stiffen the outer shoe along the edges of the outer shoe, as required.

Upper portion 2670 of outer shoe may be arranged in regions of the foot just as a typical upper would be. Upper portion 2670 may comprise a seam 2672 along an upper edge of upper portion 2670, which may extend around an ankle or leg of the wearer. Moreover, upper portion 2670 may comprise a flap 2674, which may be arranged at a rear end of the upper edge of upper portion 2670. Flap 2674 may facilitate pulling outer shoe 2650 over frame 2610 to form modular shoe 2600.

Upper portion 2670 may comprise a material having one or more layers. For example, a two-layer material may be used. For example, a stretchable and/or elastic material may form a base layer, e.g. a film. For example, a synthetic material may be used for that matter, e.g. PU, or a synthetic microfiber material. The base layer may be provided with a second layer, e.g. a film, which may reduce the stretchability of the base layer. For example, TPU may be used for the second layer. For example, the second layer may be heat pressed or printed or vacuum deposited onto the base layer.

For example, the second layer may fully cover the base layer. However, the base layer may remain free from the second layer in regions 2651 (cf. FIGS. 26A-E). For example, the second layer may generally be provided to reinforce the base layer and thus to provide a high strength upper portion 2670. However, in selected regions 2651, the second layer may not be arranged to selectively increase the stretchability of upper portion 2670. Hence, pulling outer shoe 2650 over a frame 2610 may be facilitated. For example, one or more regions 2651 may be designed in an elongate manner and/or arranged in a longitudinal direction of outer shoe 2650, e.g. in a toe portion, and/or a central instep portion, and/or in a lateral instep portion, and/or in a medial instep portion of outer shoe 2650. One or more regions 2651 in the mentioned regions may also be useful, since it may allow an increased adaptation of outer shoe 2670 to varying sizes of the arch of the foot of the respective wearer. The regions 2651 may also have other shapes and dimensions, e.g. they may be triangular, elliptical, circular, star-shaped, etc. The lateral and/or medial midfoot sides, the lateral and/or medial rearfoot sides as well as the rear side of upper portion 2670 may not comprise any regions 2651. This may maximize the sturdiness of shoe 2600 for lateral movements and around the heel portion of shoe 2600. Apart from these functional aspects, a layered structure of outer shoe 2650 may also be used to provide outer shoe 2650 with a specific optical design.

For example, regions 2651 can be created directly when printing, heat-pressing or otherwise applying the second layer onto the base layer. However, regions 2651 may also be created within a continuous second layer, e.g. by laser-cutting, prior to or after application to the base layer.

It is noted that the material used for the upper portion 2670 may also comprise additional layers and/or elements. Therefore, the wordings base layer and second layer are only used for illustrative purposes and should not be reduced to their literal meaning. For example, additional layers may be provided between the base layer and the second layer. Moreover, additional layers may be provided at that side of the base layer that opposes the second layer. Additional layers may for example be printed (e.g. by 3D printing), heat-pressed, vacuum-deposited, or otherwise applied. It is noted that such an additional layer may be provided above (e.g. on top of the second layer) or below the second layer (e.g. directly on the base layer).

For example, a print layer that may, e.g., serve optical design purposes may be used as an additional layer. The print layer may comprise a 3D structure, e.g. created by 3D-printing. A 3D structure may allow improved ball control for a soccer shoe, which is generally difficult to achieve by means of thin layers or stretchable materials. Hence, an additional layer, e.g. a print layer, may not only be used for design purposes but generally also improve the functionality of outer shoe. It is noted that the print layer may be applied onto the base layer and the second layer may be applied on top of the base and print layers. In an example, a synthetic stretchable material is used as base layer on which a 3D printed layer is applied. A TPU layer is used as second layer and applied on top of the base layer and the 3D printed layer.

Said material comprising one or more layers may be arranged essentially throughout the upper portion 2670 of outer shoe 2650. In other examples, different materials may be used or different materials may be combined with the material explained above, e.g. used as base layer and/or second layer. Such different materials may for example comprise leather, a knitted material (e.g. warp-knitted and/or weft-knitted, which may be flat knitted, and/or which may comprise a coating, e.g. as described in EP 2649898 A1, EP 2792265 A1, or EP 2792264 A1), and/or a mesh material, e.g. a coated mesh material. In particular, when using a knitted or mesh material for the base layer, the second layer may be applied by vacuum deposition.

Figure 26E:
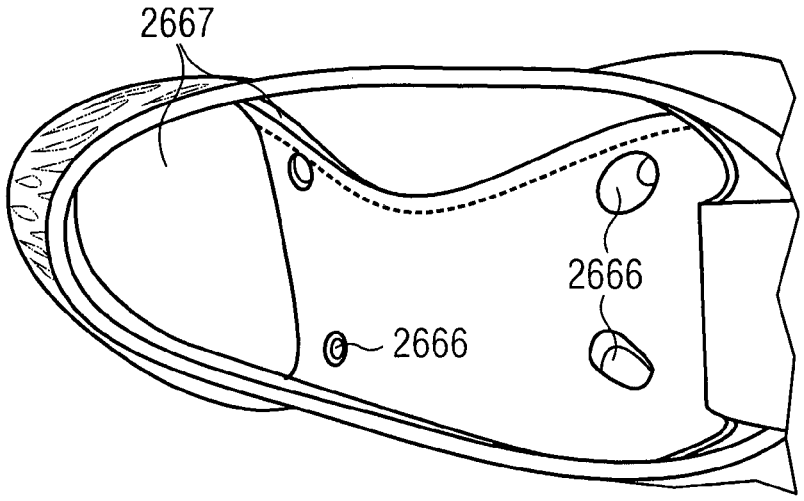

On an inner side of outer shoe 2650, further elements may be provided, e.g. slip-resistant elements, as explained in detail with reference to FIGS. 25A-F. Moreover, one or more stiffening elements 2667, such as a stiffening plate, may be provided on an inner side of outer shoe 2650. As shown in FIG. 26E, stiffening element 2667 may for example be arranged at a heel region. The sturdiness provided by outer shoe 2650 may thus further be improved. The stiffening element 2667 may be arranged on a bottom heel side, a rear heal side, a lateral heel side, and/or a medial heel side.

In other examples, a slip-resistant element may be arranged on the inner side of outer shoe 2650 and e.g. be arranged as explained with reference to stiffening element 2667. One or more of such slip-resistant elements may be provided, e.g., similarly as the slip-resistant elements 2521, 2524 and/or 2520*b* explained with reference to FIGS. 25A-F. In particular, one or more slip-resistant elements on the inner side of outer shoe 2650 may interact with one or more slip-resistant elements on frame 2610, e.g. with slip-resistant elements 2524, 2520*b* and/or with seam tape 2535, which frame 2610 may be provided with.

It is noted that slip-resistant elements on the inner side of outer shoe 2650 may also be provided in addition to one or more stiffening elements 2667. For example, one or more slip-resistant elements may be arranged above, e.g. on top of, the one or more stiffening elements 2667.

FIG. 27 shows a bottom view of a further example for a frame 2710. Frame 2710 may generally be designed similarly as explained with reference to the frames further above. Frame 2710 comprises one or more slip-resistant elements 2721, which may be arranged at a lower side of frame 2710, e.g. a lower side of a sole portion of frame 2710. Slip-resistant elements 2721 may be provided to inhibit relative movement of frame 2710 with respect to an outer shoe arranged around it, similarly as explained with reference to other slip-resistant elements further above. In particular, one or more slip-resistant elements 2721 may be provided to cover at least a majority of the lower side of frame 2710. For example, two slip-resistant elements 2721 may be provided. A first slip-resistant element 2721 may be provided in a front portion of frame 2710. It may for example be arranged in a region of the big toe and/or of the ball of the foot. Moreover, it may be arranged in lateral toe region. A center toe region may remain free from the first slip-resistant element 2721. A second slip resistant element 2721 may be arranged in a heel region of frame 2710. For example, it may be arranged in a lateral heel region and/or a medial heel region and/or a rear heel region. The arrangement of the one or more slip-resistant elements 2721 may follow the expected force distribution within frame 2710 during use such that their effect may be maximized. A midfoot region of the frame may remain free from slip-resistant elements 2721. There, the expected forces are typically low. Frame 2710 may in some examples not comprise any protrusions at its lower side.

In the following, further embodiments are described to facilitate the understanding of the invention:

1. A sock-like outer shoe for a releasable arrangement around a frame (110, 910, 1210, 1710, 1810, 1910, 2010) to provide a modular shoe (100, 900, 1200, 1700, 1800, 1900, 2000), in particular a sports shoe, wherein the sock-like outer shoe comprises:

a plurality of profile elements (165, 965, 1265, 1765, 1865, 1965, 2065), wherein at least one of the profile elements (165, 965, 1265, 1765, 1865, 1965, 2065) extends from an outer side of the sock-like shoe (150, 950, 1250, 1750, 1850, 1950, 2050), wherein a region of the at least one of the profile elements (165, 965, 1265, 1765, 1865, 1965, 2065) is configured to releasably engage in a form-fitting manner with a lower side of the frame of the modular shoe.

2. The outer shoe according to embodiment 1, wherein the plurality of profile elements (165, 965, 1265, 1765, 1865, 1965, 2065) comprises a plurality of studs.

3. The outer shoe according to embodiment 1 or 2, wherein at least one of the profile elements (165, 965, 1265, 1765, 1865, 1965, 2065) comprises an indentation for the form-fitting engagement with a protrusion on the lower side of the frame.

4. The outer shoe according to any one of the preceding embodiments, wherein the outer shoe comprises a flexible material, in particular a textile, a fabric, a knitted fabric, polyurethane, leather, polyamide 12, a polyether block amide, PEBA and/or a thermoplastic polyurethane, TPU.

5. The outer shoe according to any one of the preceding embodiments, wherein the outer shoe comprises an elastic material.

6. The outer shoe according to any one of the preceding embodiments wherein the plurality of profile elements (165, 965, 1265, 1765, 1865, 1965, 2065) is injected onto the outer shoe via injection molding.

7. The outer shoe according to any one of the preceding embodiments, wherein the outer shoe comprises at least one zone, which is adapted to provide an increased friction for contact with a ball.

8. The outer shoe according to any one of the preceding embodiments, wherein the outer shoe comprises a toe region.

9. The outer shoe according to any one of the preceding embodiments, wherein the outer shoe comprises a ground portion (960) and an upper portion (970).

10. The outer shoe according to embodiment 9, wherein the ground portion (960) comprises a material, which the upper portion (970) is free from.

11. The outer shoe according to embodiments 9 or 10, wherein the upper portion (970) comprises a material, which is more elastic than a material of the ground portion (960).

12. The outer shoe according to any one of embodiments 9 to 11, wherein the ground portion (960) and the upper portion (970) are permanently connected with each other.

13. A frame for a releasable arrangement of a sock-like outer shoe (150, 950, 1250, 1750, 1850, 1950, 2050) around the frame to provide a modular shoe (100, 900, 1200, 1700, 1800, 1900, 2000), in particular a sports shoe, wherein the frame comprises:

a. an upper part portion (130, 330, 1230, 1730, 1830, 1930, 2030), b. a sole portion (120, 320, 1220, 1720, 1820, 1920, 2020), wherein c. the frame is configured to encompass a foot, and wherein d. the sole portion comprises a lower side, which is configured to releasably engage in a form-fitting manner with the sock-like outer shoe in a region of at least one profile element (165, 965, 1265, 1765, 1865, 1965, 2065) of the sock-like outer shoe.

14. The frame according to embodiment 13, wherein the sole portion (120, 320, 1220, 1720, 1820, 1920, 2020) comprises at least one protrusion (125, 325, 1225, 1725, 1825, 1925, 2025), which is configured to engage in a form-fitting manner with the at least one profile element (165, 965, 1265, 1765, 1865, 1965, 2065) in the region of the at least one profile element (165, 965, 1265, 1765, 1865, 1965, 2065).

15. The frame according to any one of embodiment 13 or embodiment 14, wherein the sole portion (120, 320, 1220, 1720, 1820, 1920, 2020) is provided at least partially with an anti-slip textile.

16. The frame according to any one of embodiments 13 to 15, wherein the frame is adapted such that an instep region and/or a toe region of the foot are not covered by the frame.

17. The frame according to anyone of embodiments 13 to 16, wherein an upper side of the sole portion (2020) and a lower side of the upper part portion (2030) is configured to releasably engage in at least one region in a form-fitting manner with one another.

18. A modular shoe, in particular a sports shoe, comprising a sock-like outer shoe (150, 950, 1250, 1750, 1850, 1950, 2050) according to any one of embodiments 1 to 12 and a frame (110, 910, 1210, 1710, 1810, 1910, 2010) according to any one of embodiments 13 to 17, wherein a. the sock-like outer shoe is releasably arranged around the frame, and b. a lower side of the frame is engaged in a form-fitting manner with the sock-like outer shoe in a region of at least one profile element (165, 965, 1265, 1765, 1865, 1965, 2065).

19. A sock-like outer shoe for a releasable arrangement around a frame (2210, 2310) to provide a modular shoe (2200, 2300), in particular a sports shoe, wherein the sock-like outer shoe comprises:

a. a plurality of openings (2255, 2355), b. wherein the plurality of openings (2255, 2355) is adapted, so that a plurality of profile elements (2265, 2365*b*) of the frame can extend through the openings, such that a sealing is provided between the openings and the profile elements.

20. The outer shoe according to embodiment 19, wherein at least one of the openings (2255, 2355) comprises a three-dimensional shape, such that, when the outer shoe is arranged around the at least one profile element (2265, 2365*b*) of the frame (2210, 2310) in the region of the at least one opening, a sealing area is provided, which laterally abuts the profile element.

21. The outer shoe according to embodiment 20, wherein the at least one opening (2255, 2355) is configured to be downwardly tapered.

22. A frame for a releasable arrangement of a sock-like outer shoe (2250, 2350) around the frame to provide a modular shoe (2200, 2300), in particular a sports shoe, wherein the frame comprises:

a. an upper part portion (2230, 2330) and a sole portion (2220, 2320), b. wherein the sole portion comprises a lower side with a plurality of profile elements (2265, 2365*b*), c. wherein the plurality of profile elements is adapted, such that it can extend through a plurality of openings (2255, 2355) of the outer shoe, so that a sealing between the openings and the profile elements is provided.

23. A modular shoe, in particular a sports shoe, comprising a sock-like outer shoe (2250, 2350) according to any one of embodiments 19 to 21 and a frame (2210, 2310) according to embodiment 22, wherein a. the sock-like outer shoe is releasably arranged around the frame, and b. the plurality of profile elements (2265, 2365*b*) extends through the plurality of openings (2255, 2355) such that a sealing between the openings and the profile elements is provided.

The invention claimed is:

1. A modular shoe comprising:

a frame comprising a lower side, wherein the lower side is configured to extend beneath a foot of a user when worn, and wherein the frame comprises at least one protrusion extending outwardly from the lower side of the frame; and an outer shoe cover arranged around the frame to provide the modular shoe, wherein the outer shoe is removable from the frame, and wherein the outer shoe cover comprises:

a ground portion configured to extend beneath the foot of the user when worn;

an upper portion; and a plurality of profile elements, wherein the ground portion and the upper portion of the outer shoe cover each form an outermost surface of the modular shoe when the outer shoe cover is assembled with the frame, wherein the plurality of profile elements are fixed on the outermost surface on the ground portion and extend outwardly from the outermost surface on the ground portion of the outer shoe cover, and wherein the at least one protrusion of the frame is releasably engaged with at least one of the plurality of profile elements.

2. The modular shoe according to claim 1, wherein the plurality of profile elements comprises a plurality of studs.

3. The modular shoe according to claim 1, wherein at least one of the profile elements comprises an indentation defined in the ground portion of the outer shoe cover, and wherein the at least one protrusion is selectively positionable in the indentation.

4. The modular shoe according to claim 1, wherein the outer shoe cover comprises a flexible material selected from the group consisting of a textile, a fabric, a knitted fabric, polyurethane, leather, polyamide 12, a polyether block amide (PEBA), and a thermoplastic polyurethane (TPU).

5. The modular shoe according to claim 1, wherein the outer shoe cover comprises an elastic material.

6. The modular shoe according to claim 1, wherein the plurality of profile elements are formed via injection molding.

7. The modular shoe according to claim 1, wherein the outer shoe cover comprises at least one zone comprising a friction element.

8. The modular shoe according to claim 1, wherein the outer shoe cover comprises a toe region.

9. The modular shoe according to claim 1, wherein the ground portion comprises at least one material that is different from a material of, the upper portion.

10. The modular shoe according to claim 1, wherein the upper portion comprises a first material and the ground portion comprises a second material, and wherein the first material is more elastic than the second material of the ground portion.

11. The modular shoe according to claim 1, wherein the ground portion and the upper portion are permanently connected with each other.

12. The modular shoe according to claim 1, wherein the at least one protrusion is form-fittingly engaged with the at least one of the profile element.

13. A modular shoe comprising:

an outer shoe cover, wherein the outer shoe cover comprises a layer forming an outermost surface of the modular shoe when assembled, and wherein the outer shoe cover comprises at least one profile element fixed on the outermost surface and extending outwardly from the outermost surface; and a frame, wherein the outer shoe cover is arranged around the frame to provide the modular shoe, wherein the outer shoe cover is removable from the frame, and wherein the frame comprises:

an upper part portion; and a sole portion connected to the upper part portion, wherein a lower side of the sole portion is configured to extend beneath a foot of a user when worn, wherein the frame is configured to encompass the foot of the user when worn, wherein the lower side of the sole portion comprises at least one protrusion, which is configured to releasably engage with the at least one profile element of the outer shoe cover.

14. The modular shoe according to claim 13, wherein the frame comprises a slip-resistant element arranged on a heel portion of the sole portion of the frame, wherein the slip-resistant element is a first slip-resistant element, and wherein the frame further comprises a second slip-resistant element.

15. The modular shoe according to claim 14, wherein the second slip-resistant element is provided on a forefoot region of the sole portion of the frame.

16. The modular shoe according to claim 14, wherein at least one of the first slip-resistant element or the second slip-resistant element comprises a rubber material.

17. The modular shoe according to claim 14, wherein at least one of the first slip-resistant element or the second slip-resistant element comprises a rubberized textile.

18. The modular shoe according to claim 13, wherein the sole portion of the frame comprises an instep region and a toe region, and wherein at least one of the instep region or the toe region is not covered by the upper part portion of the frame.

19. The modular shoe according to claim 13, wherein the sole portion of the frame is releasably connected to the upper part portion of the frame.

20. The modular shoe according to claim 13, wherein the at least one protrusion on the lower side of the sole portion is configured to releasably engage with the at least one profile element of the outer shoe cover in a form-fitting manner.

21. A modular shoe comprising:

an outer shoe cover comprising:

a layer forming an outermost surface of the modular shoe, the layer comprising a ground portion configured to extend beneath a foot of a user when worn and an upper, portion;

at least one profile element on the outermost surface on the ground portion, the at least one profile element extending outwardly from the outermost surface; and at least one indentation defined in an inner surface of the ground portion and aligned with the at least one profile element, wherein the inner surface is opposite from the outermost surface; and a frame comprising:

an upper part portion;

a sole portion connected to the upper part portion; and at least one protrusion on the sole portion extending outwardly from the sole portion, wherein the outer shoe cover is arranged around the frame and is removable from the frame, and wherein the at least one protrusion of the sole portion of the frame is releasably engaged with the at least one indentation of the outer shoe cover.

22. The modular shoe according to claim 21, wherein the at least one protrusion of the frame is engaged with the at least one indentation in a form-fitting manner.

23. A modular shoe comprising:

a frame comprising:

a lower side configured to extend beneath a foot of a user when worn;

a portion configured to encompass at least a portion of the foot of the user when worn; and at least one profile element fixed on the lower side and extending outwardly from the lower side, an outer shoe cover arranged around the frame to provide the modular shoe, wherein the outer shoe cover is removable from the frame, and wherein the outer shoe cover comprises:

an inner surface;

an outer surface; and a plurality of openings, each opening extending through the outer shoe cover from the inner surface to the outer surface;

wherein the at least one profile element is selectively positioned in at least one opening of the plurality of openings and through the outer shoe cover, wherein the positioning of the at least one profile element in at least one opening of the plurality of openings forms a seal between the at least one opening of the plurality of openings and the at least one profile element, and wherein the lower side, the portion configured to encompass the portion of the foot of the user, and the at least one profile element are connected such that they are removable as a single component from the outer shoe cover.

24. The modular shoe according to claim 23, wherein at least one opening of the plurality of openings comprises a three-dimensional shape, such that, when the outer shoe cover is arranged around the at least one profile element of the frame, a sealing area is provided, which laterally abuts the at least one profile element.

25. The modular shoe according to claim 24, wherein the at least one opening is downwardly tapered.

26. A modular shoe comprising:

an outer shoe cover comprising a layer defining an outermost layer of the modular shoe, wherein the layer defines a plurality of openings; and a frame, wherein the outer shoe cover is arranged around the frame to provide the modular shoe, wherein the outer shoe cover is removable from the frame, and wherein the frame comprises:

an upper part portion;

a sole portion fixed to the upper part portion, the sole portion comprising a lower side configured to extend beneath a foot of a user when worn; and a plurality of profile elements on the lower side of the sole portion and extending outwardly from the lower side of the sole portion, wherein each profile element of the plurality of profile elements is configured to extend through a corresponding opening of the plurality of openings of the outer shoe cover and form a seal.

* * * * *